US008999230B1

(12) United States Patent
Nagarathnam et al.

(10) Patent No.: US 8,999,230 B1
(45) Date of Patent: Apr. 7, 2015

(54) NEAR NET SHAPE FABRICATION OF HIGH TEMPERATURE COMPONENTS USING HIGH PRESSURE COMBUSTION DRIVEN COMPACTION PROCESS

(75) Inventors: Karthik Nagarathnam, Culpeper, VA (US); Donald Trostle, Herndon, VA (US); Dennis Massey, Markham, VA (US)

(73) Assignee: Utron Kinetics, LLC, Manassas, VA (US)

( * ) Notice: Subject to any disclaimer, the term of this patent is extended or adjusted under 35 U.S.C. 154(b) by 1030 days.

(21) Appl. No.: 12/383,948

(22) Filed: Mar. 30, 2009

Related U.S. Application Data

(60) Provisional application No. 61/072,179, filed on Mar. 28, 2008.

(51) Int. Cl.
*B22F 1/00* (2006.01)
*B22F 1/02* (2006.01)
*B22F 3/23* (2006.01)

(52) U.S. Cl.
CPC ..... *B22F 3/23* (2013.01)

(58) Field of Classification Search
USPC ..... 419/45, 38, 58; 148/423; 75/228
IPC ..... B22F 3/087,2998/10; C22C 33/02
See application file for complete search history.

(56) References Cited

U.S. PATENT DOCUMENTS 4,166,375 A 9/1979 Stepantsov et al.
4,599,060 A 7/1986 Flinn et al.
4,658,629 A 4/1987 Milisavljevic
4,863,881 A 9/1989 Ahrens et al.
5,087,435 A 2/1992 Potter et al.
5,405,574 A 4/1995 Chelluri et al.
5,437,744 A * 8/1995 Carlen ..... 148/423
5,611,139 A 3/1997 Chelluri et al.
5,935,461 A 8/1999 Witherspoon et al.
5,989,487 A 11/1999 Yoo et al.
5,996,385 A 12/1999 Kecskes
6,001,304 A 12/1999 Yoo et al.
6,004,120 A 12/1999 Matsubara et al.
6,183,690 B1 2/2001 Yoo et al.
6,187,087 B1 2/2001 Yoo et al.
6,325,965 B1 12/2001 Makita et al.
6,767,505 B2 * 7/2004 Witherspoon et al. ..... 419/45

OTHER PUBLICATIONS

Rusnak, R.M.; *Energy Relationships in the High Velocity Compaction of Copper Powder*; Int. Journal of Powder Metellurgy and Powder technology; vol. 12, No. 2; (Apr. 1976); pp. 91-99.

(Continued)

*Primary Examiner* — Weiping Zhu
(74) *Attorney, Agent, or Firm* — James Creighton Wray

(57) ABSTRACT

New net shape strength retaining high temperature alloy parts are formed from fine metallurgical powders by mechanically blending the powders and placing them in die, placing a piston in the die, extending the piston into a driving chamber, filling the chamber with CH4 and air and compressing the powders with the filling pressure. Igniting gas in the chamber drives the piston into the cavity, producing pressures of about 85 to 150 tsi, compacting the powders into a near net shape alloy part, ready for sintering at 2300° C. without shrinking. The alloy parts are Re, Mo—Re, W—Re, Re—Hf—HfC, Re—Ta—Hf—HfC, Re—Mo—Hf—HfC, Mo—Re—Ta, Mo—Re-f-HfC, W—Re—Hf—HfC, W—Re—Ta—Hf—HfC or W—Re—Mo—Hf alloys.

13 Claims, 56 Drawing Sheets

Schematic of the Combustion Driven Compaction-CDC Process

(56) References Cited

OTHER PUBLICATIONS

Lennon et al.; *Explosive Compaction of Metal Powders*; Powder Metallurgy; No. 1; (1978); pp. 29-34.
Lenel, F.V.; *Powder Metallurgy: Principles and Applications*; Chapter 4, Compacting; Metal Powder Industries Federation, (1980); pp. 99-157.
Raybould, D.; *Dynamic Powder Compaction*; The Carbide and Tool Journal;(Mar.-Apr. 1984); pp. 7-11.
German, R.M.; *Powder Metallurgy Science*; Chapter 5, Compaction; Metal Powder Industries Federation (1984); pp. 113-233.
Gourdin, W.H.; *Dynamic Consolidation of Metal Powders*; Progress in Materials Science, vol. 30, No. 4; pp. 39-80, 1986.
DeLuca, R.J.; *Description of Railgun Deposition Process*; Appendix B to Final Technical Report UTCMSE-87-02; Univ. of Texas at Austin (Feb. 1987).
Baird et al.; *Density-energy Relationships in Explosive Compaction of Metal Powders*; Powder Metallurgy, vol. 30, No. 4 (1987); pp. 281-285.
Yadav et al; *Study of Explosive and Shock Parameters for compaction of Powders*; propellants, Explosives, and Pyrotechnics; vol. 15 (1990); pp. 194-200.
Prummer, R.; *Explosive Compaction in Materials Science*; Metall., 51, Jahrgang, No. 5/97; pp. 333-335, date unknown.
Baird et al.; *Energy Utilization in Explosive Compaction of Metal Powders*; MPR (Feb. 1986); pp. 143-145.
Hagemeyer et al.; *Dynamic Compaction of Metal Powders with a High Velocity Impact Device*; Int. Journal of Powder Metallurgy, vol. 4, No. 3 (1968); pp. 19-25.
Rosato et al.; *Manufacture of Powder Compacts*; International Materials Review; vol. 36, No. 2 (1991) pp. 45-61.
Tidman et al.; *Electrothermal Light Gas Gun*; IEEE Transactions on Magnetics, vol. 29, No. 1, Jan. 1993, pp. 621-624.
Dowding et al.; *Synthesis and consolidation of Nanoparticles*; in Advances in Powder Metallurgy and Particulate Materials—1994 vol. 5 (Specialty Materials and Composites); pp. 45-58.
ASM International Handbook Committee; *ASM Handbook vol. 7, (Powder Technologies and Applications)*; (1998) pp. 315-320.

* cited by examiner

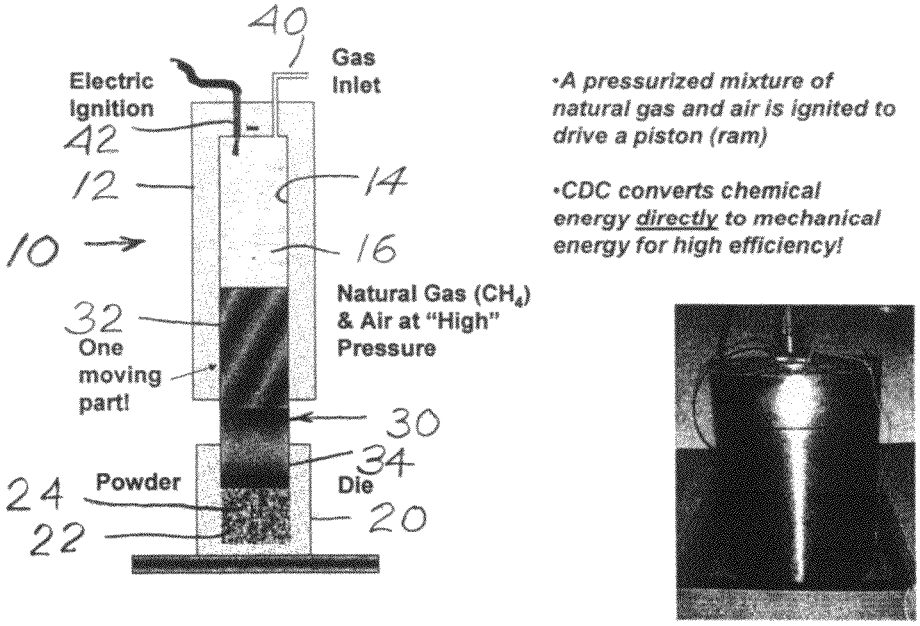
Fig. 1 Schematic of the Combustion Driven Compaction-CDC Process

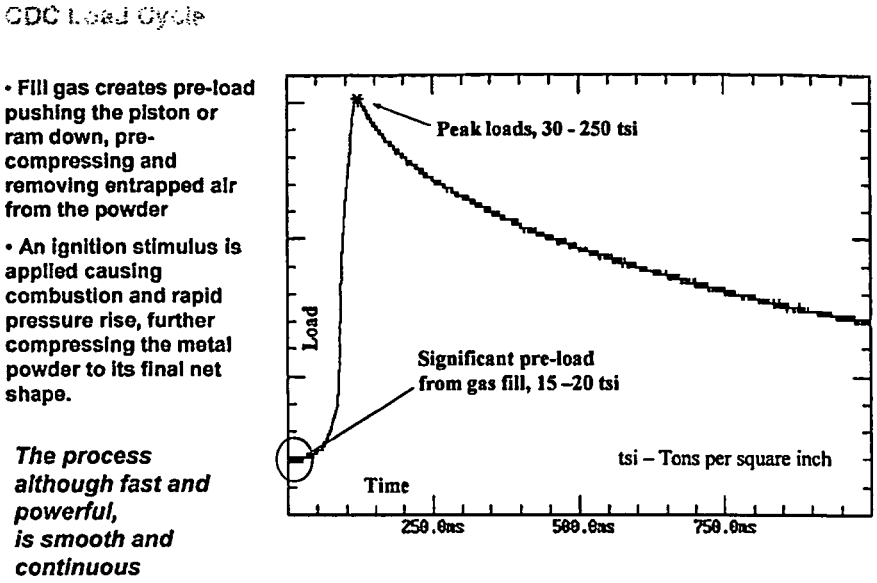
Fig. 2 Typical CDC High Pressure Compaction Loading Cycle

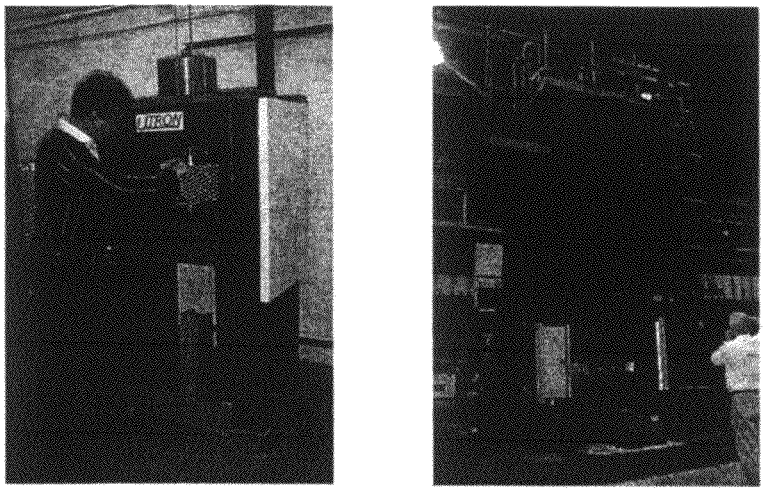
Fig. 3 Compactness Comparison of 300 Ton CDC Press with Traditional Press

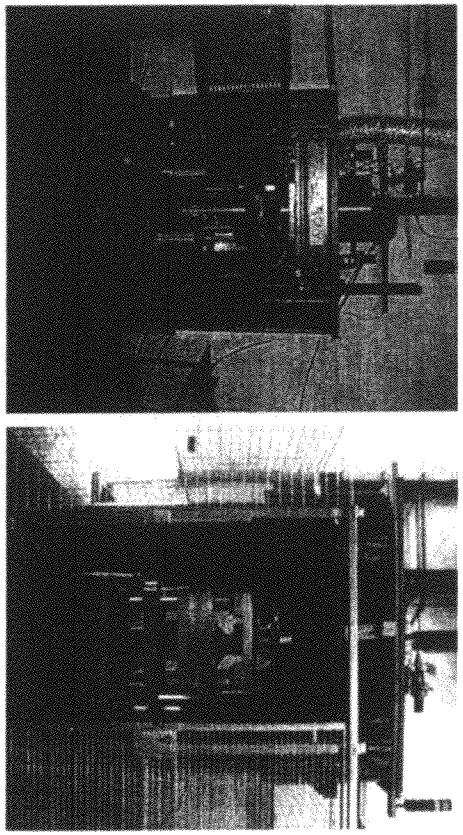
Fig, 4 300 and 1000 Ton CDC Press

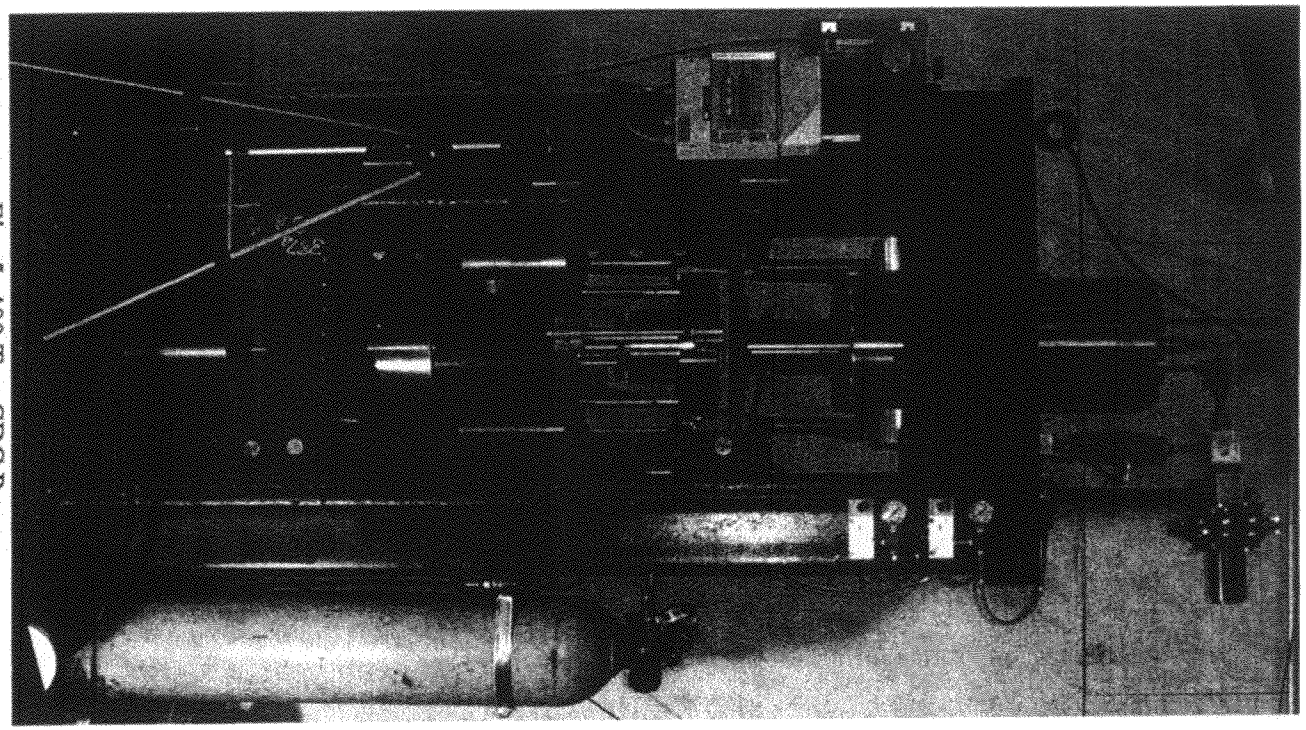
Fig. 5 400 Ton CDC Press

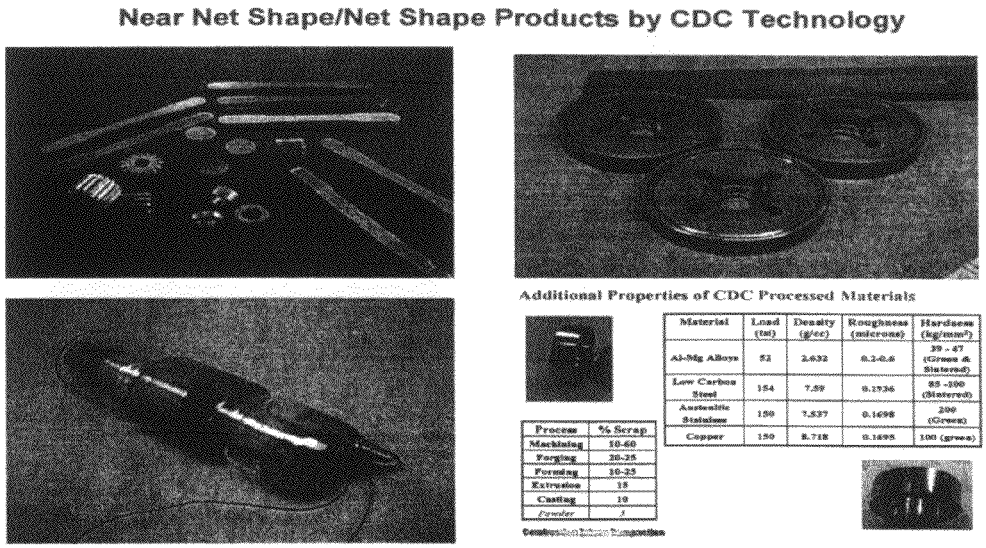

Fig. 6 CDC High Pressure Compacted Near Net Shape and Net Shape Geometries of a Variety of Materials (a) Single layered and Multilayered (e.g., Stainless Steel/Copper) Parts b) CDC Copper Disks for Next Generation Linear Colliders c) Net Shaped High Density CDC Tungsten Disk Targets for X-ray Tube Applications d) CDC Compacted Properties of Al, Steel, Stainless Steel and Copper and Comparison of Various Manufacturing Processes (% Scrap Metals)

NanoSiC, Dielectric Grade SiC
Armor Grade SiC
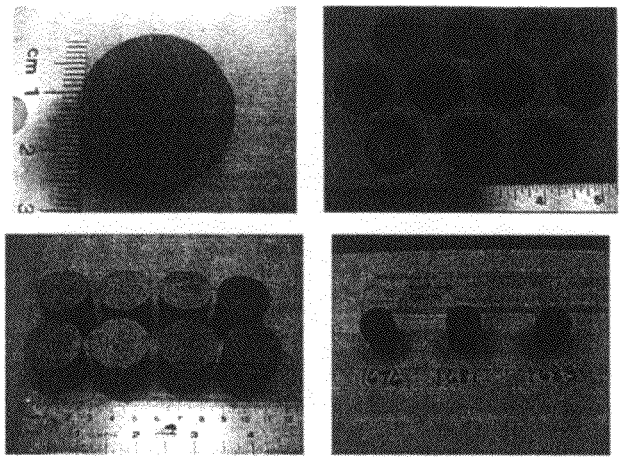
Fig. 7 CDC Processed Ceramics

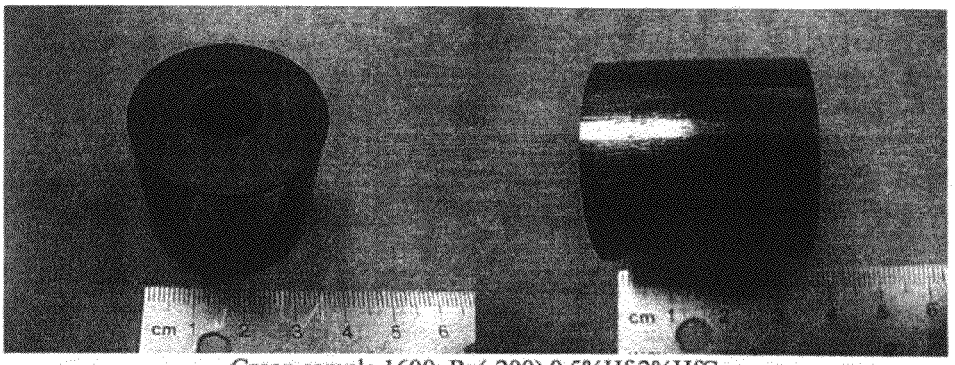
Green sample 1600; Re(-200) 0.5%Hf 2%HfC
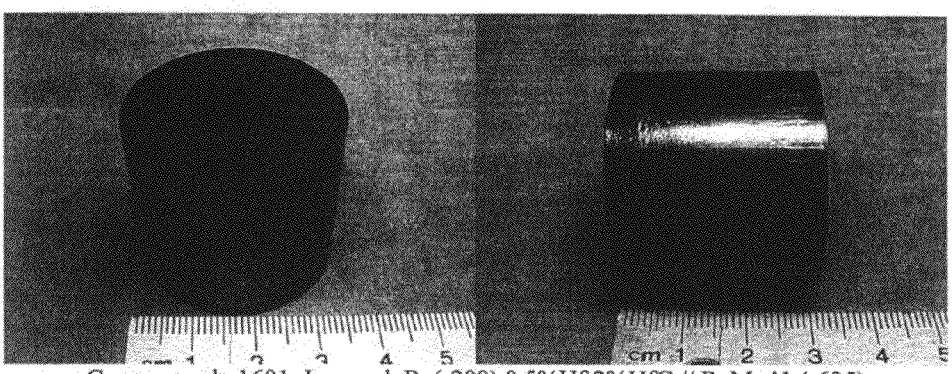
Green sample 1601; Layered, Re(-200) 0.5%Hf 2%HfC // ReMo41 (-635)
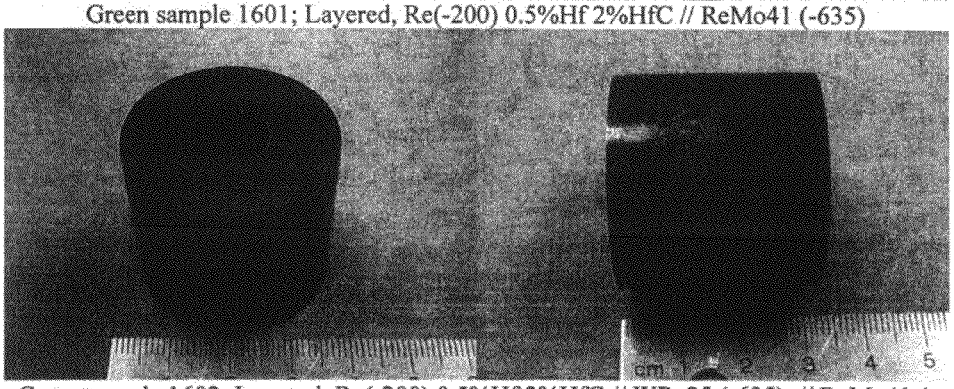
Green sample 1602; Layered, Re(-200) 0.5%Hf 2%HfC // WRe25 (-635) // ReMo41 (-635)
Fig. 8 CDC Compacted Functional Gradient Materials (FGM) for High Temperature Protection

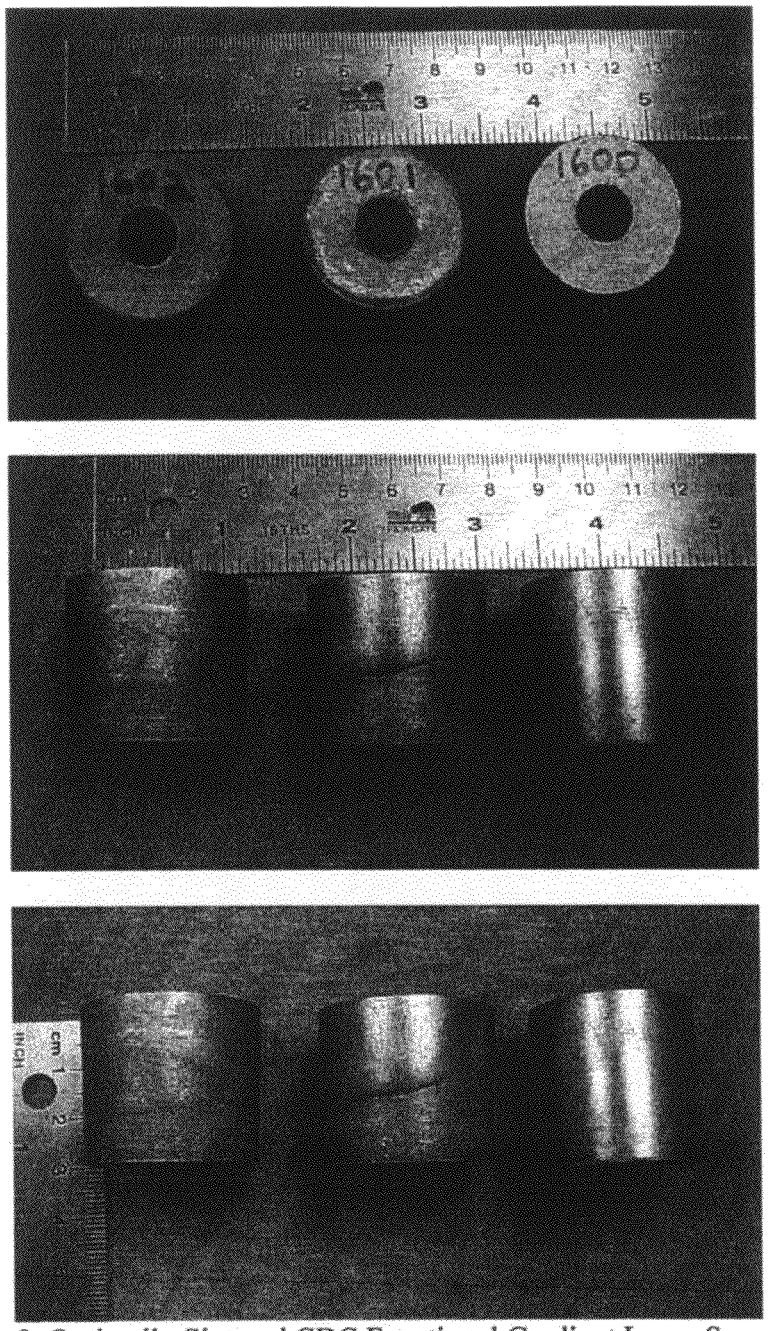
Fig. 9 Optimally Sintered CDC Functional Gradient Layer Samples;
1600; Re(-200) 0.5%Hf 2%HfC
1601; Layered, Re(-200) 0.5%Hf 2%HfC // ReMo41 (-635)
1602; Layered, Re(-200) 0.5%Hf 2%HfC // WRe25 (-635) // ReMo41 (-635)

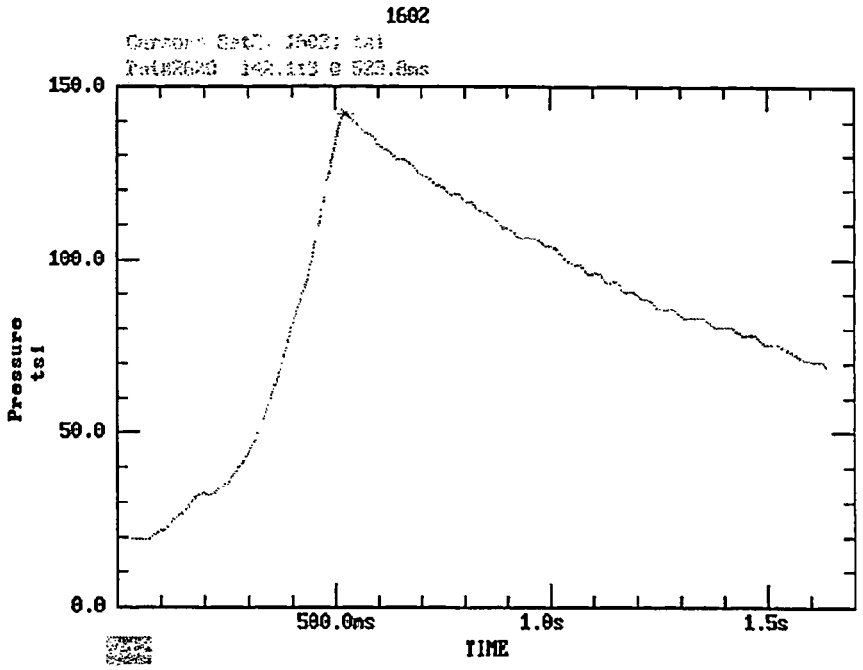
Fig. 10 CDC Loading graph for Functional Gradient Materials for High Temperature Applications (Sample 1602)

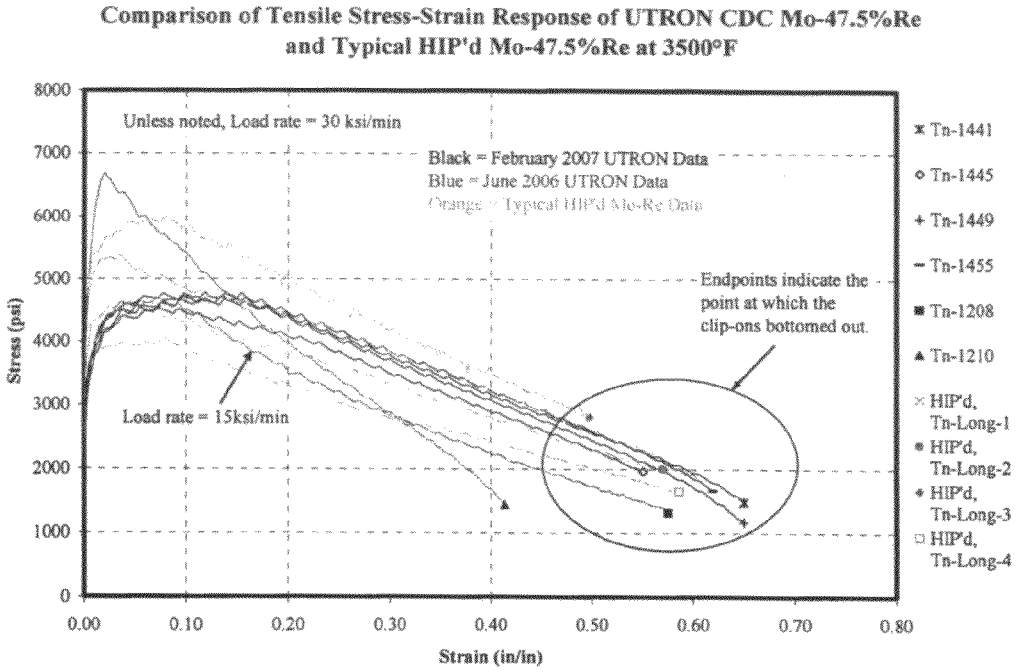
Fig. 11 High Temperature Data at 3500 deg F of Previously Tested CDC Mo-47.5% Re Samples Compacted at 150 tsi together with HIPed Material Data High Temperature Mechanical Test Results of CDC-Mo-47.5%Re @ 3500°F
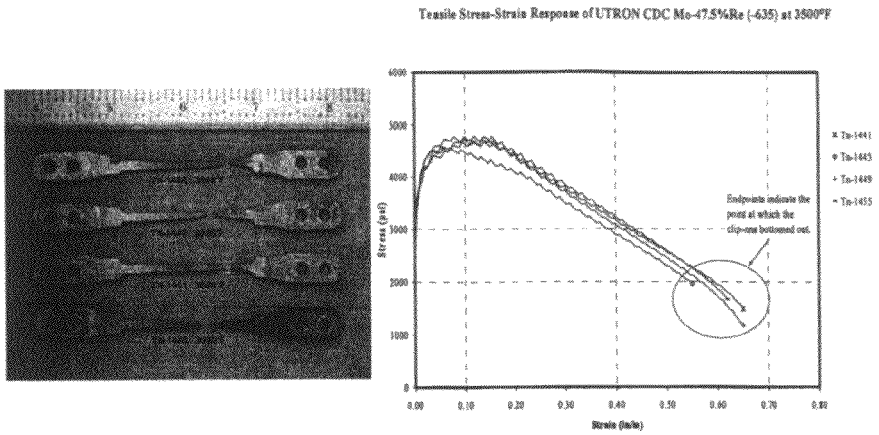
Fig. 12 Fractured Samples Indicating Excellent Ductility in the form of Necking @ 3500 deg F

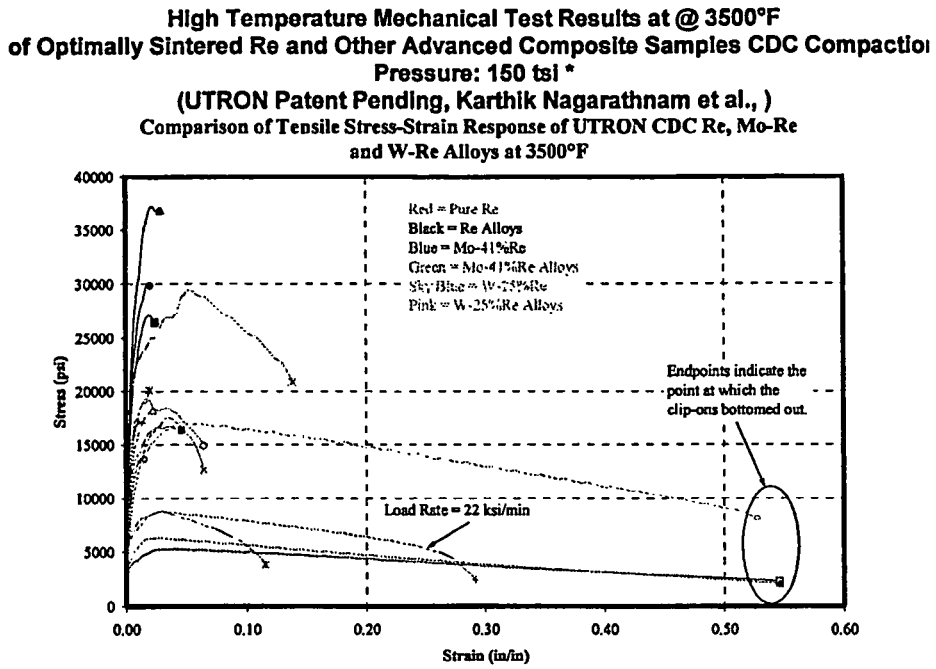
Fig. 13. High Temperature Mechanical Properties of CDC Compacted and Optimally Sintered Re, Mo and W-Based alloy Samples

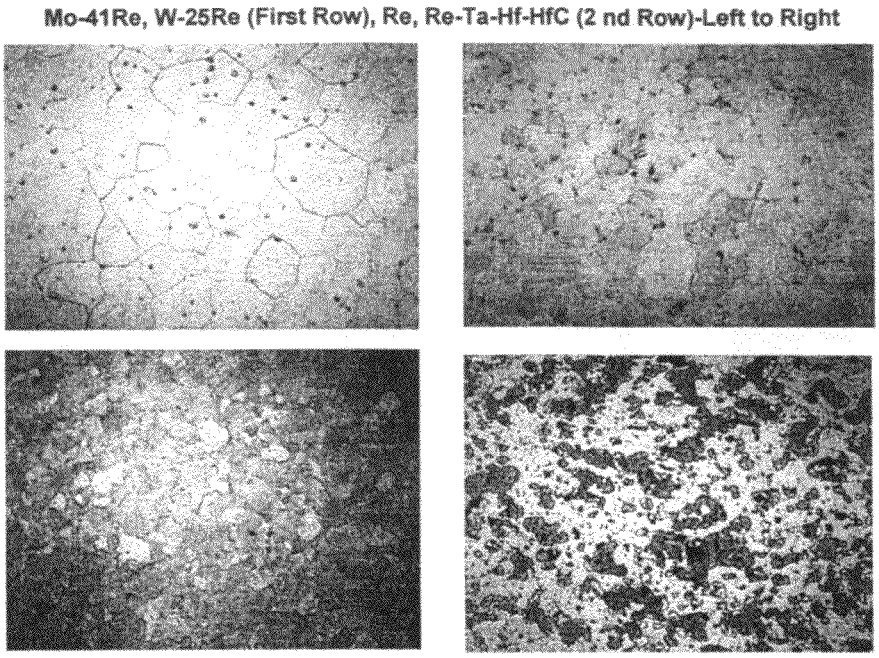
Fig. 14. Microstructures of CDC Compacted and Processed High Temperature AlloysMo-41 Re, W-25Re and Re-Ta-Hf-HfC (200X) and Re (250 X)

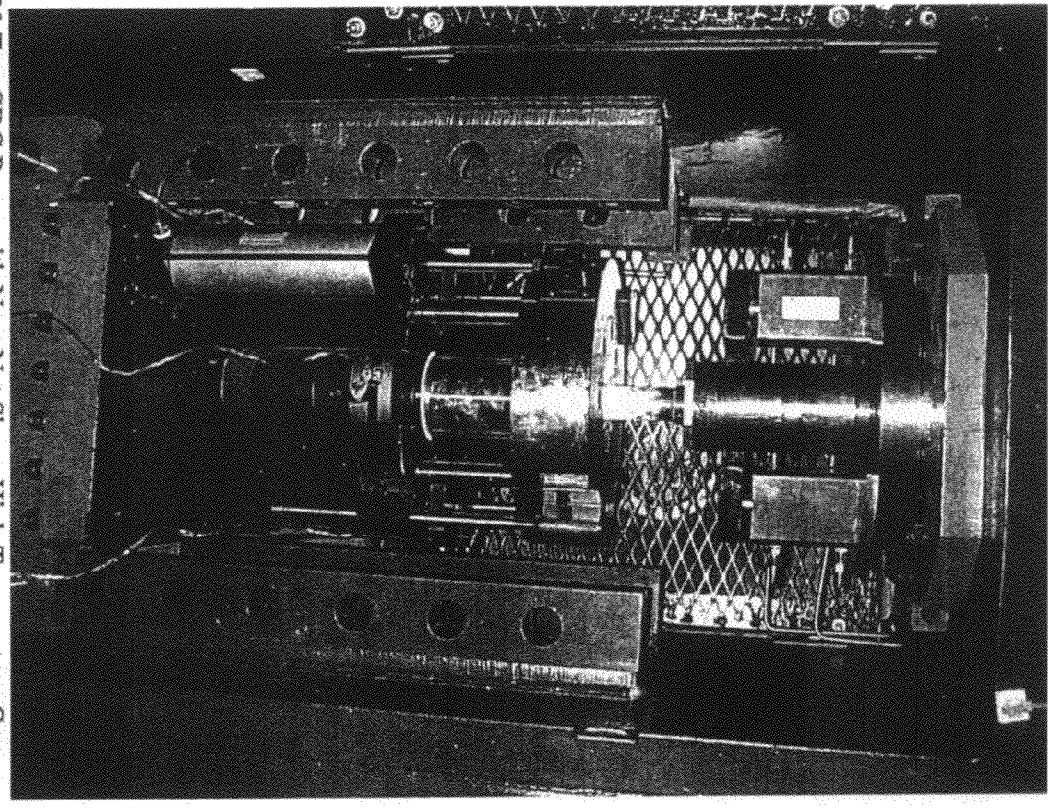
Fig. 15 300 Ton CDC Press with Near Net Shape High Temperature Component-Design C tooling

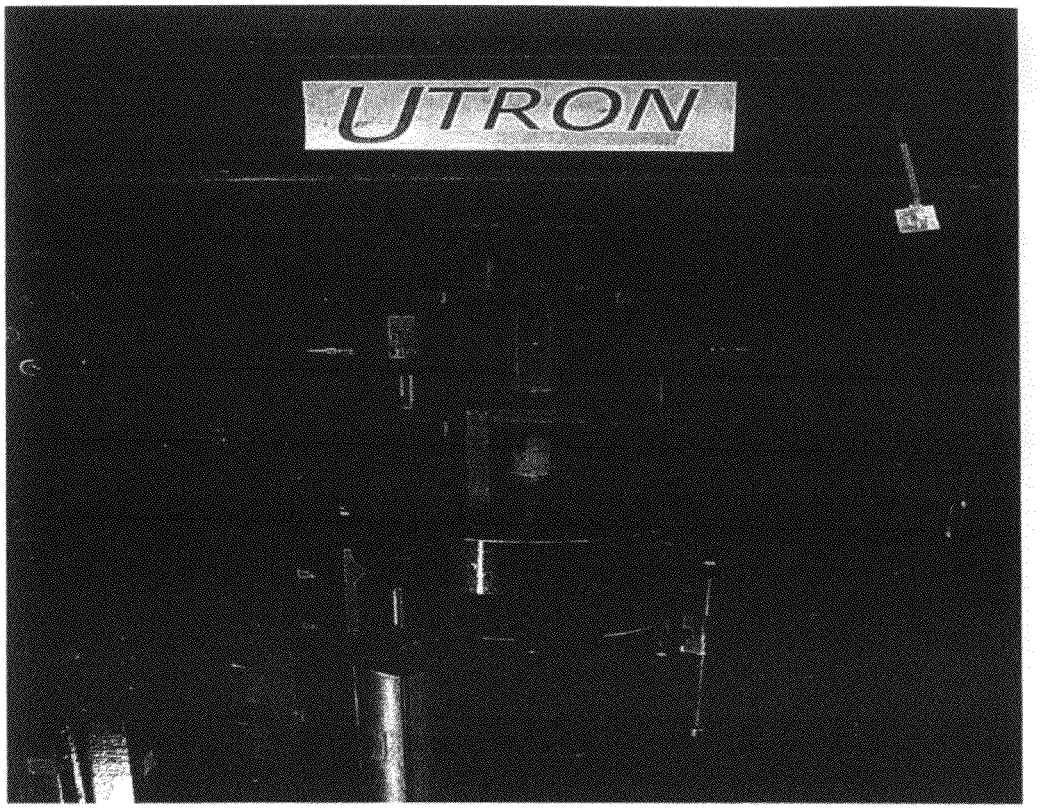
Fig. 16 CDC Compacted HTC-Design C-Sample# 1488 Prior to Ejection from the 300 Ton-Press Die Assembly
(~84 tsi)

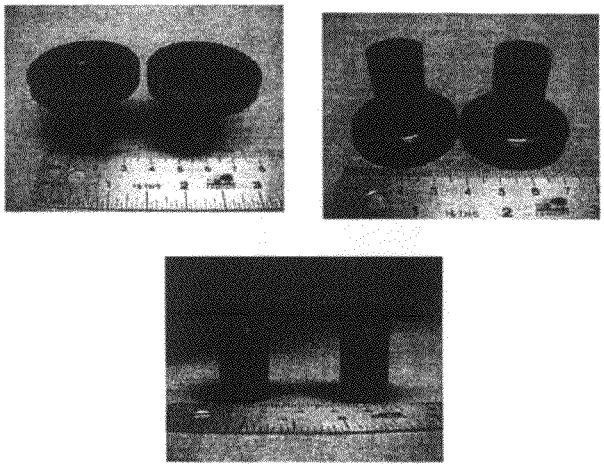
Fig. 17a CDC Compacted 52.5 Mo-47.5 Re
Design C Near Net Shape Part#1487 and 1488 after Extraction from 300 Ton-CDC Press from the Die Assembly (e.g., CDC Compaction Pressure on the Flange~84 tsi)

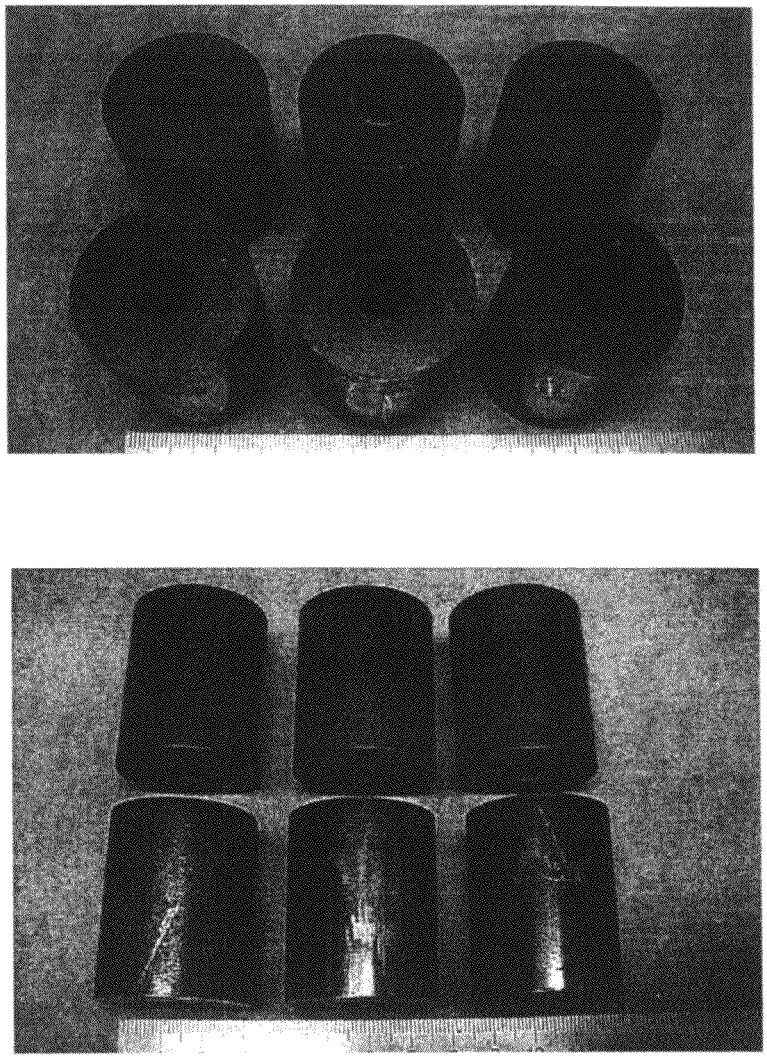
Fig. 17b CDC Compacted Green HTC Design A

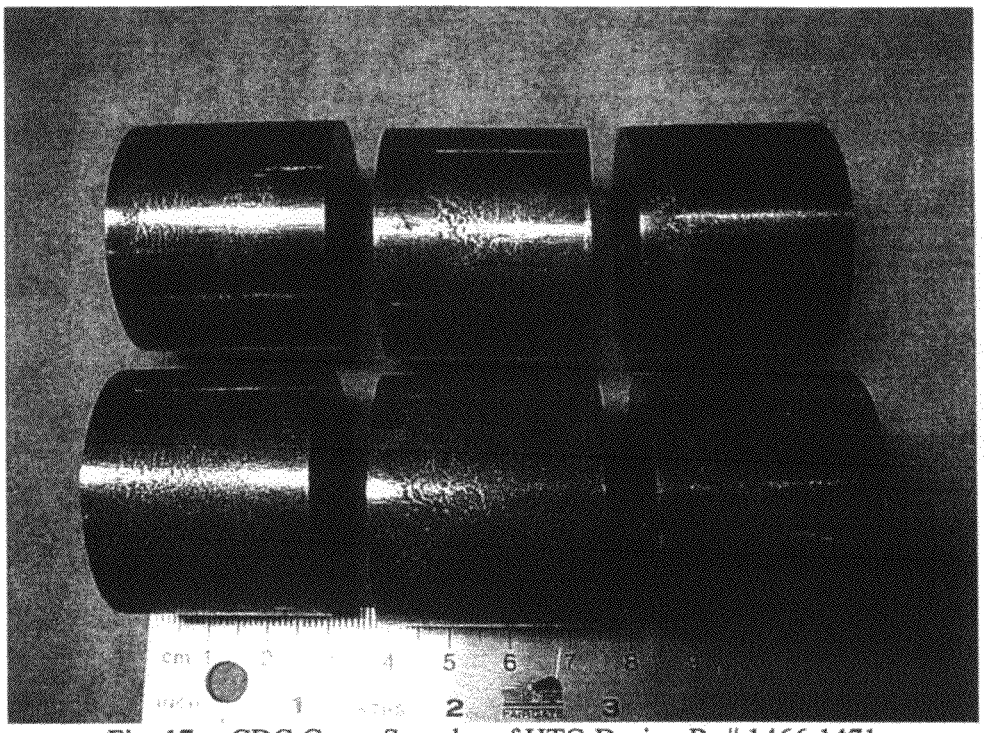
Fig. 17c. CDC Green Samples of HTC-Design B # 1466-1471

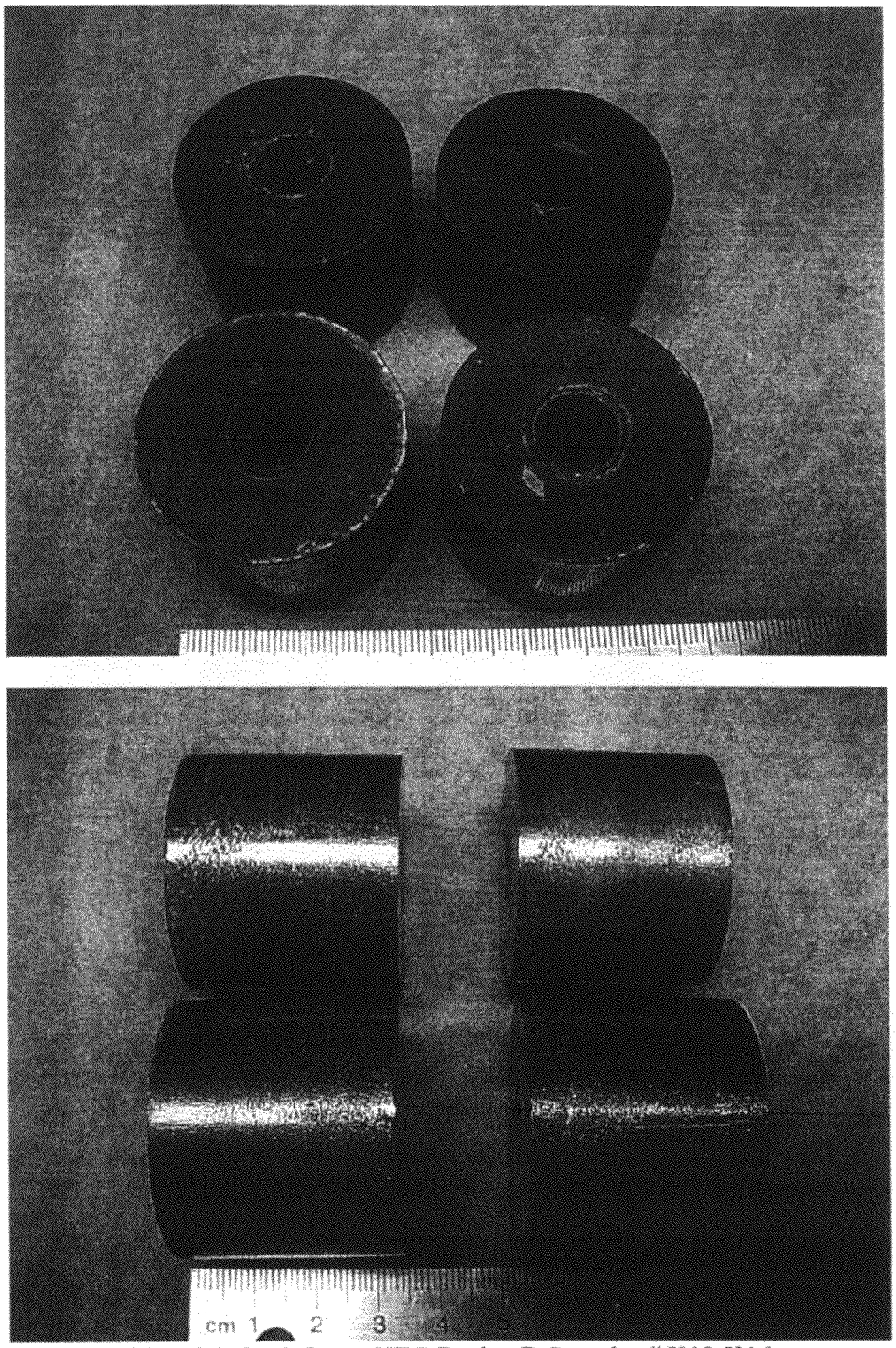
Fig. 17d. CDC Green HTC-Design B Samples # K13-K16

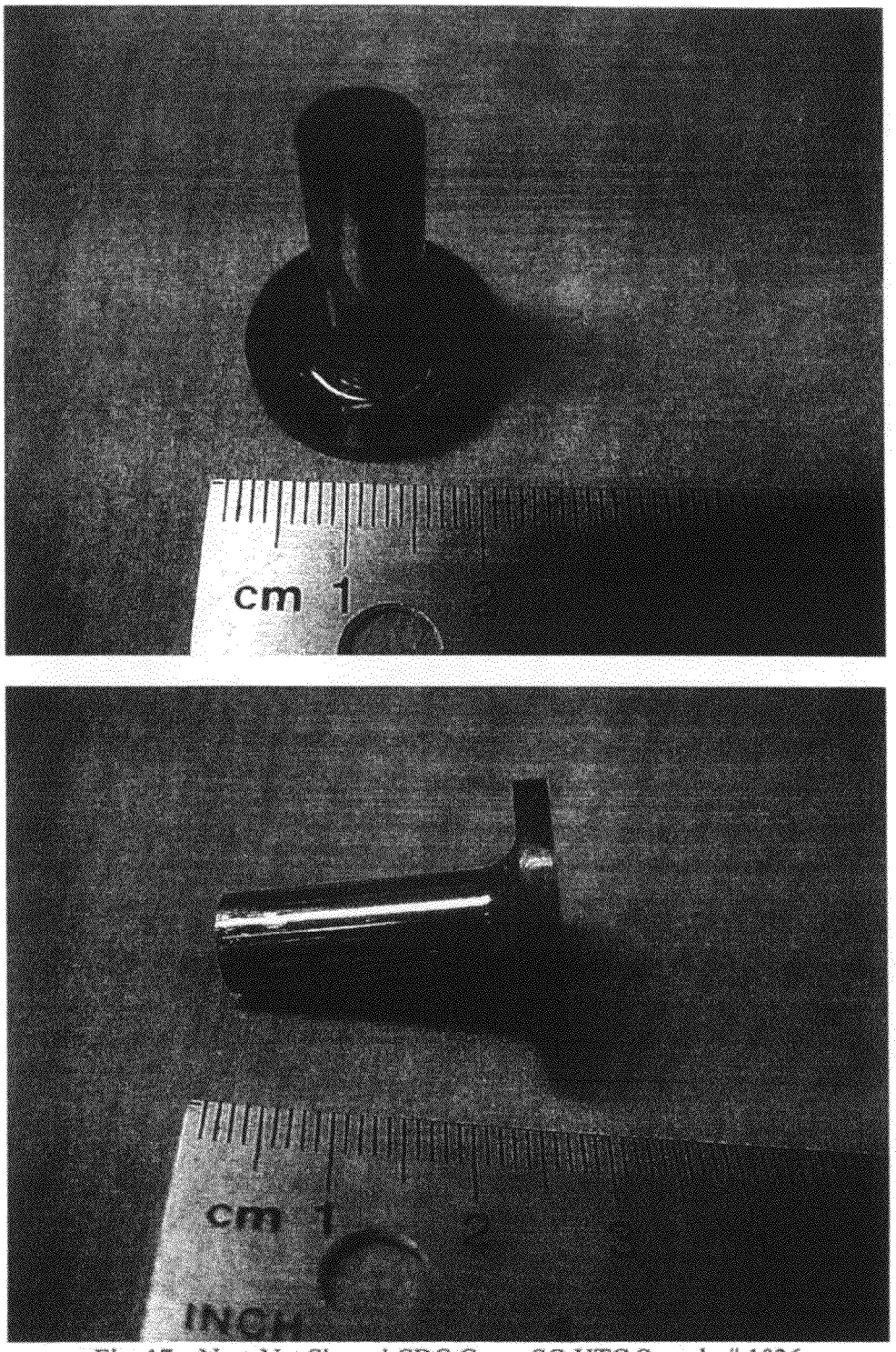
Fig. 17e. Near Net Shaped CDC Green SC-HTC Sample # 1036

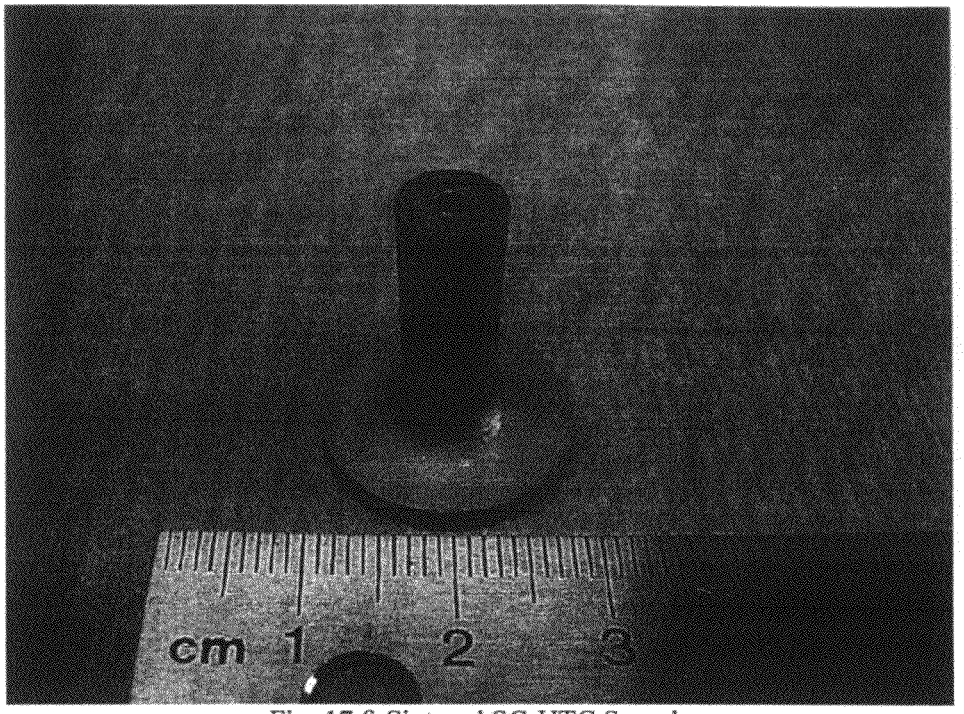
Fig. 17 f Sintered SC-HTC Sample

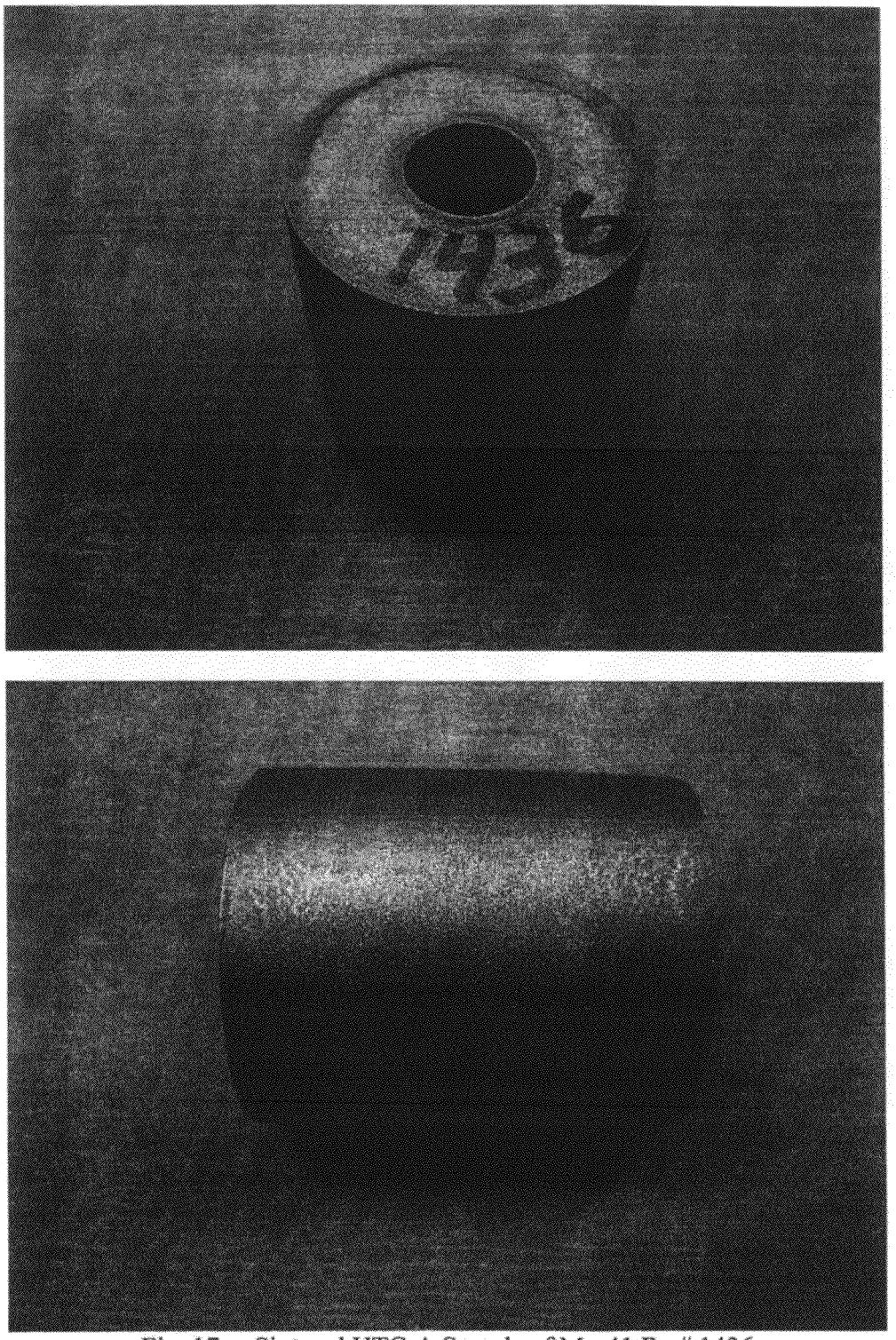
Fig. 17g. Sintered HTC-A Sample of Mo-41 Re # 1436

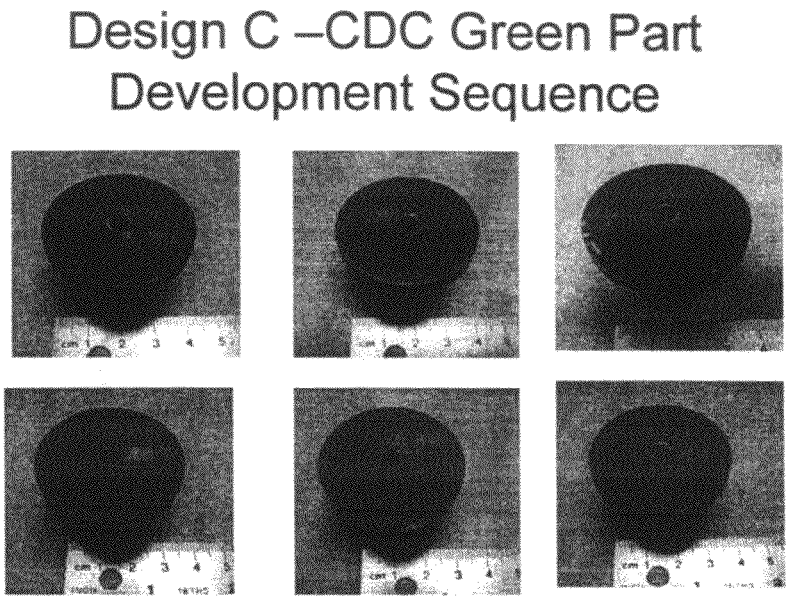
Fig. 17h. CDC Pressed Near Net Shaped Green HTC-Design C Parts

Sintered Near Net Shape CDC Design C Parts
Sintered Densities ~ 98+ % of Theoretical Density-TD
#1487: 98.50%TD; #1488: 98.47% TD
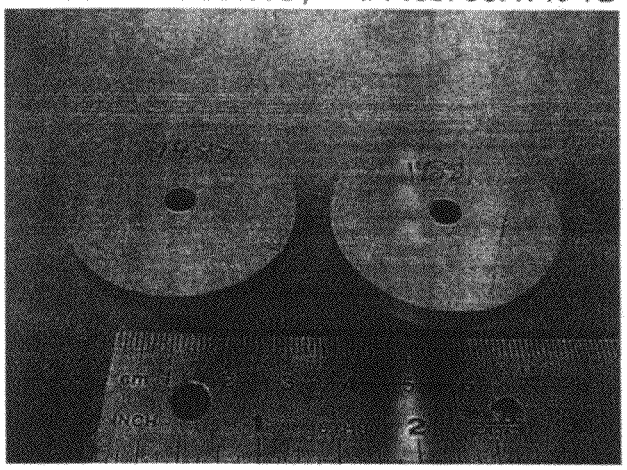
Fig. 17i. Sintered Near Net Shape High Temperature Component Design C Parts Design C-Sintered Trial Parts
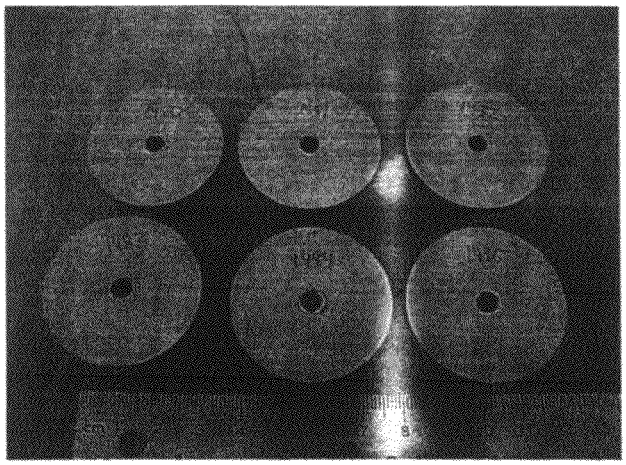
Fig. 17j. Sintered CDC Near Net Shape Parts Design C –Sintered Trial Parts
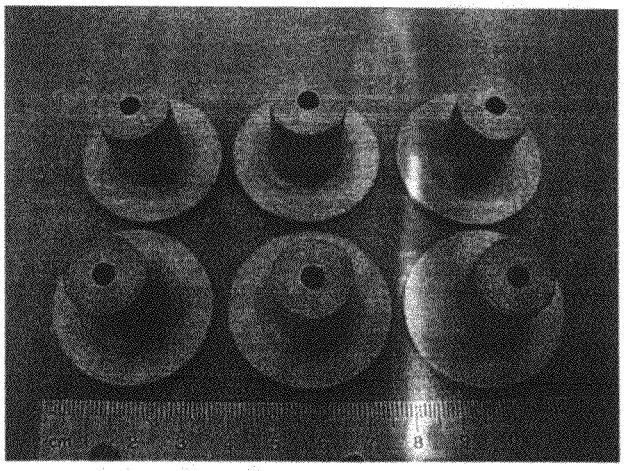
Fig. 17k. Sintered Design C Parts
(#1480, 1481, 1482 Top Row)
(#1483, 1484, 1485 Bottom Row)

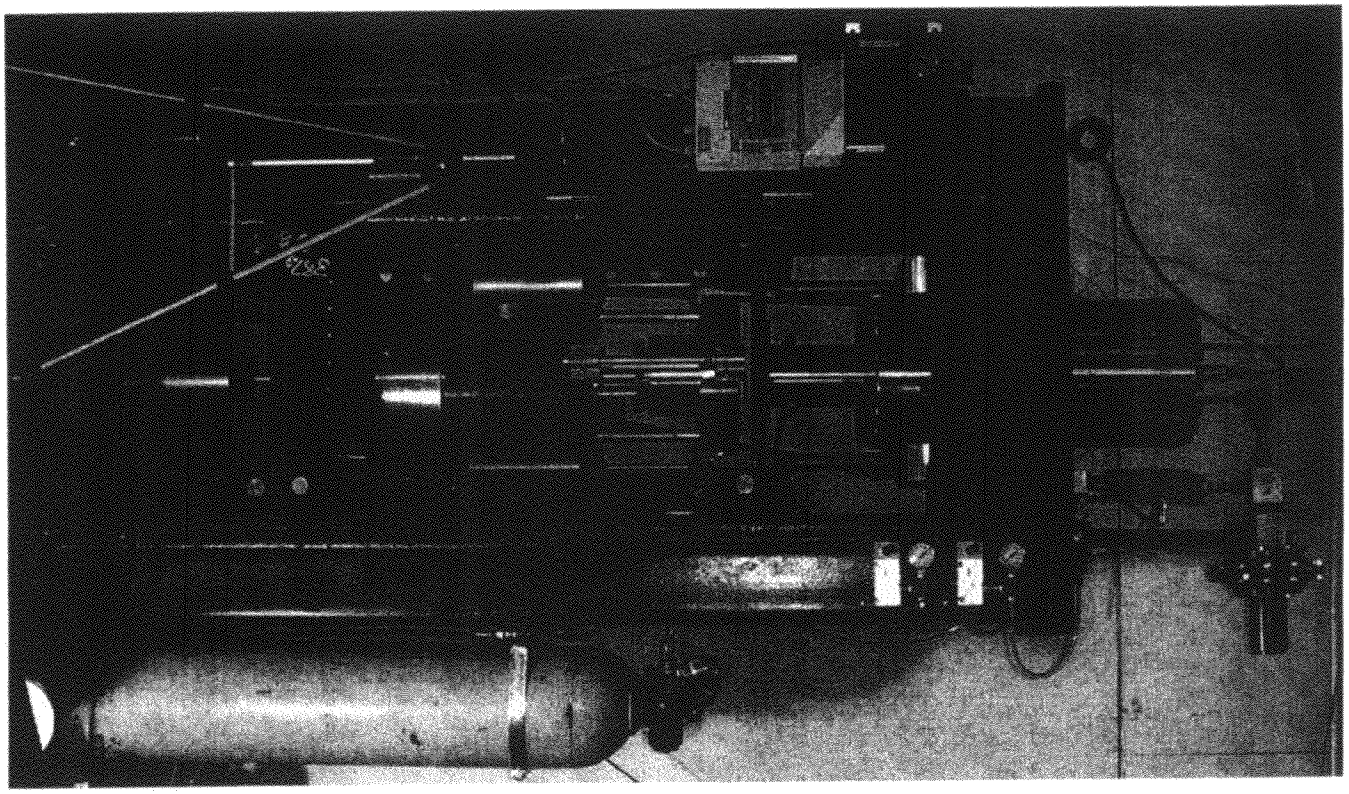
Fig. 18 400 Ton CDC-Press with High Temperature Component-HTC-D tooling

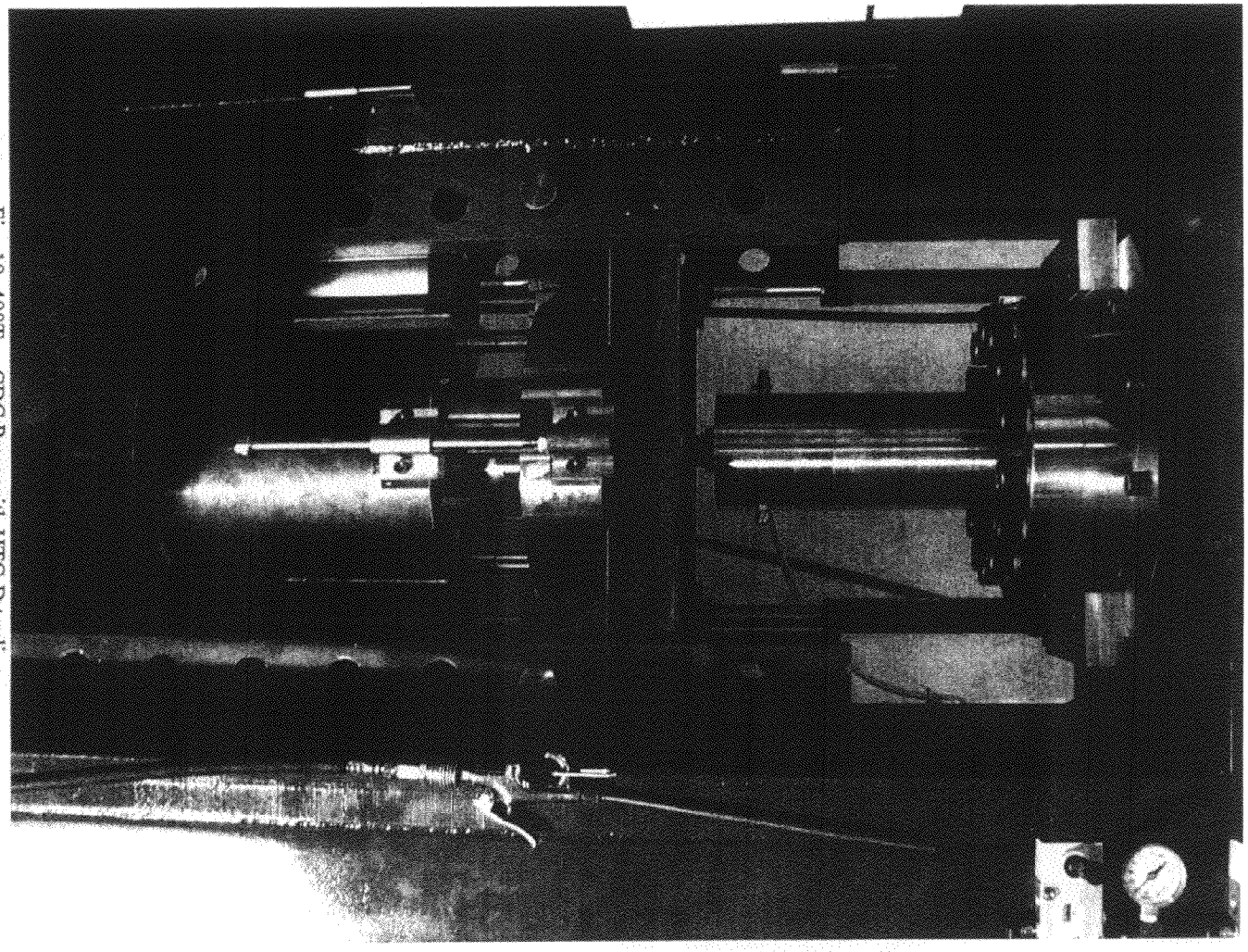
Fig. 19 400Ton CDC Press with HTC-D tooling

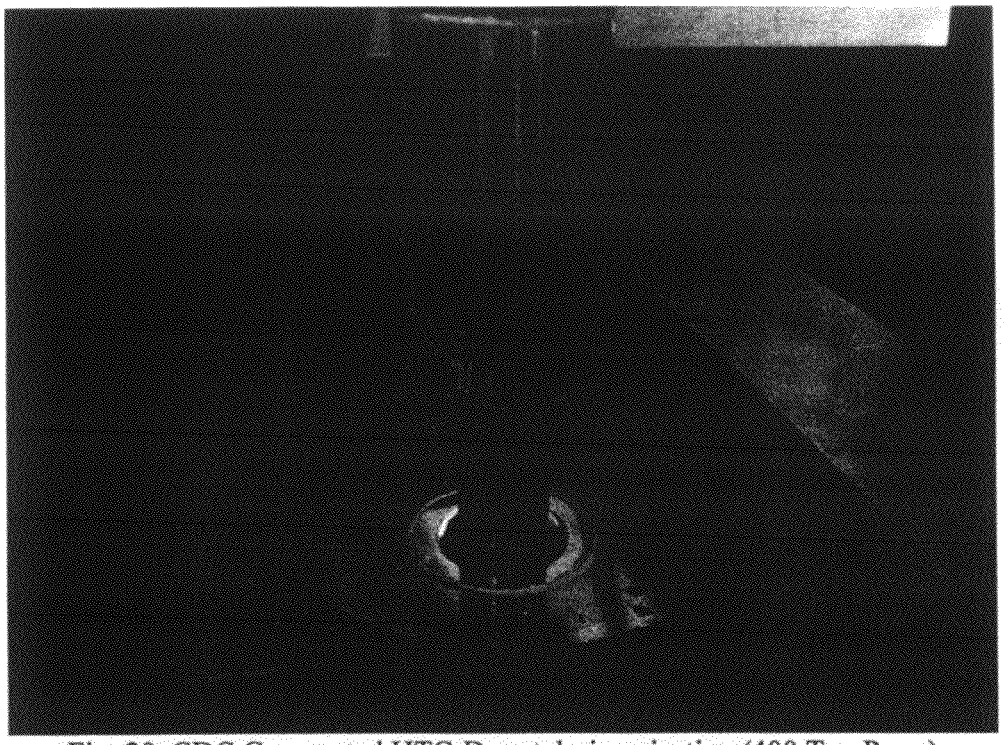
Fig. 20 CDC Compacted HTC-D part during ejection (400 Ton Press)
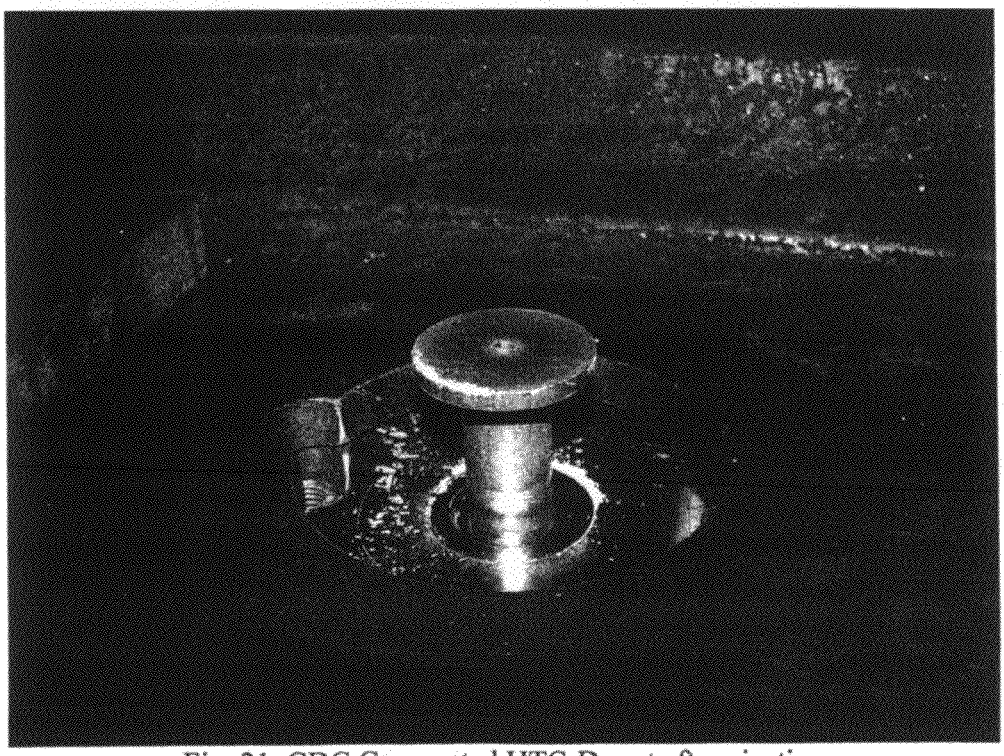
Fig. 21. CDC Compacted HTC-D part after ejection

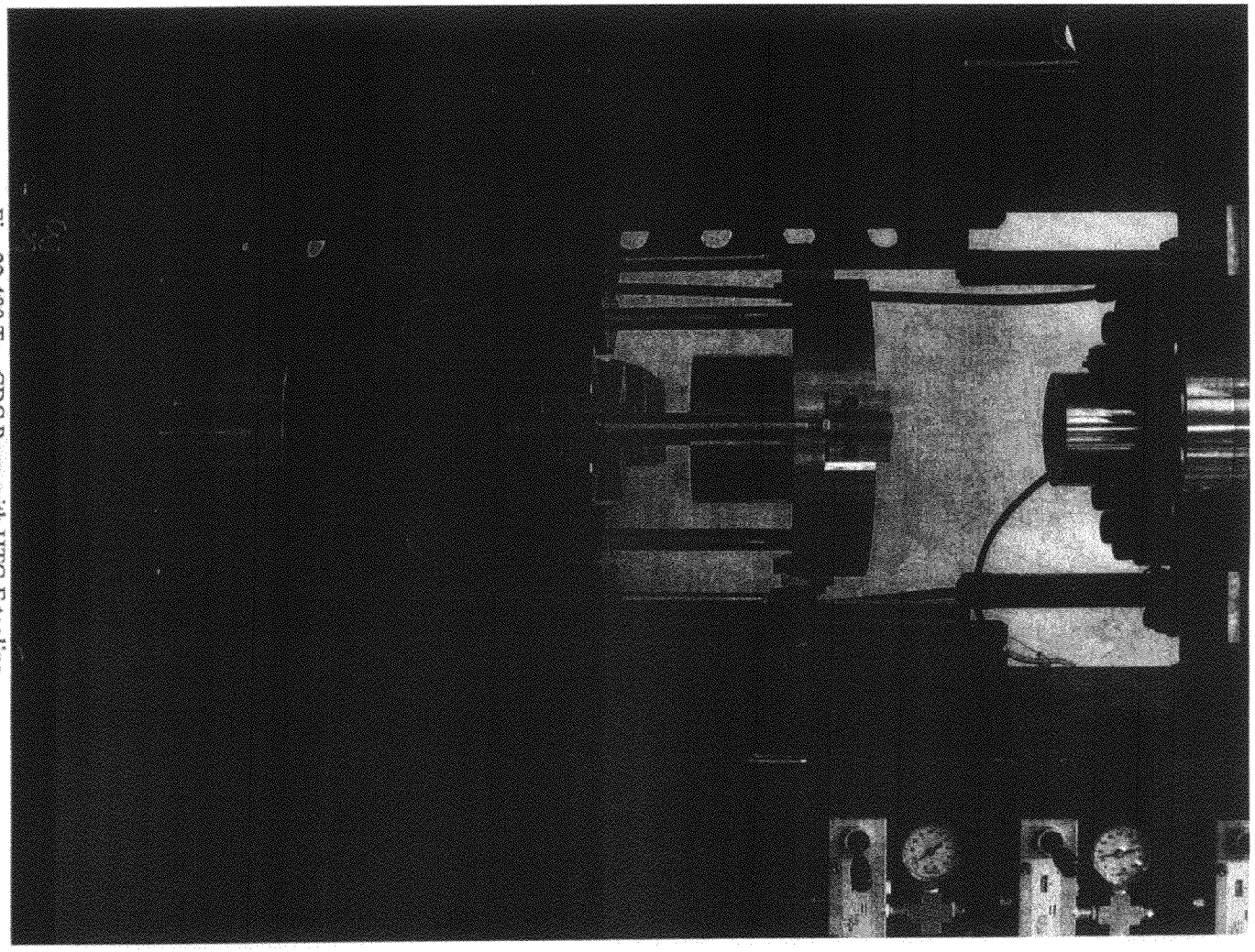
Fig. 22 400 Ton CDC Press with HTC-E tooling

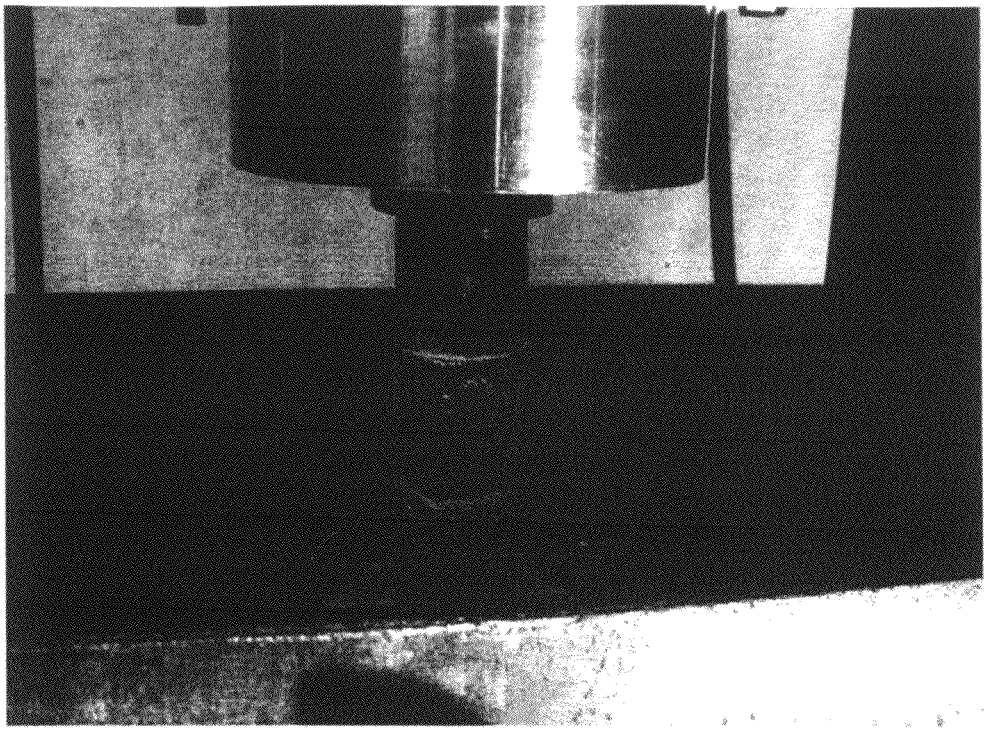
Fig. 23 CDC Compacted HTC-E part during ejection (400 Ton Press)
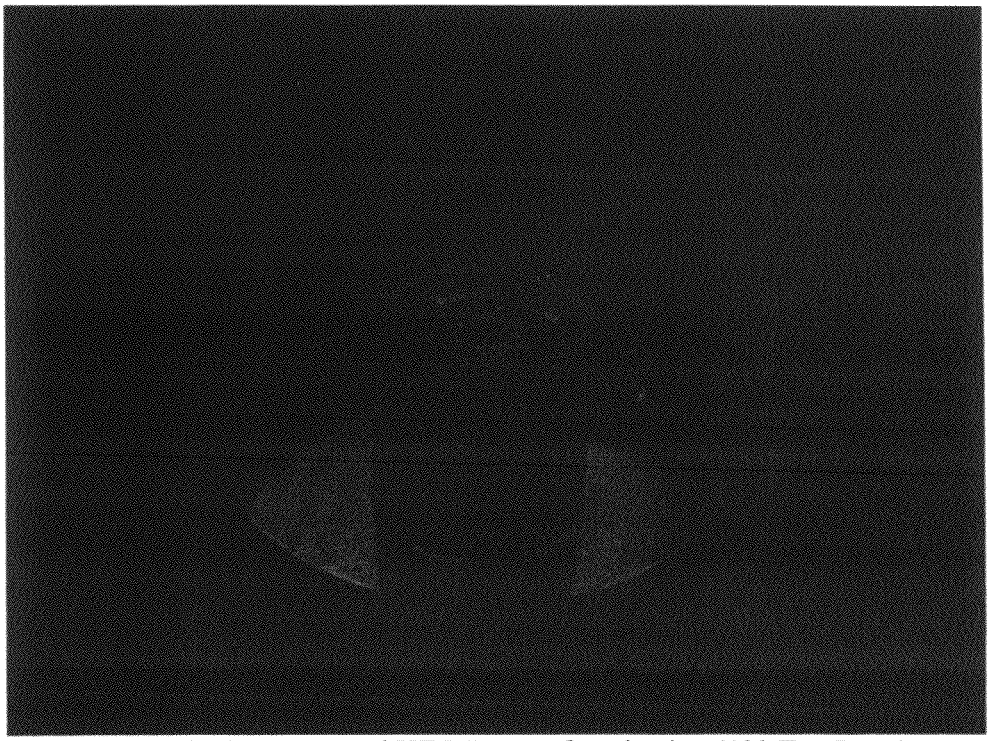
Fig. 24 CDC Compacted HTC-E part after ejection (400 Ton Press)

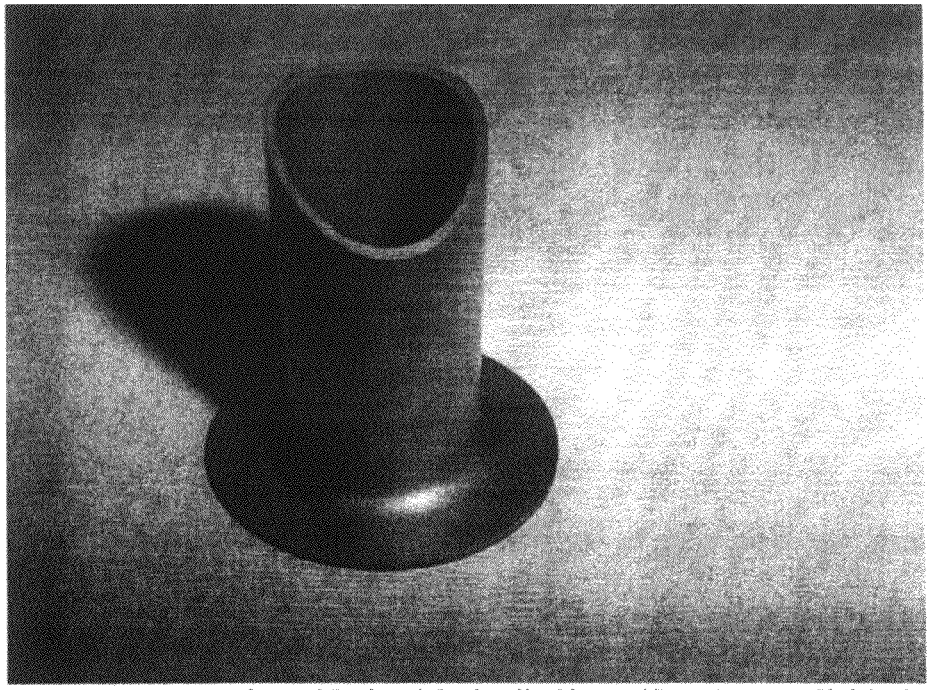
Fig. 25 CDC Compacted at ~ 85 tsi and Optimally Sintered/Post-Process Finished High Temperature Component-HTC-D final part
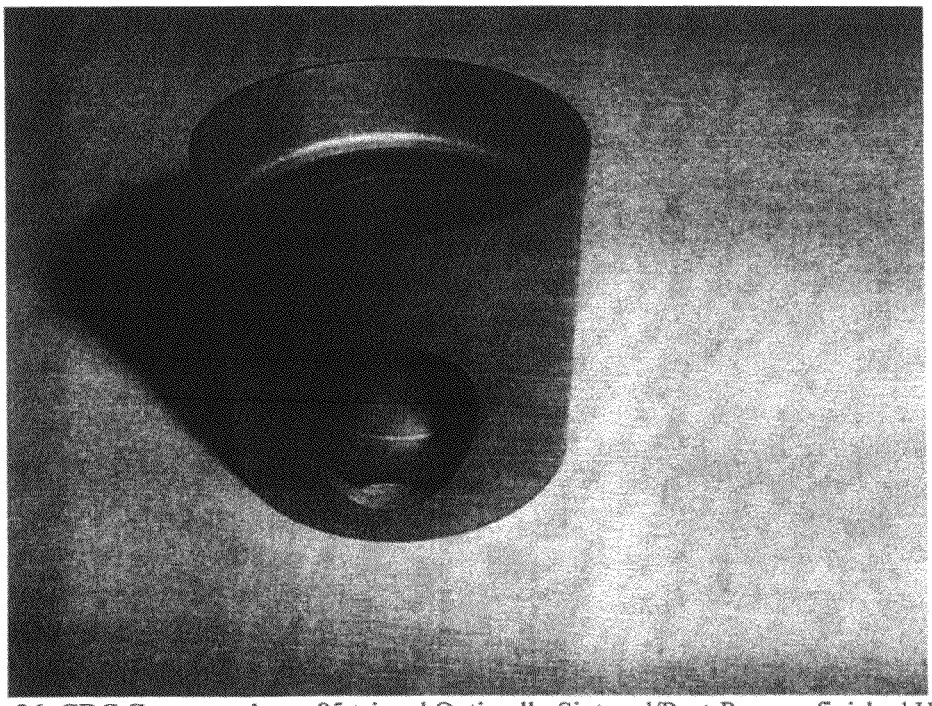
Fig. 26 CDC Compacted at ~ 85 tsi and Optimally Sintered/Post-Process finished High Temperature Component-HTC-E final part

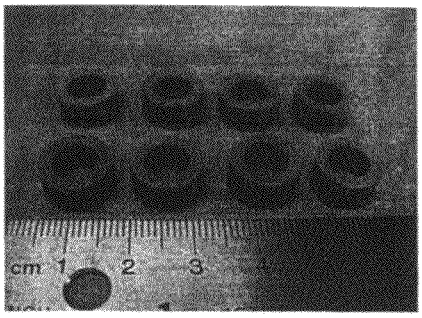
Fig. 27 Sample # 1023, 1024, 1025, 1026, 1027, 1028, 1029, 1030
Sintered Ring samples-The CDC properties are listed in Table 13 [44]

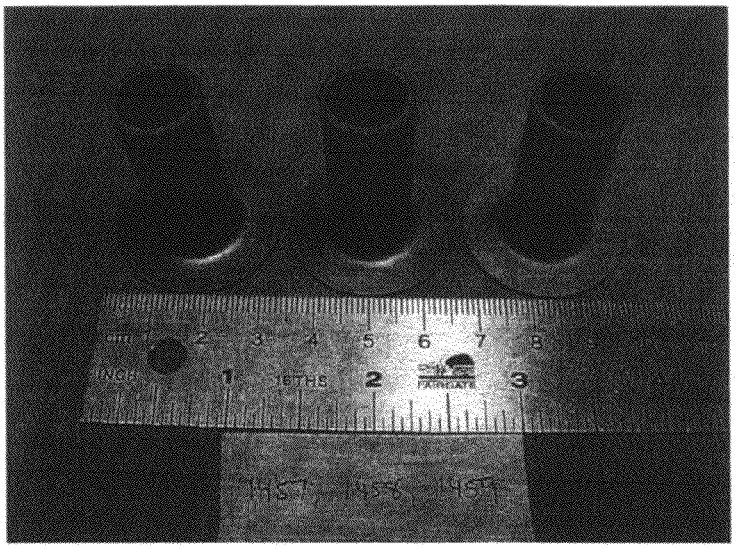
Fig. 28 CDC Compacted and Processed HTC-Design A (Samples # 1457, 1458 and 1459)

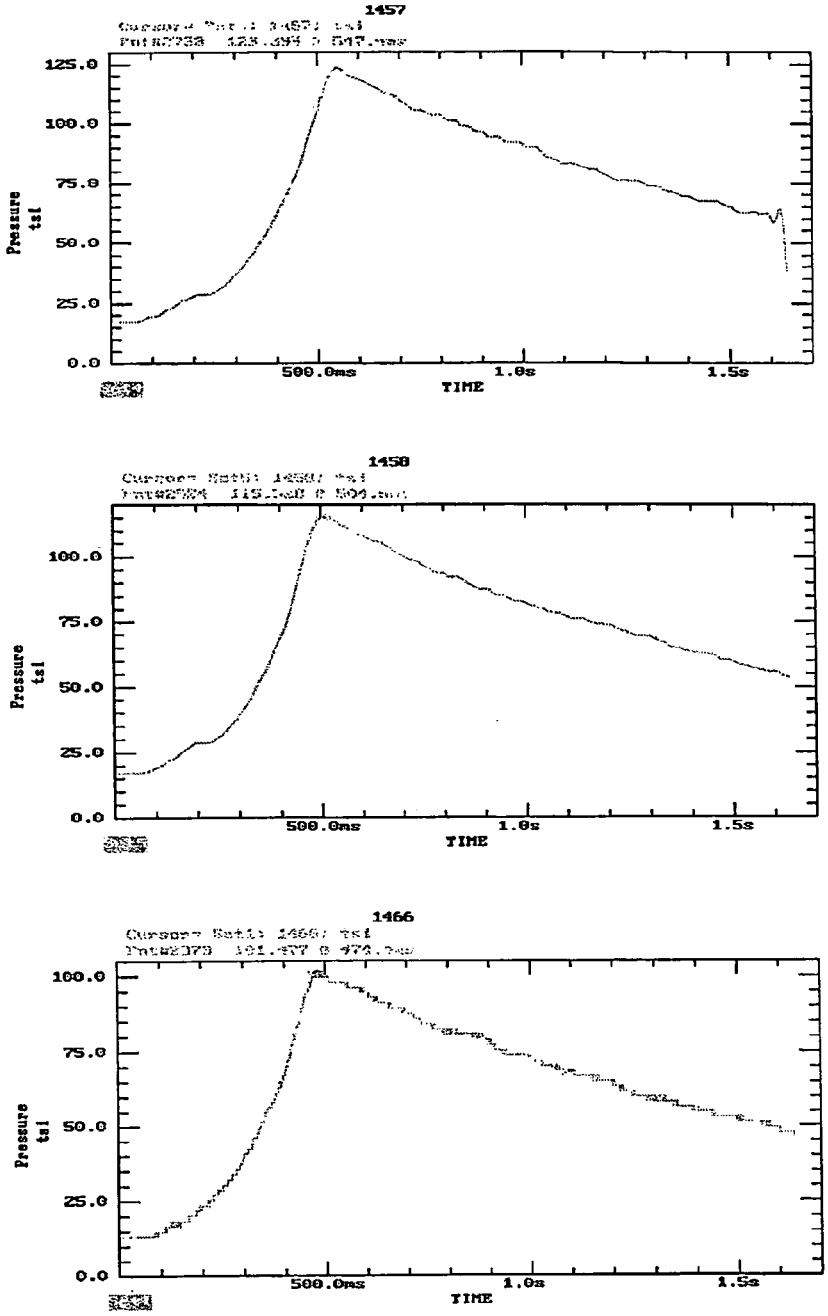
Fig. 29a. CDC Compaction Loading Profiles-300 Ton Press (Samples # 1457, 1458 and 1466)

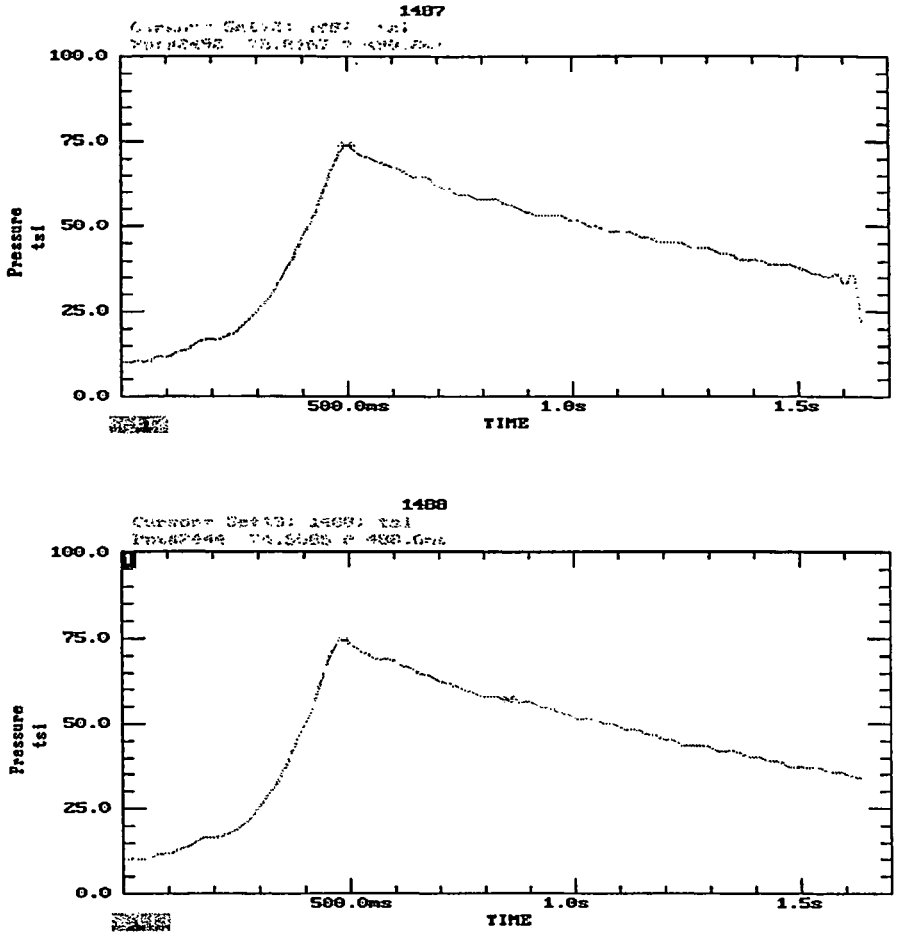
Fig. 29b. CDC Compaction Loading Profiles-300 Ton Press (Samples 1487 and 1488)

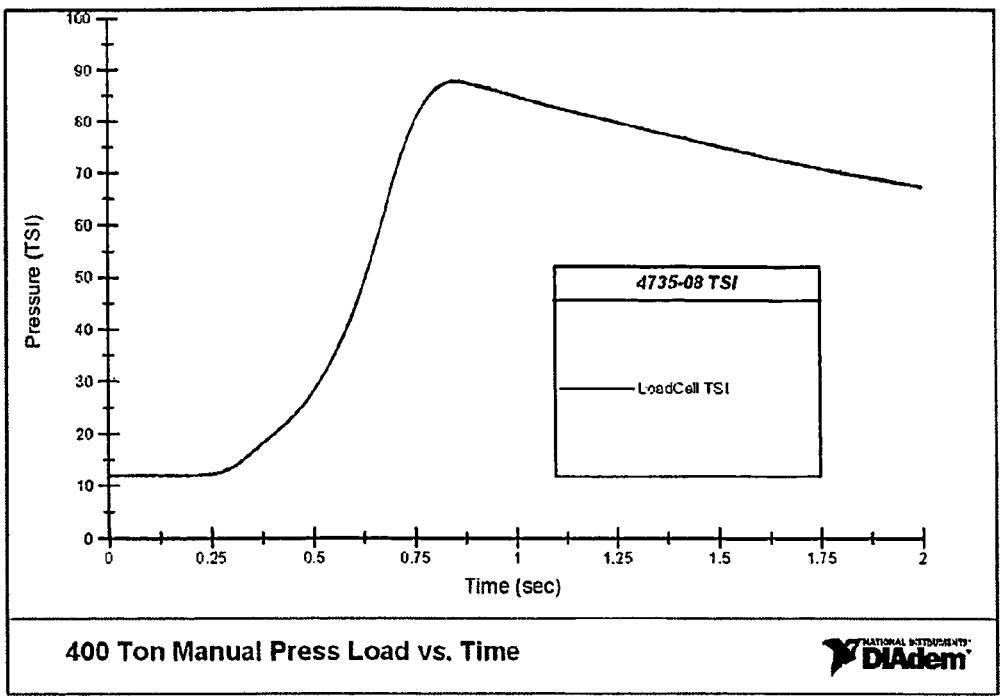
Fig. 30. Controlled Unique Combustion Driven Compaction-CDC-Loading Cycles for Various Compacted Geometries Indicating milliseconds of Pressing Time (400 Ton Press: Sample 4735-08)

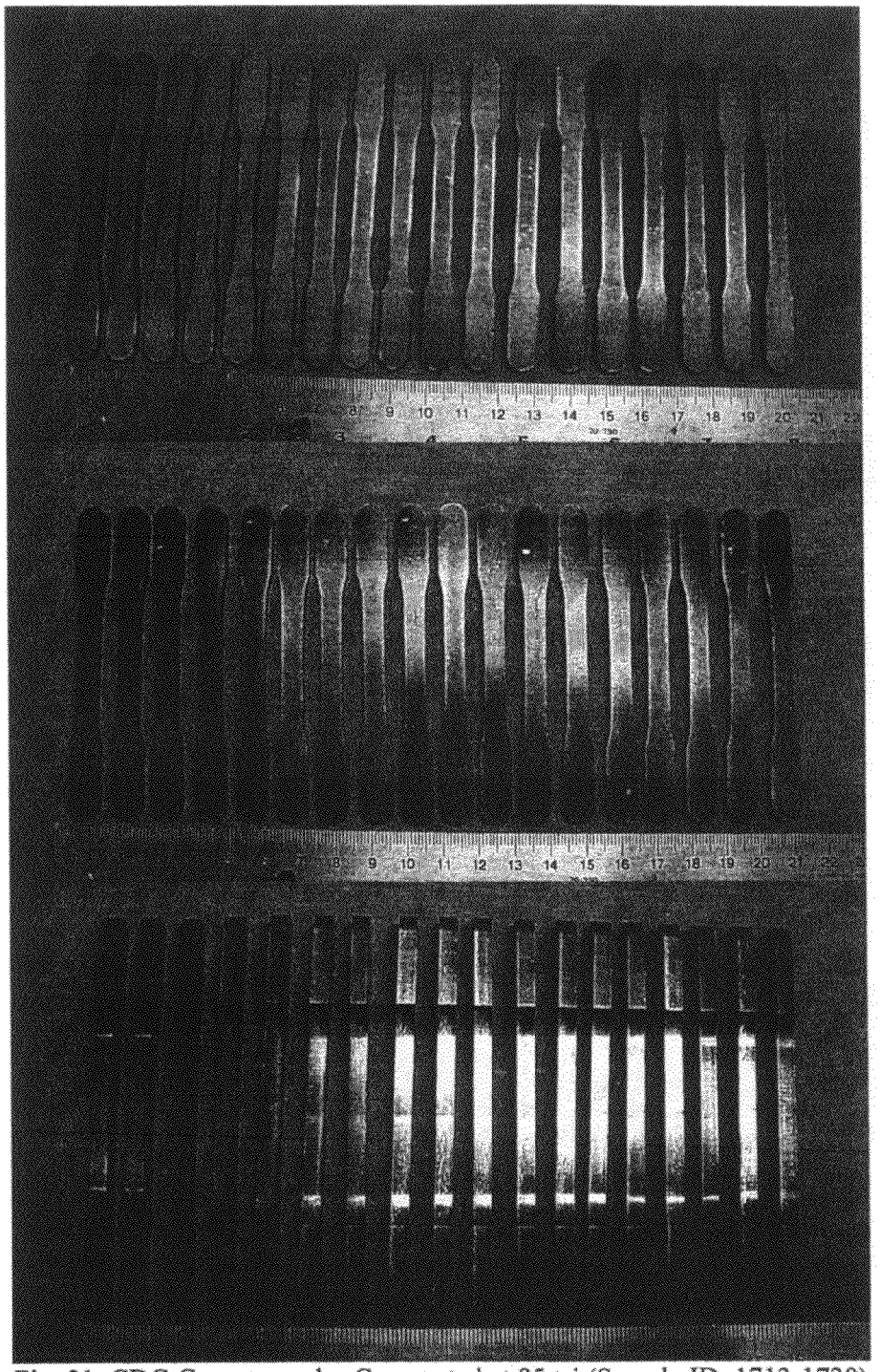
Fig. 31 CDC Green samples Compacted at 85 tsi (Sample ID: 1713-1730)

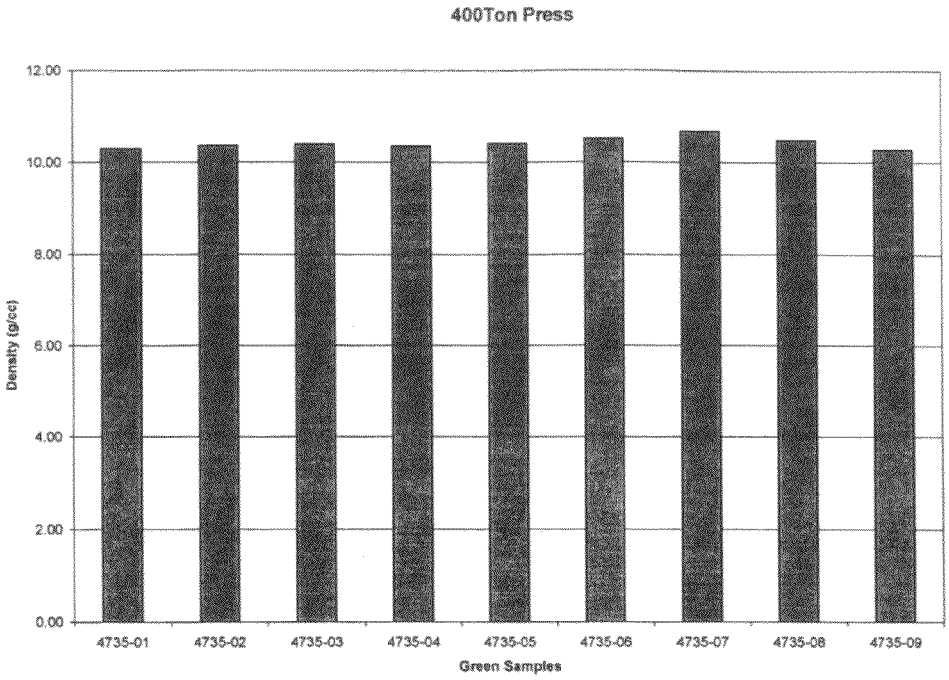
Fig. 32 CDC Compacted Green Sample Densities Using 400 Ton-CDC Press (HTC-Design D)

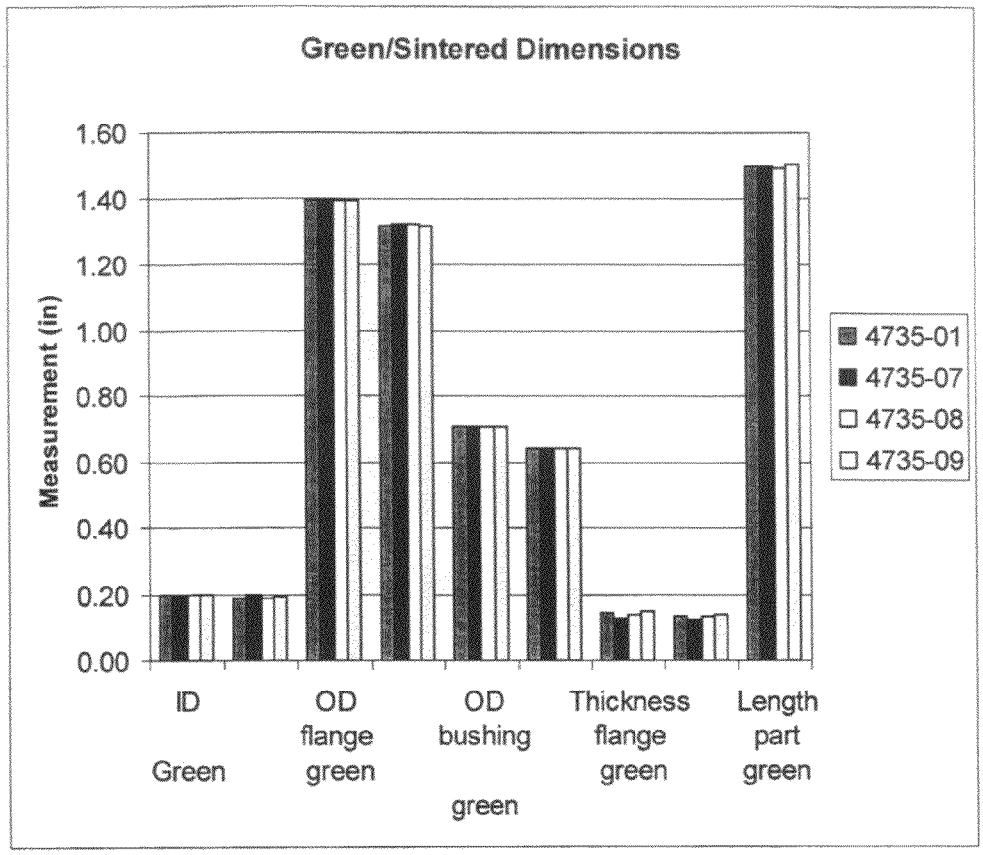
Fig. 33 CDC Compacted Green Part Dimensions
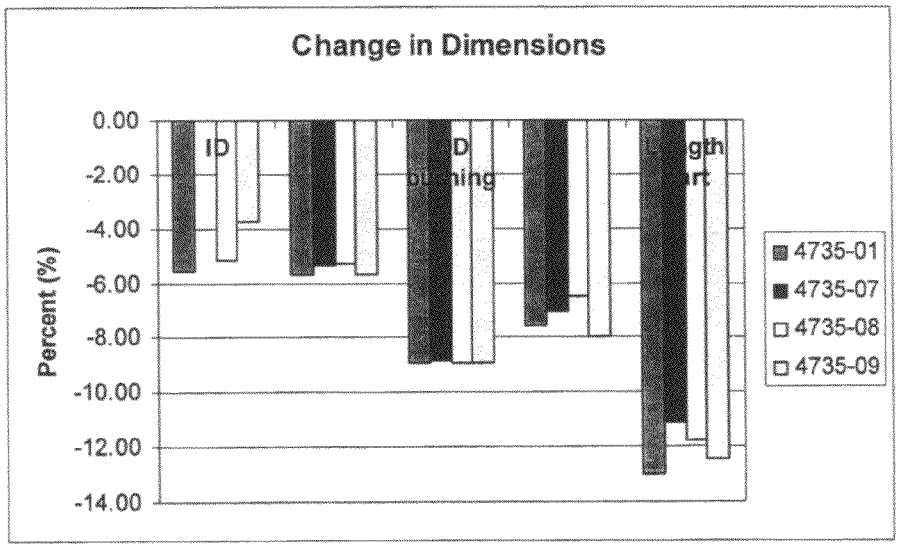
Fig. 34 Minimal Shrinkage (negative % Change) Attributes of CDC Compacted HTC-Design D Parts at 85 tsi and Optimal Sintering

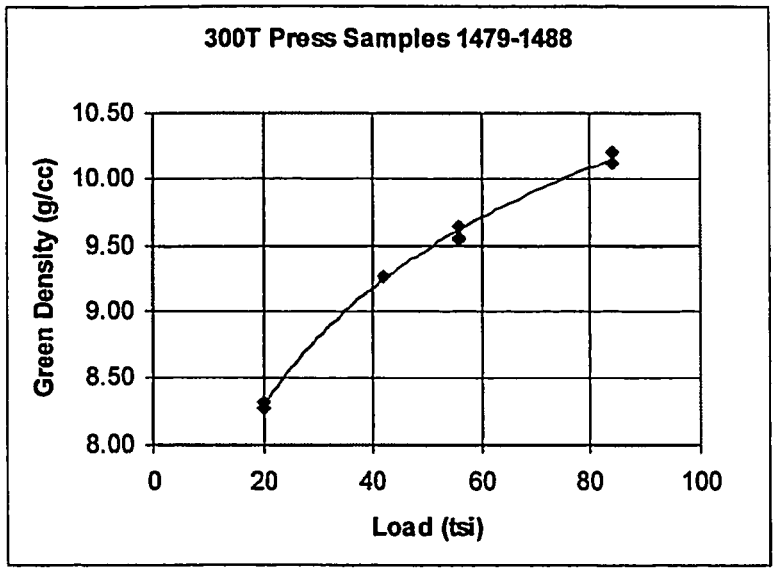
Fig. 35 Potential Benefits of Higher CDC Compaction Pressures on Increased Green Part Densities of HTC-Design C Near Net Shaped Mo-47.5 % Re Parts.
Note that the Conventional Presses are limited to 50-55 tsi.

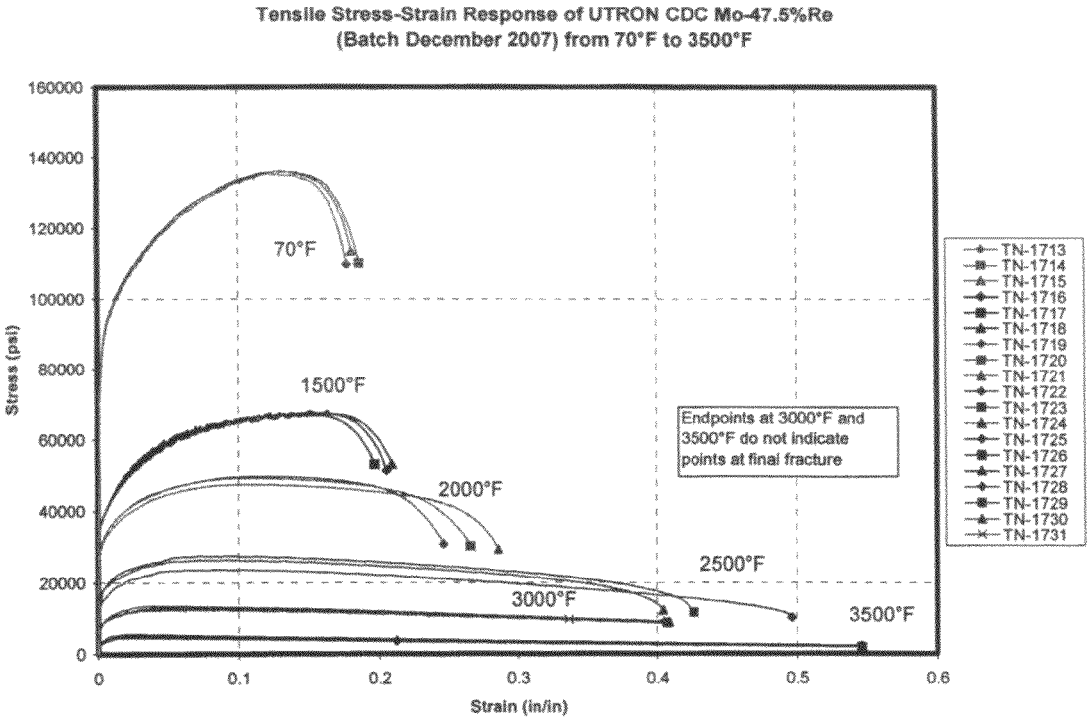
Fig. 36 Room (e.g., 70 deg F) and High Temperature (1500, 2000, 2500, 3000 and 3500 deg F) Mechanical Properties of CDC Compacted at 85 tsi and Optimally Sintered 52.5 Mo-47.5 Re Mechanical Test Samples

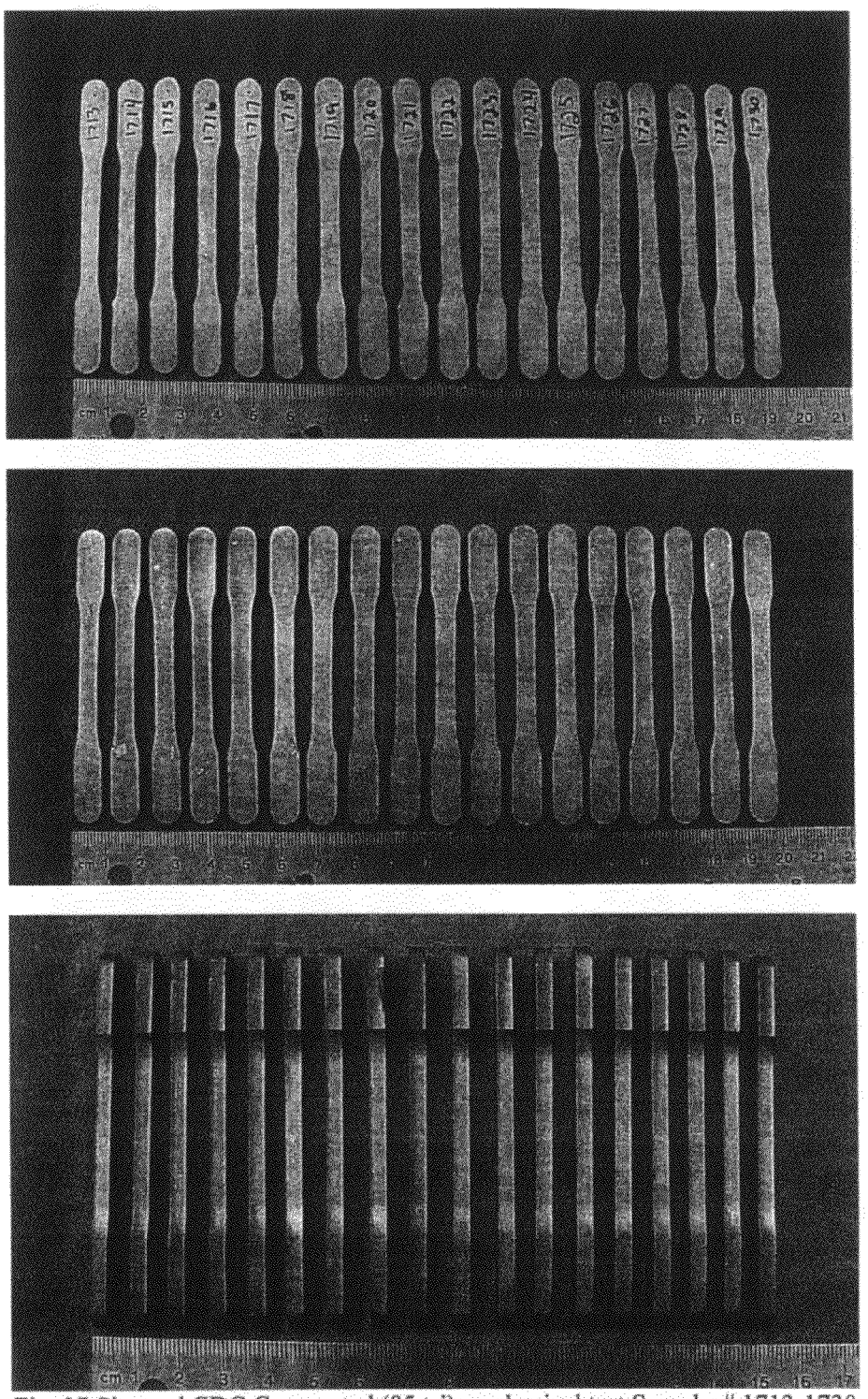
Fig. 37 Sintered CDC Compacted (85 tsi) mechanical test Samples# 1713-1730

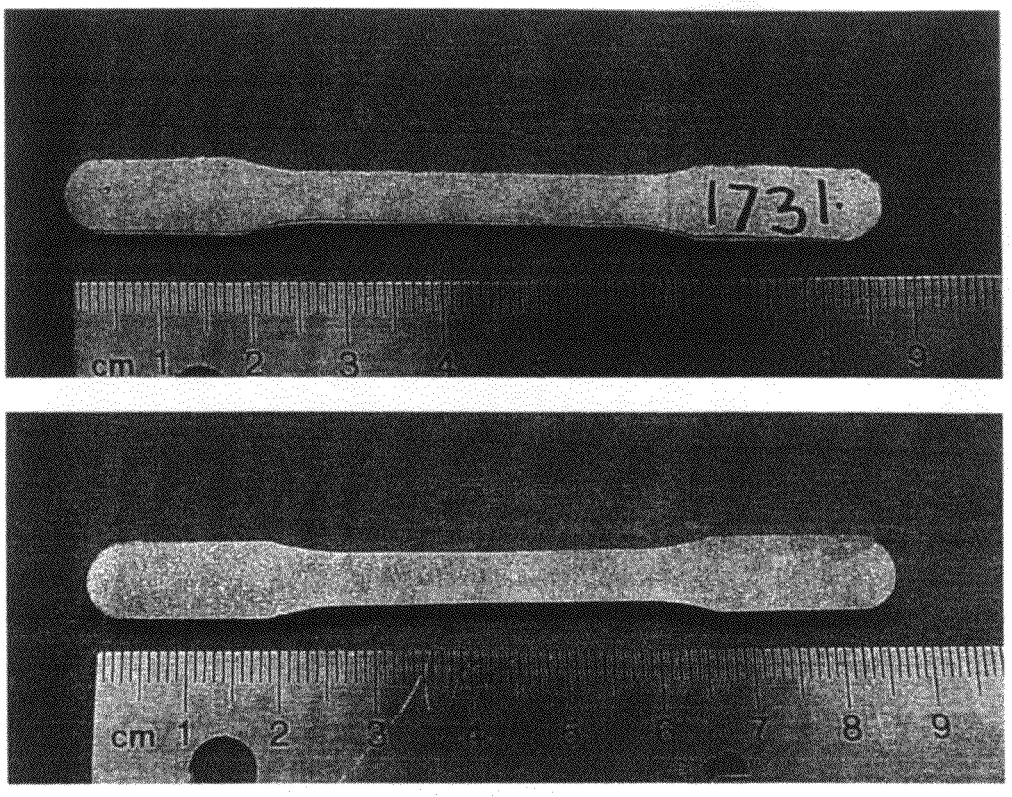
Fig. 38 Sintered CDC Compacted (150 tsi) Sample# 1731

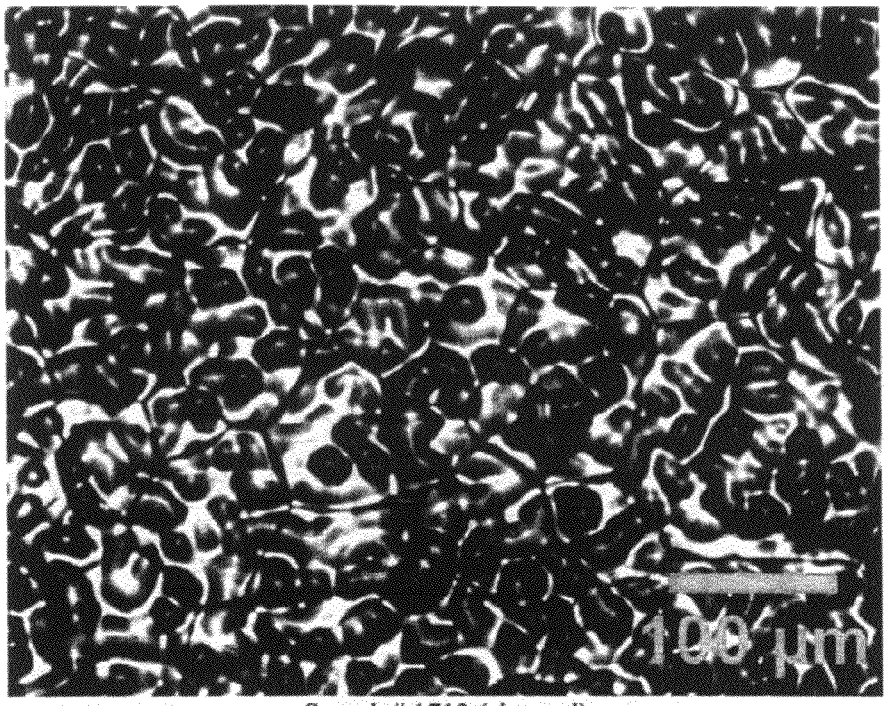
Sample# 1713 (sintered)
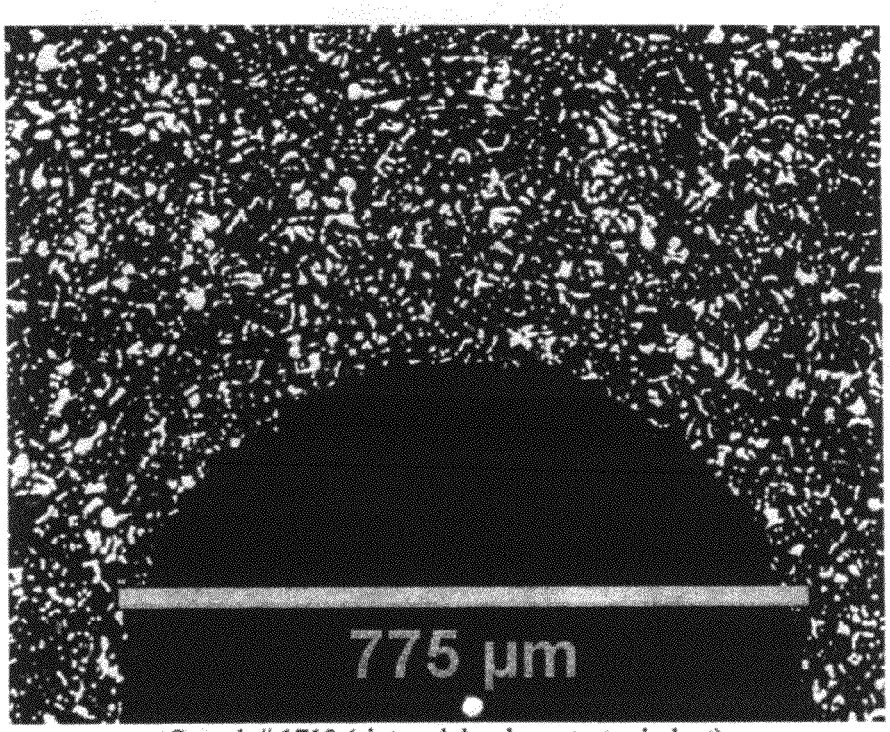
Sample# 1713 (sintered, hardness tester indent)
Fig. 39 Microstructures of As-Sintered Mechanical Tensile Sample 1713 (CDC Load: 85 tsi)

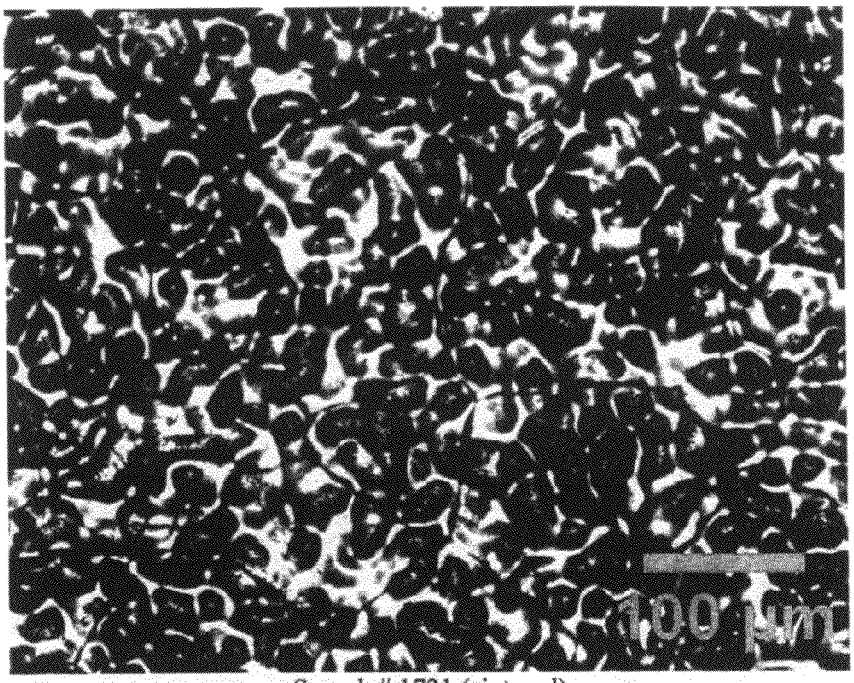
Sample# 1721 (sintered)
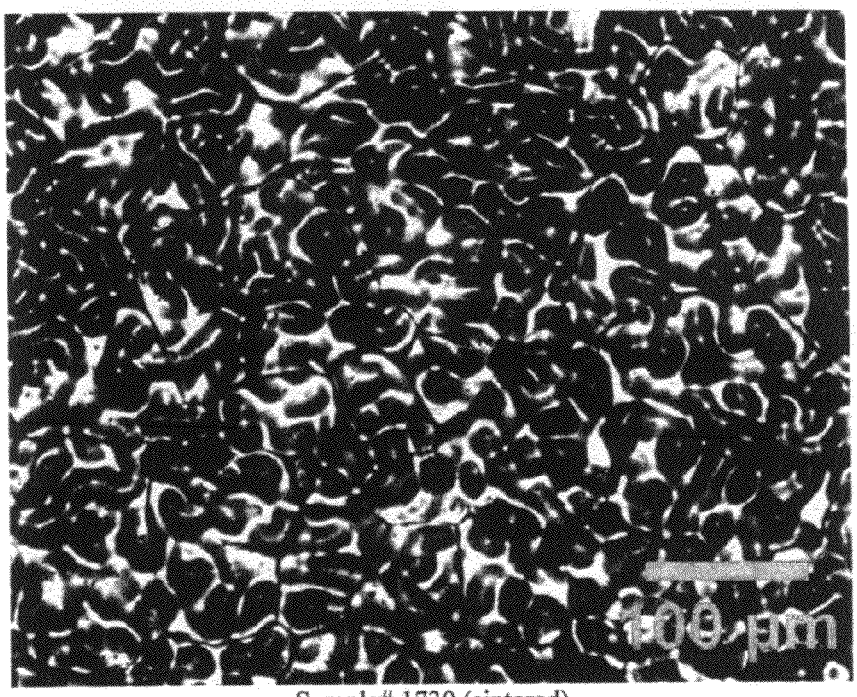
Sample# 1730 (sintered)
Fig. 40 Microstructures of As-Sintered Mechanical Tensile Sample (CDC Load: 85 tsi)

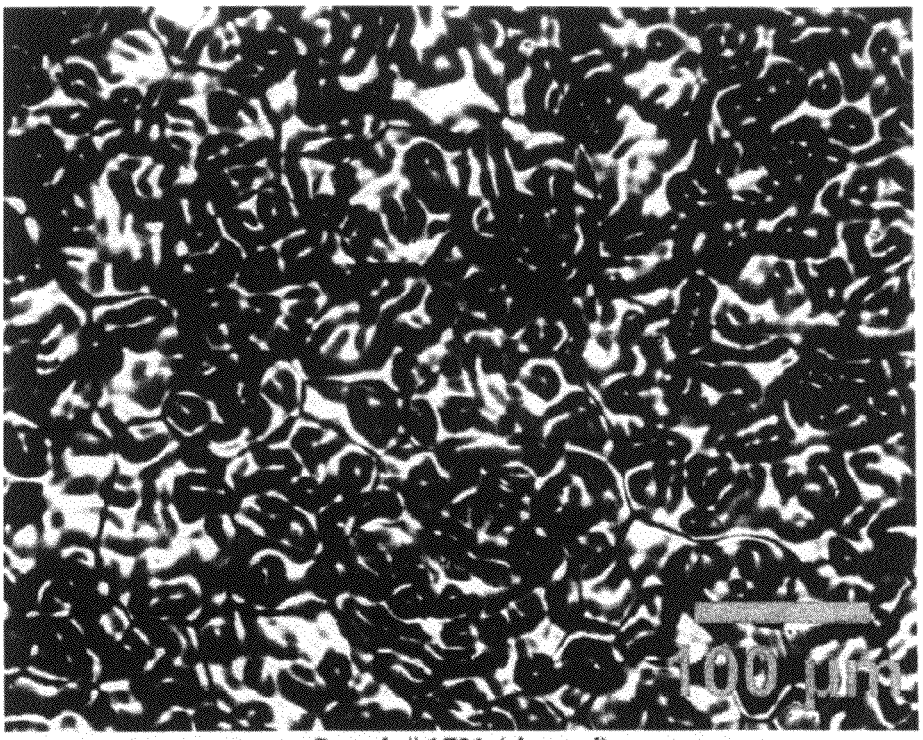
Sample# 1731 (sintered)
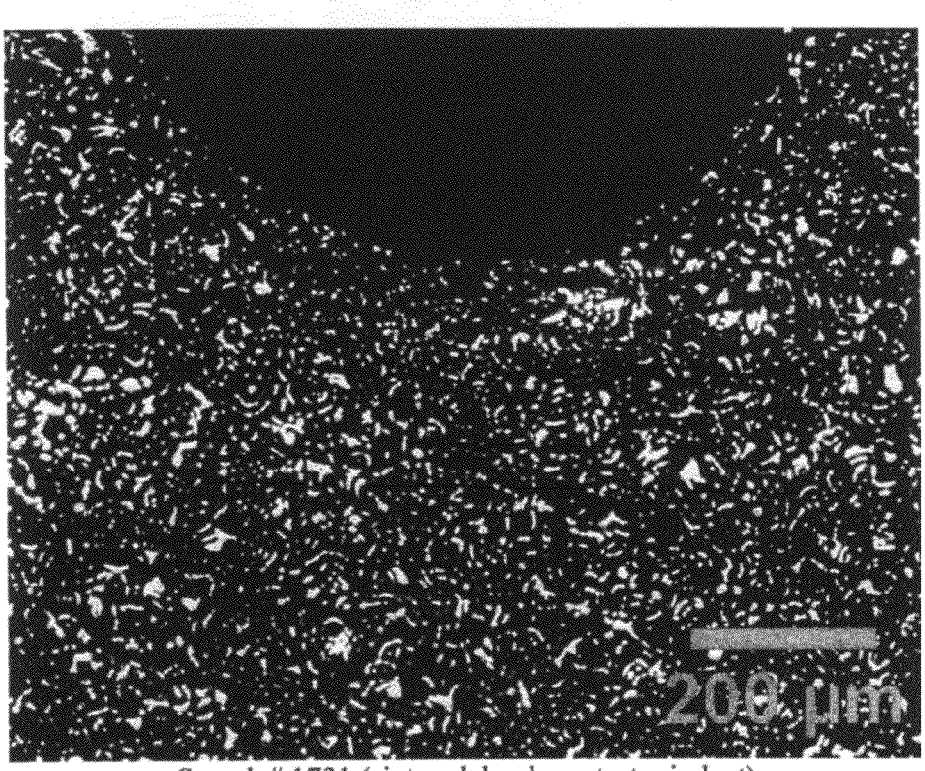
Sample# 1731 (sintered, hardness tester indent)
Fig. 41 Microstructures of CDC Mechanical Tensile Sample #1731 (CDC Load: 150 tsi)

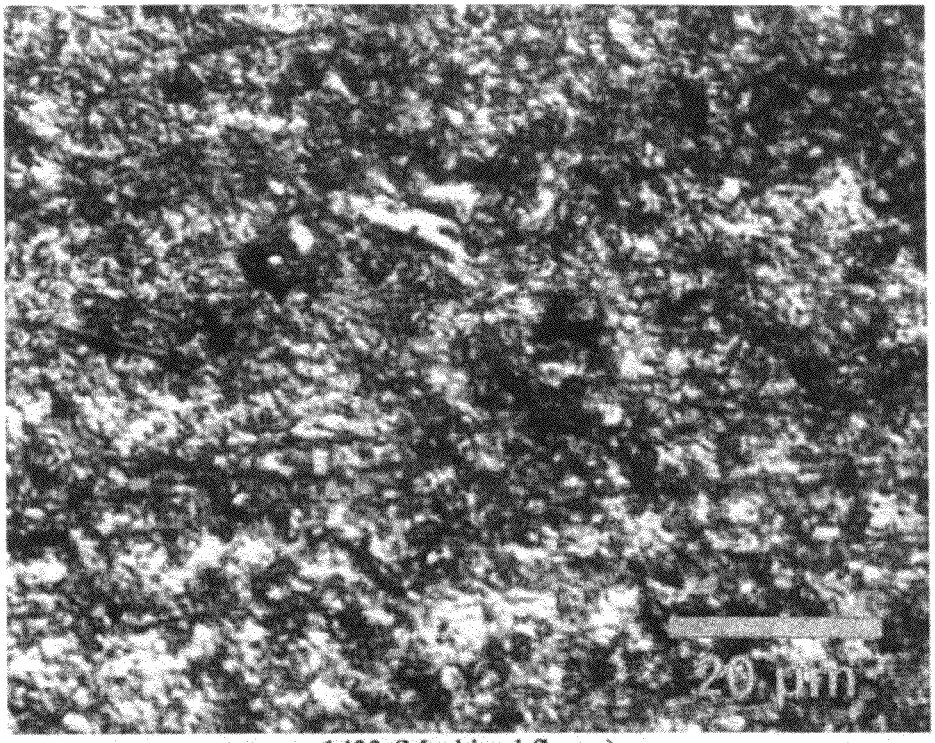
1433 (Machined flange)
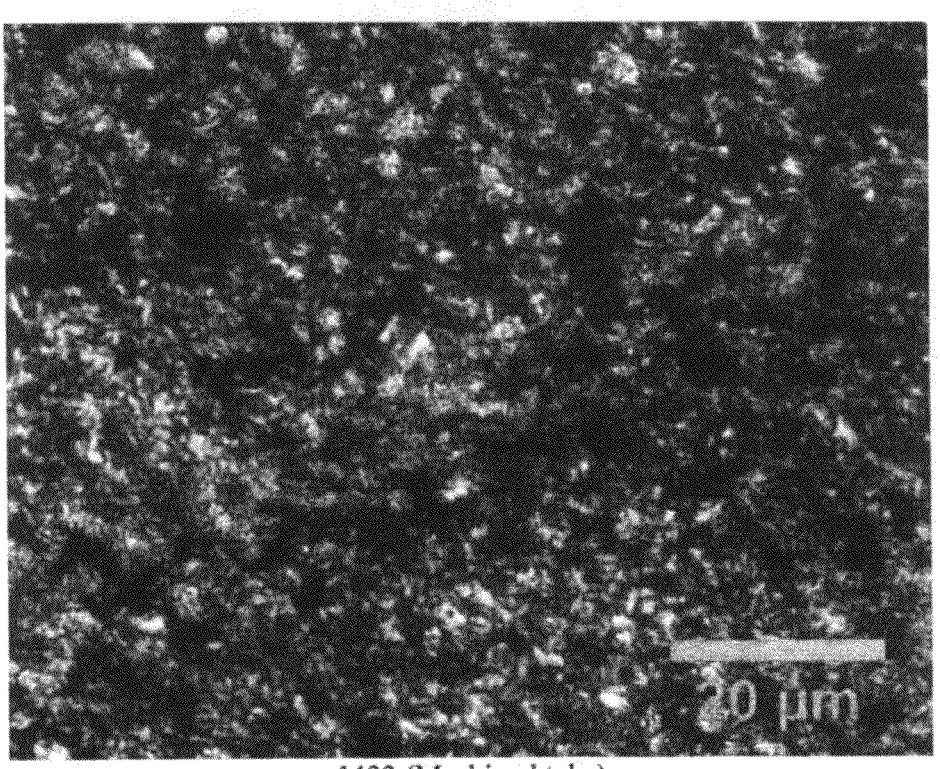
1433 (Machined tube)
Fig. 42. Post-Process Finished Microstructures (Sample 1433)

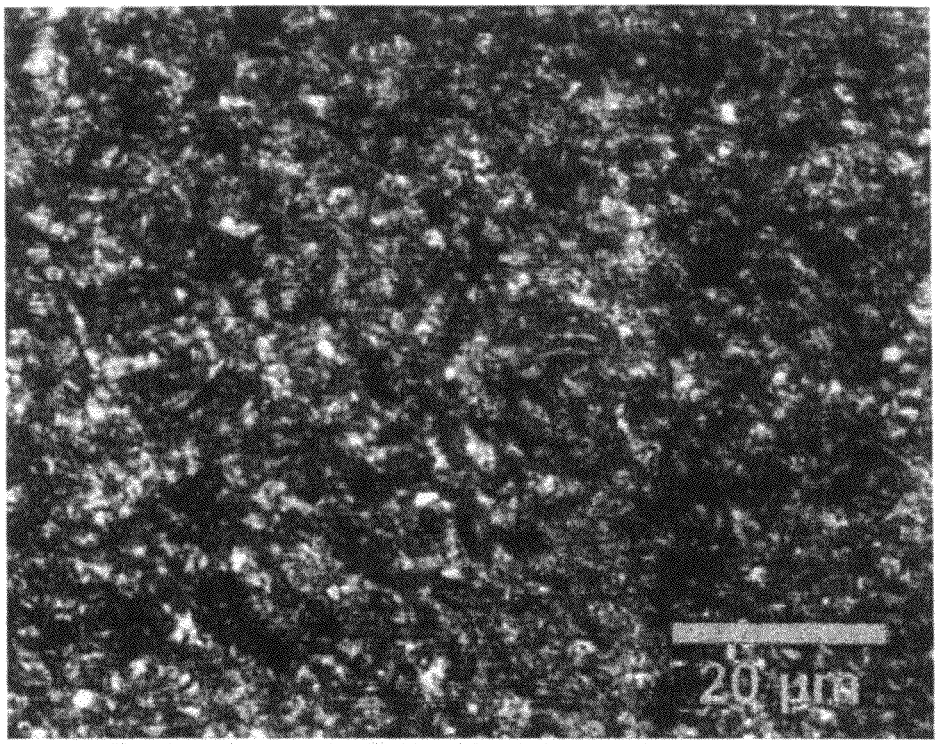
1435 (Machined flange)
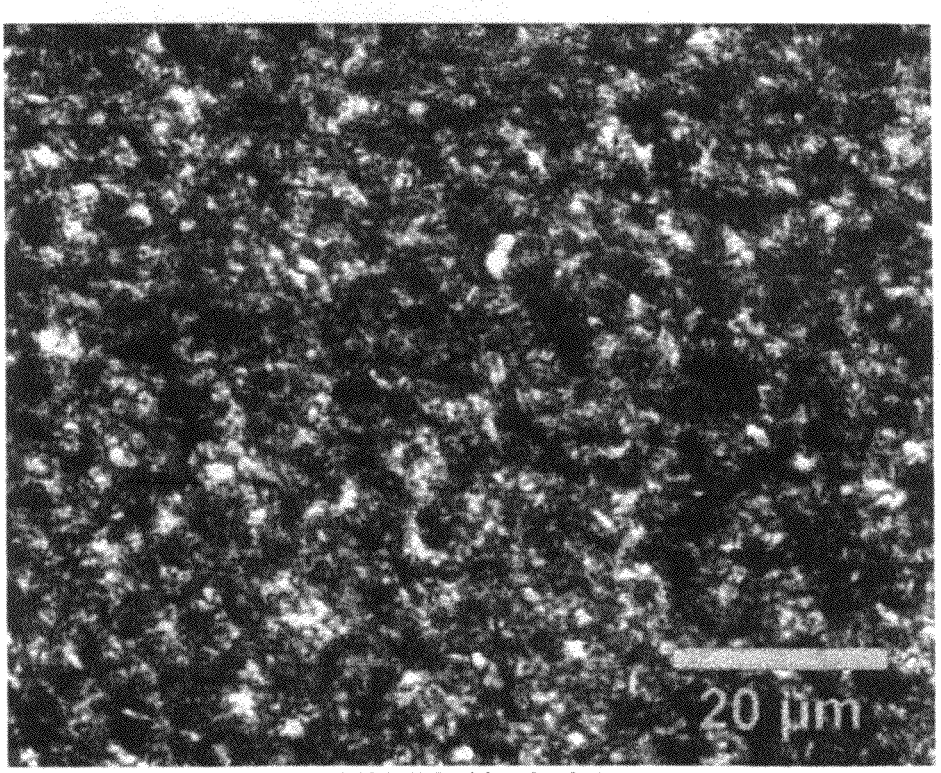
1435 (Machined tube)
Fig. 43 Post-Processed Finished Microstructures (Sample 1435)

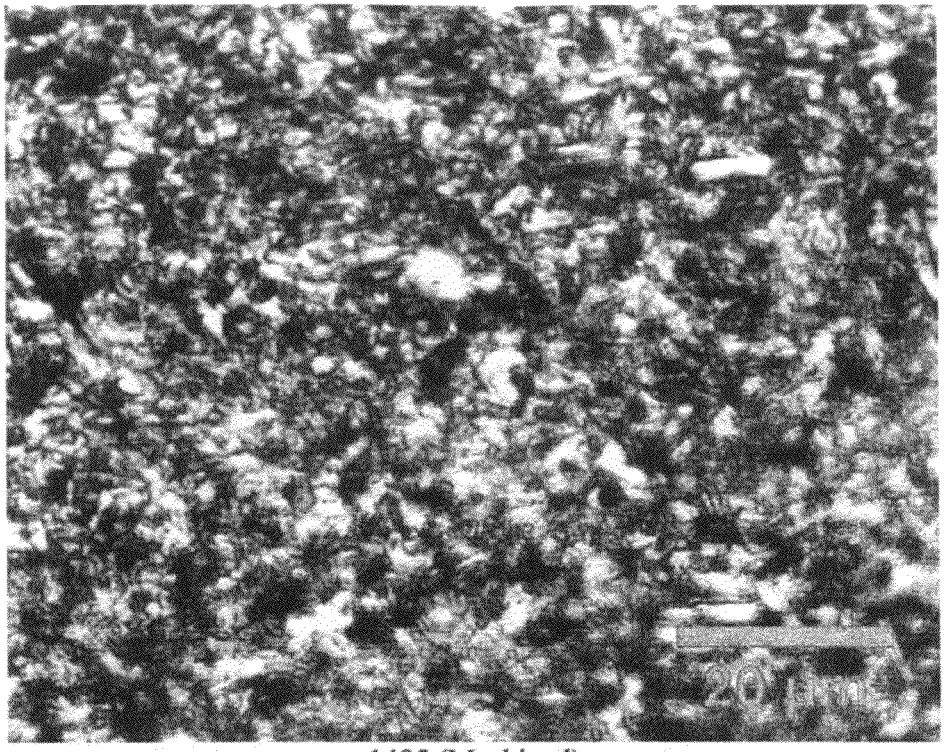
1485 (Machined)
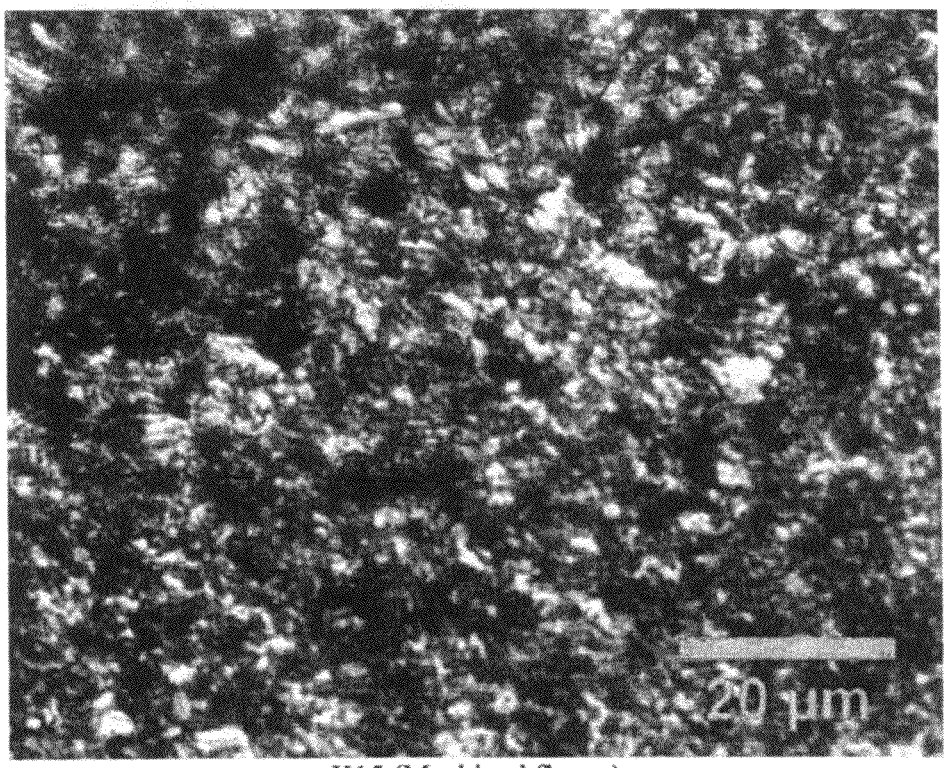
K15 (Machined flange)
Fig. 44 Microstructures of Post-Process Finished Sample (1485 and K15)

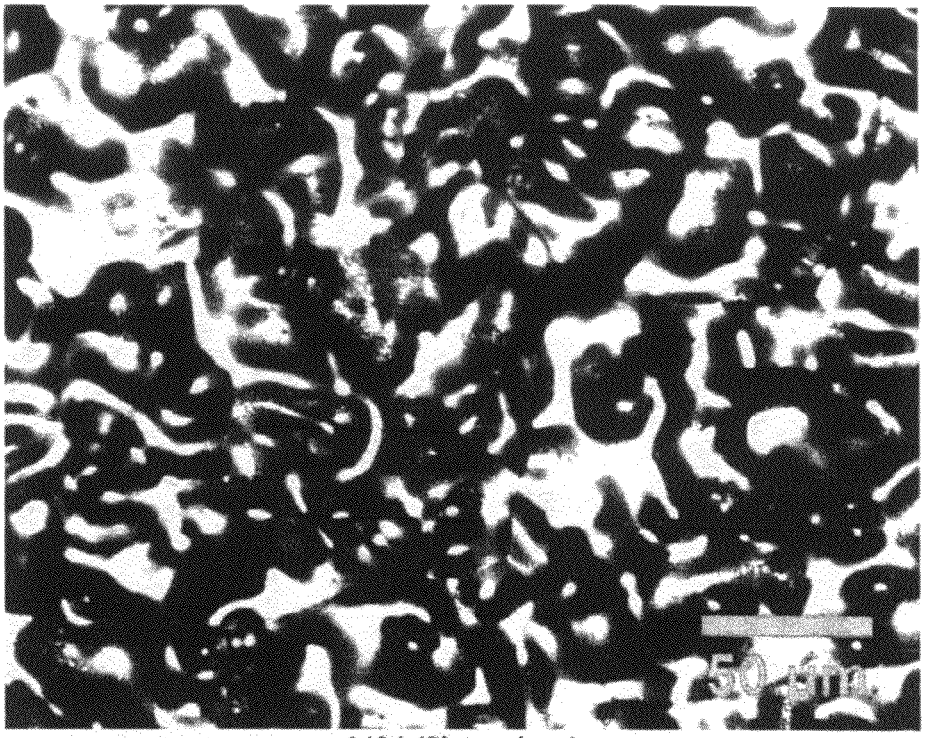
1434 (Sintered top)
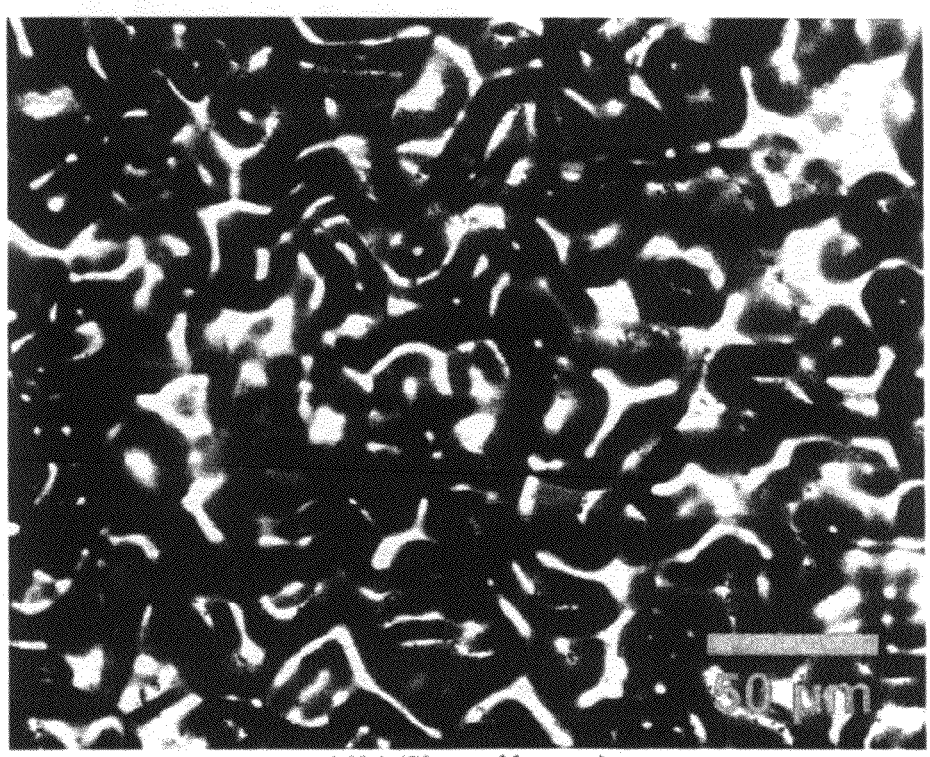
1434 (Sintered bottom)
Fig. 45 As-Sintered Microstructures (Sample 1434)

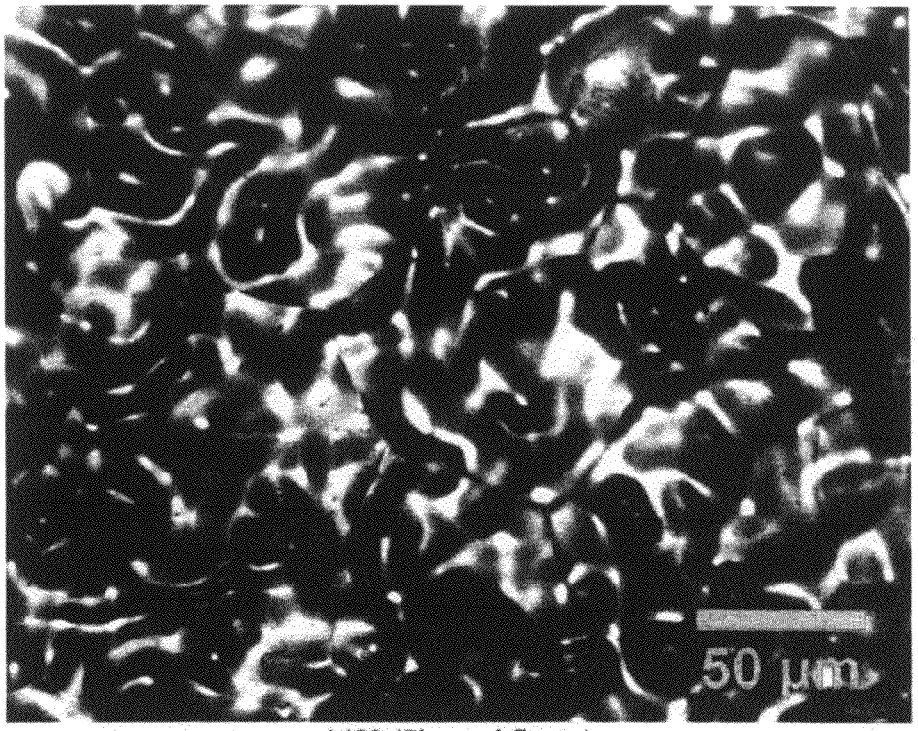
1482 (Sintered flange)
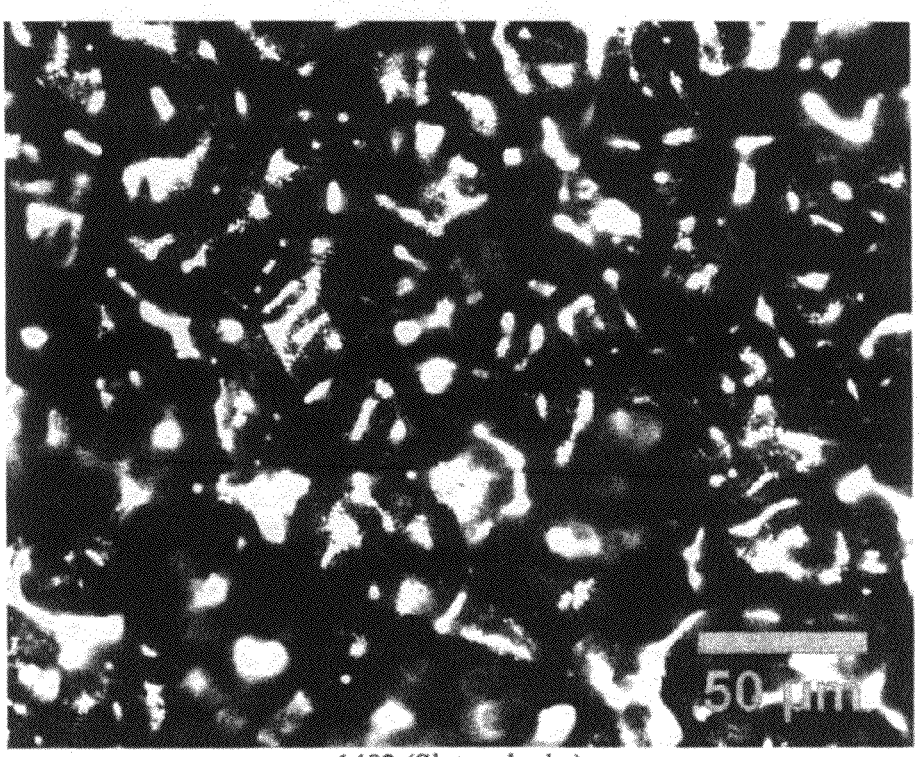
1482 (Sintered tube)
Fig. 46. As-Sintered Microstructures (Sample 1482)

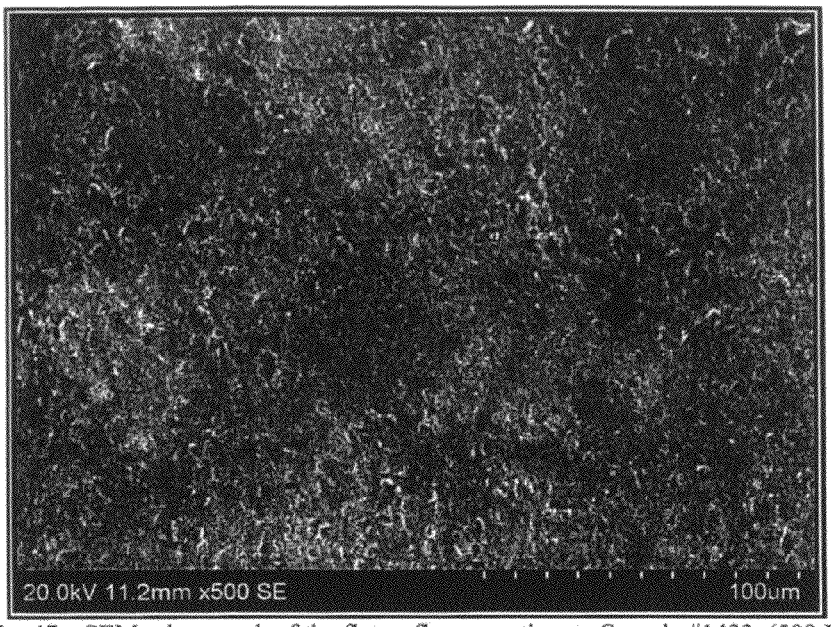
Fig. 47 a SEM micprograh of the flat or flange section on Sample #1433 (500 X)
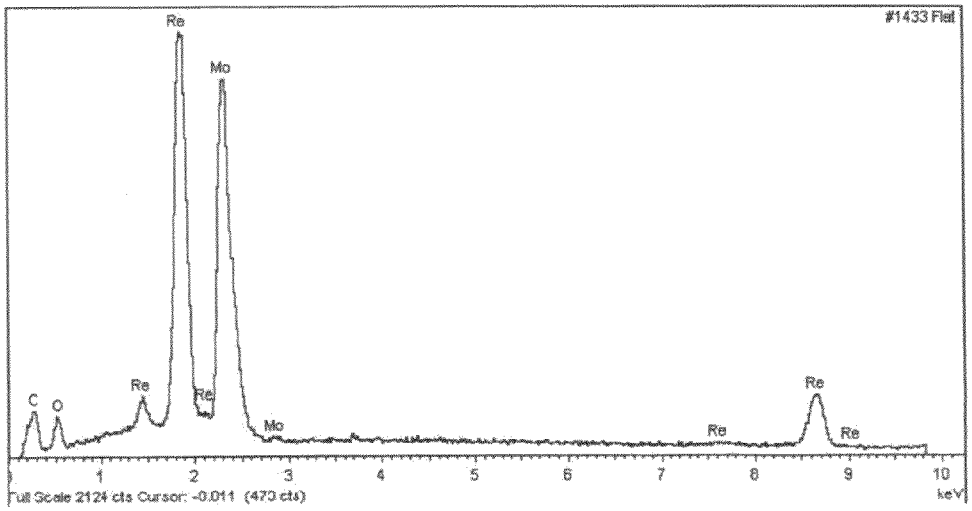
Fig. 47b EDS spectrum in the flat/flange section for Sample #1433

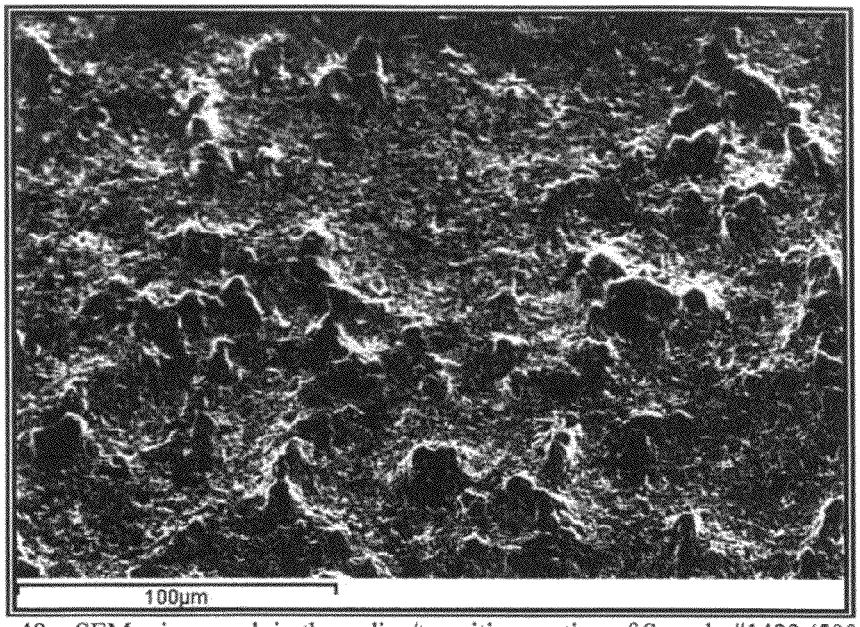
Fig. 48a: SEM micrograph in the radius/transition section of Sample #1433 (500 X)
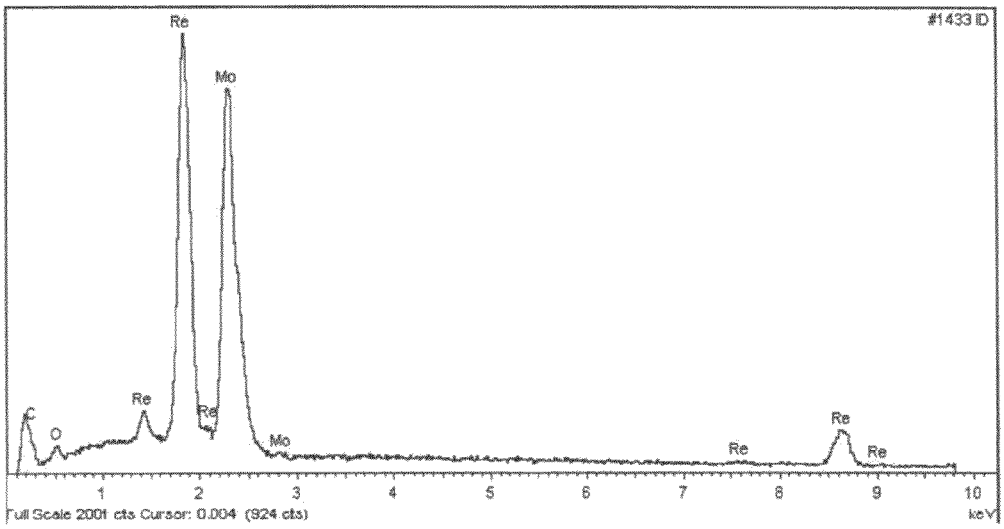
Fig. 48b. EDS spectrum in the transition area for Sample #1433

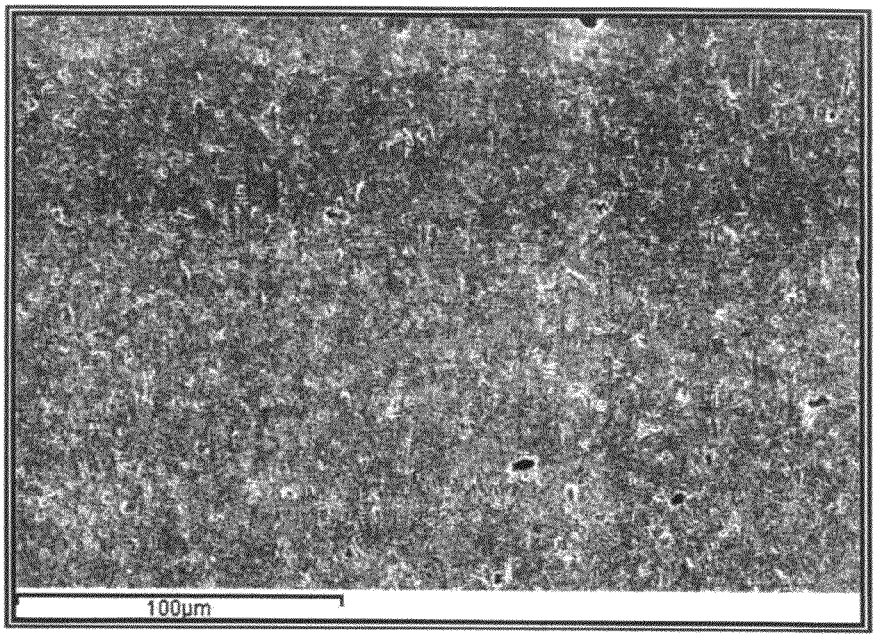
Fig. 49 a SEM micrograph of Sample #1433 in the ID (500 X)
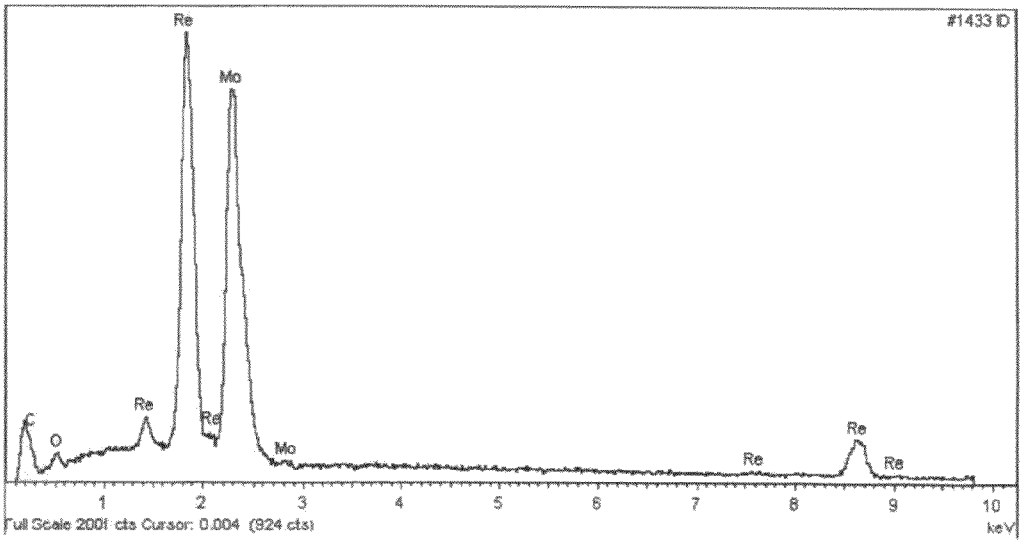
Fig. 49b EDS spectrum in the ID for Sample #1433

NEAR NET SHAPE FABRICATION OF HIGH TEMPERATURE COMPONENTS USING HIGH PRESSURE COMBUSTION DRIVEN COMPACTION PROCESS

This application claims the benefit of U.S. Provisional Application No. 61/072,179, filed Mar. 28, 2008, which is hereby incorporated by reference in its entirety.

This invention was made with Government support under Contract HG0006-05-C-7224, awarded by the Missile Defense Agency. The government has certain rights in this invention.

SUMMARY OF THE INVENTION

The present invention relates in general to the near net shape fabrication of select high temperature Molybdenum-Rhenium alloy and unique mechanical strength/ductility and super-plastic properties up to 3500 deg F. for potential high temperature component applications.

Various advanced propulsion system components such as rocket motor components, igniter system parts, advanced thruster/plasma electrodes, nuclear components require not only suitable high temperature materials, but also innovative near net shape or net shape manufacturing with unique high temperature durability properties and cost-effectiveness. The present invention pertains to the innovative high pressure Combustion Driven Compaction (CDC) method to process typical high temperature Molybdenum-Rhenium (Mo—Re) alloy of composition 52.5 Mo-47.5 Re in both near net shape form and mechanical test sample geometries using and successfully hot-fire test the component for potential advanced propulsion and other high temperature applications.

This unique high pressure CDC compaction method has several benefits: 1) higher compacted part green and sintered densities 2) minimized wastage of materials 3) minimal number of processing steps without requiring prolonged heating during pressing 4) ability to press finer size difficult-to-press and otherwise hot-pressable or hot-isostatic pressable powders.

Material choices and unique manufacturing of components of near net shape with minimal materials wastage and adequate properties for high temperature applications requiring Rhenium based alloys are therefore crucial. In either case, the components are subjected to extreme erosive conditions of heat (several thousands of deg F) and flow velocity. Solutions generally require high performance refractory or refractory based ceramic composite materials (Table 1) with better durability, minimal number of processing steps, and high temperature strength/ductility properties and demand faster and cost-effective production processes.

Vapor deposition techniques (e.g., CVD, CVI), in general, are relatively slow and expensive and involve intermediate multi-steps to obtain the near net shape product. Microstructures of CVD produced materials usually involve preferential grain growth directions such as columnar grains, for example. Plasma processes have the ability to cover a large areas of the substrates, with some porosity present inherently (e.g., 5 to 15% are typical) and limitations for finer surface finish qualities, crack-sensitive composite alloy processing and tighter chemistry/impurity controls due to rapid solidification rates. Conventional powder metallurgical pressing technology is limited by relatively lower compaction pressures (e.g., <50-55 tsi) that limits the densification process especially for pressing finer powders, with much higher part shrinkages requiring several post-process steps to improve the properties and obtain the final geometry. Hot-Isostatic Pressing (HIP) involves both heating and pressures (20000-60000 psi), is a labor-intensive and costly process, and is not suitable for rapid/higher production rate components.

Materials such as rhenium-tantalum alloys (e.g., 97% Re-3% Ta) have been reported by other researchers for applications such as valves, poppets, seats and nozzles previously with improved strength and ductility characteristics. However, Mo—Re alloys have unique combination of high temperature strength with better ductility as claimed in this innovation. Also, when fabricating Re—Ta alloys, the low pressure compacted materials have been sintered so that tantalum goes into solid solution with rhenium. The sintered material was then cold rolled. The cold rolling disperses oxides away from concentrations in the alloy grain boundaries. If desired, the alloy may then be annealed. This is another example of conventional powder metallurgical art which involves several steps including additional rolling and annealing, for example, to obtain better densification and properties.

When it comes to Mo—Re processing, CDC high pressure compaction overcomes several of these challenges posed by conventional methods, to obtain denser, near net shape parts with excellent high temperature properties and much better surface finish attributes together with few processing steps and economical cost-effective manufacturing and potential for rapid manufacturing.

Some high temperature component/propulsion structural parts are made of carbon/carbon (C/C) or carbon/silicon carbide (C/SiC) composites due to their high temperature strength and lightweight properties. However, the oxidation behavior of C/C based composites at temperatures >450-500 deg C. still poses some limitations and demands alternate protective liner materials against oxidation and erosion. The Mo—Re or Rhenium or Tungsten-based alloy materials are popular for such applications.

Rhenium-Based and Molybdenum-Rhenium alloys (e.g., Mo—Re alloys) have been used extensively in industries in defense, energy and commercial as well as research and production welding. Mo—Re alloy products, which are cost-effective alternates with better high temperature ductility properties to relatively more expensive Rhenium are usually available commercially in three standard alloy compositions: Mo—Re 41%; Mo—Re 44.5%; Mo—Re 47.5%. These commercially available and relatively more expensive wrought refractory materials unlike tungsten or molybdenum are usually available in rod, bar, tubing, foil, sheet and plate. The cost and availability of powder raw materials including the powder properties such as size variations/chemistry/quality/purity vary a lot depending on the powder vendors and fluctuating market conditions.

As claimed in this innovation, UTRON's CDC high pressure (up to 150 tsi) compaction processing overcomes that challenge to develop near net shape cost-effective manufacturing, reduction in materials wastage and post-process machining, improved part densification compared to traditional powder metallurgy (<50-55 tsi), less thermal shrinkage attributes, ability to press coarse and fine powders including nanomaterials (FIGS. 6, 7 and 8 and Tables 2 and 3) and desirable high temperature mechanical properties with significant reduction in lead time (e.g., 2-3 months as opposed to several months with conventional methods) with potential for weight reduction using refractory as well as potential composite materials and adequate high temperature mechanical durability attributes useful for high temperature applications.

CDC at high pressures up to 150 tsi has the ability to generate desired finer and uniform microstructures by careful process control and minimal grain growth with potential for novel composite materials development. The CDC processed samples of several novel other Re, Mo—Re and W—Re based alloys and unique composites have been successfully fabricated in select geometries and evaluated for geometrical, physical, microstructural, microchemistry, microhardness and high temperature mechanical properties. These findings are encouraging to produce Re, Mo—Re and W—Re refractory materials their associated composites with desirable fine grained attributes, varying strengthening characteristics (Rc 13-14 to Rc 55.) and ability to fabricate Functional Gradient Materials (FGM). High temperature mechanical testing of select materials have been obtained up to 3500 deg F. with excellent properties.

The potential high temp materials are refractories such as Re, W—Re, or Re/Mo and or composites with carbides, nitrides, and borides such as C/SiC, TaC, HfC, HfN, $HfB_2$, $ZrB_2$, $TiB_2$, depending on the temperature of use, thermophysical and mechanical material properties. Re or Mo/Re or W—Re alloys and their composites have unique advantage of better strength and reasonable mechanical properties. It is seen that rhenium (Melt Temp 3180 deg C.) has the highest strength and modulus of elasticity compared to other refractory metals such as tungsten, molybdenum, tantalum, and niobium with melt temperatures of 3410, 2610, 2996, and 2468 deg C., respectively. It is seen that rhenium (Melting Point of 3180 deg C.) has the highest strength and modulus of elasticity compared to other refractory metals such as tungsten, molybdenum, tantalum, and niobium with melting points, 3410, 2610, 2996, and 2468 deg C., respectively. The high strength, high-temperature Mo-based TZM alloy and W—Re alloys are of greatest technological importance. TZM and Re—W are manufactured either by PM or arc-cast processing followed by densification by hot working processes such as HIP, swaging, etc. W—Re alloys have much higher strengths and operating temperatures than TZM.

The refractory materials are currently manufactured either by PM or arc-cast processing followed by densification by hot working processes such as HIP, swaging, etc. Unlike the relatively lower cost Molybdenum or Tungsten, At present due to the higher varying cost, limited supply and specialized uses/demands of Rhenium (e.g., gas turbine superalloy additive and petrochemical catalyst uses are common uses besides their needs for other high temperature component applications involving Re-based alloy materials) and emerging competitiveness among limited number of powder suppliers to provide this powder to us in the USA, there is crucial demand to develop the required material suitability using our high pressure compaction manufacturing, develop the materials property and powder quality affecting the properties and cost-effective and competitive near net shape manufacturing needs and rapid materials development.

The potential applications for combustion driven compaction technology transfer include the following: rocket motor components, valves, emission cathodes/anodes, military ammunitions/projectiles/heat sinks, x-ray targets/tubes, thermoelectrics, roller bearings, permanent/superconducting magnets, valve seats, gears, rotorcraft bearings, high temperature composite bearings, and wear/corrosion resistant tribological components.

Competitive manufacturing advantages are:

improved green and sintered part densification due to higher CDC compaction pressures, ability to process novel alloy compositions and densify variety of powder materials (e.g., micro to nano and composites), amenable for rapid production (e.g., typically feasible 1 to 6 CDC pressed parts/minute, depending on the nature of part geometry) and automation, less scrap materials/reduced materials wastage, near net/net shaping depending on the part geometry, reduced lead times (few weeks as opposed to months), and Cost-effective manufacturing, and superior surface quality.

The invention provides rapid novel materials development with multi-functional uses and innovative rhenium based refractory materials and composites for evaluation and selection using CDC compaction manufacturing. These advanced unique and novel composite materials have been developed using CDC compaction and processing successfully:

Re; Mo-41 Re; W-25Re; Re-0.5Hf-2 HfC; Re-5 Ta-0.5Hf-2HfC; Re-5 Mo-0.5 Hf-2HfC; Mo-41 Re-10 W; Mo-41Re-10 Ta; Mo-41Re-0.5 Hf-2HfC; W-25 Re-0.5 Hf-2 HfC; W-25Re-5Ta-0.5 Hf-2HfC; W-25Re-5 Mo-0.5Hf-2 HfC

We have demonstrated that by careful optimization, we can obtain excellent high temperature properties of CDC compacted and optimally processed parts.

There have been crucial needs to improve the durability and minimize the manufacturing time and cost in fabricating the near net shape or net shape for such demanding high temperature applications.

The invention provides:

- A novel method of near net shape manufacturing a specific rhenium-molybdenum alloy (e.g., 52.5 Mo-47.5 Re) using high pressure Combustion Driven Compaction (CDC) process with the potential to fabricate other similar alloys comprising the steps of:
- High pressure compaction (e.g., within a range 85 tsi-150 tsi) of a mechanically blended mixture of rhenium and molybdenum alloy material without using any binders or additives to obtain well-bonded, crack-free and high density green parts of various geometrical shapes of mechanical test samples and other high temperature component designs (HTC Design A, Design B, Design C, Design D and Design E) with gentler/controlled loading profiles with milliseconds of pressing times.
- Suitable sintering at 2300 deg C. in a controlled environment (hydrogen) for few hours to obtain higher sintered part densities, much less part dimensional shrinkages, fine microstructures and high temperature mechanical properties equivalent or better than Hot Isostatic Pressed (HIP) materials.
- Controlled and reproducible post-process finishing steps to obtain the net shaping of the final HTC component with excellent materials response for the post-process finishing steps with superior fine surface finishes (e.g., <16 micro-inch on the inner diameter areas) and minimal wastage of materials.
- Novelty of high pressure CDC compaction at 85-150 tsi range using difficult-to-press finer powders (e.g., −635 mesh), unlike the convention low pressure (~50-55 tsi) Powder Metallurgy (PM) or Hot-Pressing/Hot-Isostatic Pressing methods that involve both prolonged heating and pressure and less suitable for rapid production, to fabricate near net shape components in minimal number of steps and cost-effective fabrication of high density Mo—Re high temperature components.
- Potential ability to fabricate other Mo/Re based alloys (e.g., Mo/41 Re, W—Re, Re) and functional gradient materials (FGM) layers of various Re and Mo-alloys and composites in select geometries using high pressure CDC compaction and optimal sintering.
- Few processing steps due to higher compacted part green and sintered densities as compared to conventional powder metallurgy.
- The starting mixture is mechanically blended 52.5 Molybdenum-47.5% Rhenium.

Sintering further comprises controlled sintering in hydrogen at a temperature 2300 deg C. for up to 4 hours.

There are no additional intermediate sintering steps after CDC pressing at high pressures unlike the conventional low pressure powder metallurgy methods or annealing involved after post-process finishing.

The CDC high pressure compaction followed by suitable thermal sintering of mechanical test samples (the CDC process conditions were similar to those conditions used for high temperature component geometries) has resulted in improved higher sintered densities better than conventional low pressure PM methods and high temperature mechanical properties (up to test temperatures of 3500 deg F.) equivalent or better than HIP equivalent Mo—Re material.

Post-process finishing the pressed and sintered parts to obtain excellent surface quality attributes (in some critical areas of ID and flange inlet areas, finishes of <16 micro-inches have been obtained), minimal materials wastage, controlled fine grained microstructures, adequate responses to hot-fire testing (e.g., up to test temperatures of 3700 deg F.) and net shaping behavior.

There was no need for post-process annealing and optimal post-process steps were found to eliminate less desirable chemical contamination effects due to post-process step processes such as copper or zinc.

Theses and further and other objects and features of the invention are apparent in the disclosure, which includes the above and ongoing written specification, with the claims and the drawings.

BRIEF DESCRIPTION OF THE DRAWINGS

FIG. 1 Schematic of the Combustion Driven Compaction-CDC Process

FIG. 2 Typical CDC High Pressure Compaction Loading Cycle

FIG. 3 Compactness Comparison of 300 Ton CDC Press with Traditional Press

FIG. 4 300 and 1000 Ton CDC Presses

FIG. 5 400 Ton CDC Press

FIG. 6 CDC High Pressure Compacted Near Net Shape and Net Shape Geometries of a Variety of Materials (a) Single layered and Multilayered (e.g., Stainless Steel/Copper) Parts b) CDC Copper Disks for Next Generation Linear Colliders c) Net Shaped High Density CDC Tungsten Disk Targets for X-ray Tube Applications d) CDC Compacted Properties of Al, Steel, Stainless Steel and Copper and Comparison of Various Manufacturing Processes (% Scrap Metals)

FIG. 7 CDC Processed Ceramics

FIG. 8 CDC Compacted Functional Gradient Materials (FGM) for High Temperature Protection FIG. 9 Optimally Sintered CDC Functional Gradient Layer Samples;

1600; Re(−200) 0.5% Hf 2% HfC

1601; Layered, Re(−200) 0.5% Hf 2% HfC//ReMo41 (−635)

1602; Layered, Re(−200) 0.5% Hf 2% HfC//WRe25 (−635)//ReMo41 (−635)

FIG. 10 CDC Loading graph for Functional Gradient Materials for High Temperature Applications (Sample 1602)

FIG. 11 High Temperature Data at 3500 deg F. of Previously Tested CDC Mo-47.5% Re Samples Compacted at 150 tsi together with HIP Material Data FIG. 12 Fractured Samples Indicating Excellent Ductility in the form of Necking @ 3500 deg F.

FIG. 13 High Temperature Mechanical Properties of CDC Compacted and Optimally Sintered Re, Mo and W-Based alloy Samples FIG. 14 Microstructures of CDC Compacted and Processed High Temperature Alloys Mo-41 Re, W-25Re and Re—Ta—Hf—HfC (200×) and Re (250×)

FIG. 15 300 Ton CDC Press with Near Net Shape High Temperature Component-Design C tooling FIG. 16 CDC Compacted HTC-Design C-Sample #1488 Prior to Ejection from the 300 Ton-Press Die Assembly (~84 tsi)

FIGS. 17*a-k* CDC Compacted 52.5 Mo-47.5 Re Design C Near Net Shape Part #1487 and 1488 after Extraction from 300 Ton-CDC Press from the Die Assembly (e.g., CDC Compaction Pressure on the Flange-84 tsi) and other Near Net Shape Parts FIG. 18 400 Ton CDC-Press with High Temperature Component-HTC-D tooling FIG. 19 400 Ton CDC Press with HTC-D tooling FIG. 20 CDC Compacted HTC-D part during ejection (400 Ton Press)

FIG. 21 CDC Compacted HTC-D part after ejection

FIG. 22 400 Ton CDC Press with HTC-E tooling

FIG. 23 CDC Compacted HTC-E part during ejection (400 Ton Press)

FIG. 24 CDC Compacted HTC-E part after ejection (400 Ton Press)

FIG. 25 CDC Compacted at ~85 tsi and Optimally Sintered/Post-Process Finished High Temperature Component-HTC-D final part FIG. 26 CDC Compacted at ~85 tsi and Optimally Sintered/Post-Process finished High Temperature Component-HTC-E final part FIG. 27 Sample #1023, 1024, 1025, 1026, 1027, 1028, 1029, 1030

Sintered Ring samples—The CDC properties are listed in Table 13 [44]

FIG. 28 CDC Compacted and Processed HTC-Design A (Samples #1457, 1458 and 1459)

FIG. 29*a* CDC Compaction Loading Profiles-300 Ton Press (Samples #1457, 1458 and 1466)

FIG. 29*b* CDC Compaction Loading Profiles-300 Ton Press (Samples 1487 and 1488)

FIG. 30 Controlled Unique Combustion Driven Compaction-CDC-Loading Cycles for Various Compacted Geometries Indicating milliseconds of Pressing Time (400 Ton Press: Sample 4735-08)

FIG. 31 CDC Green Tensile Mechanical samples Compacted at 85 tsi (Sample ID: 1713-1730)

FIG. 32 CDC Compacted Green Sample Densities Using 400 Ton-CDC Press (HTC-Design D)

FIG. 33 CDC Compacted Green Part Dimensions

FIG. 34 Minimal Shrinkage (negative % Change) Attributes of CDC Compacted HTC-Design D Parts at 85 tsi and Optimal Sintering FIG. 35 Potential Benefits of Higher CDC Compaction Pressures on Increased Green Part Densities of HTC-Design C Near Net Shaped Mo-47.5% Re Parts.

Note that the Conventional Presses are limited to 50-55 tsi.

FIG. 36 Room (e.g., 70 deg F.) and High Temperature (1500, 2000, 2500, 3000 and 3500 deg F.) Mechanical Properties of CDC Compacted at 85 tsi and Optimally Sintered 52.5 Mo-47.5 Re Mechanical Test Samples FIG. 37 Sintered CDC Compacted (85 tsi) mechanical test Samples #1713-1730

FIG. 38 Sintered CDC Compacted (150 tsi) Sample #1731

FIG. 39 Microstructures of As-Sintered Mechanical Tensile Sample 1713 (CDC Load: 85 tsi)

FIG. 40 Microstructures of As-Sintered Mechanical Tensile Sample (CDC Load: 85 tsi)

FIG. 41 Microstructures of CDC Mechanical Tensile Sample #1731 (CDC Load: 150 tsi)

FIG. 42 Post-Process Finished Microstructures (Sample 1433)

FIG. 43 Post-Processed Finished Microstructures (Sample 1435)

FIG. 44 Microstructures of Post-Process Finished Sample (1485 and K15)

FIG. 45 As-Sintered Microstructures (Sample 1434)

FIG. 46 As-Sintered Microstructures (Sample 1482)

FIGS. 47*a-b* SEM micrograph and EDS spectrum of flat flange Sample #1433

FIGS. 48*a-b* SEM micrograph and EDS spectrum of transition area of Sample #1433

FIGS. 49*a-b* SEM micrograph and EDS spectrum in the ID for Sample #1433

DETAILED DESCRIPTION

The CDC Process

Combustion Driven Compaction (CDC) uses the controlled release of energy from combustion of natural gas and air to compact powders. In operation the following steps occur: Fill chamber to high pressure with a mixture of natural gas and air. As the chamber is being filled the piston or ram is allowed to move down pre-compressing and removing entrapped air from the powder. The gas supply is closed, and an ignition stimulus is applied, causing the pressure.

The basic CDC process is shown in FIG. 1. Press 10 has a body 12 with a chamber 14 which is filled with Natural Gas 15, CH5, and air or oxygen at high pressure.

Press 10 has a die 20 with a cavity 22 in which blended metallurgical powder 24 is disposed.

Piston 30 is the single moving part. The part top 32 of the piston in the chamber 14 may have a larger diameter than the bottom part 34 of the piston.

Fixed die 30 has an interior cavity 22 shaped to the desired near net shape. The bottom part 34 of piston 30 is shaped complementary to the near net shape of the cavity 22. Gas enters through the inlet 40 and moves the piston 30 downward compressing the powder 24. Electric ignition 42 is energized combusting the gas and driving the lower part 34 of the piston into the die at about 85 to 150 tsi. The result is a near net shape part removed from the die which does not shrink upon sintering.

The CDC process is unique in utilizing the direct conversion of chemical energy to produce compaction. In addition, the process inherently includes a pre-compaction step, preparing the powder for the final compaction load. The CDC process can provide standard or very high compaction tonnages, resulting in very high-density parts with improved mechanical properties. In addition to the unique loading sequence and high tonnage, the process occurs over a relatively short time frame (a few hundred milliseconds). A typical UTRON's Combustion Driven Compaction gentler loading profile is shown in FIG. 2, which illustrates the faster process cycle time of milliseconds. Additional similar loading profiles used for fabricating Functional Gradient Layered Materials and other High Temperature Component Designs are shown in FIG. 10 and FIGS. 29 *a*, 29*b* (300 Ton Press) and FIG. 30 (400 Ton Press).

A CDC press is compact and uncomplicated. For example, a 4137 MPa (300-ton) mechanical or hydraulic press is typically two or more building floors tall and has many moving parts and/or complex hydraulics (FIG. 3 provides some comparison). UTRON's compact prototype CDC 300 and 400 (FIGS. 3 and 5) and 1000 ton (FIG. 4) rated presses are shown. Comparison with a traditionally used much larger conventional press is shown in FIG. 3.

CDC Loading Cycle

As a general rule, as the compressive load applied to a powder metal is raised, the compact density and green and sintered part properties improve. However, if the powder is compressed too rapidly or violently, shock propagation in some materials can cause internal cracks and separations (over-pressing).

CDC Press Scaling

As previously mentioned, since the CDC press directly converts chemical energy into compaction energy, it is very energy efficient and capable of producing enormous compaction loads. To date several presses of increasing size have been constructed and operated with 300, 400 and 1000 ton. Scaling from one size to the next has been relatively straightforward. Since the process works more or less like a piston in an automobile, although at much higher pressures, the loads that can be produced are a direct function of the combustion pressure and the area of the ram (piston). It is possible then to scale a CDC press to very high tonnages (e.g., up to 5000 Tons) without increasing the size of the press itself dramatically.

There are other engineering issues we are currently working with producing a "high rate" production version of a CDC press. These issues include rapid filling of propellant gases, rapid venting of combustion gases, purging of water produced in the chamber, active cooling of the chamber if necessary, and robust repetitive high-pressure ignition. A 400 Ton CDC production press (for example, to manufacture 1 to 6 parts per minute) is in design/development stage at UTRON for near net shape and rapid cost-effective manufacturing for various defense, energy and commercial applications.

Properties of CDC Produced Compacts

The CDC process operates at compaction loads of 15 to 150-tsi (tons per square inch). It is well known that compaction tonnage generally makes a large difference in the final quality of the compacted part, both in the green (unsintered state) and in the sintered state. Another benefit of high part density is minimal dimensional changes (e.g., shrinkages) when the material is sintered. Table 8 and FIG. 34 provide the minimized shrinkage attributes data for CDC samples of 52.5 Mo-47.5 Re.

The combination of high temperature strength together with elongation and hence "relative toughness" of samples produced with the high pressure CDC process is particularly exceptional often approaching that of comparable or better than equivalent annealed or HIP materials under optimized CDC process conditions. For example, for 52.5 Mo-47.5 Re high temperature alloy material, FIG. 11 provides the data from 150 tsi high pressure compacted samples and Table 11 and FIG. 36 provide the data for samples, compacted at ~85 tsi. Table 10 provides the higher densification of tensile samples, and Table 12 provides the density data of CDC processed HTC geometries (all processed at '85 tsi), indicating the similar trends. The small scale rings compacted at 150 tsi and sintered suitably also provided higher densification behavior, which has been reported previously. For other similar and advanced high temperature alloys (e.g., Mo-41 Re, W-25 Re, and Re/Re composites in FIGS. 13-14), by CDC processing, we have also obtained finer microstructures and improved high temperature mechanical properties with high densifications. These unique findings from the high temperature mechanical behavior of the processed Mo—Re alloys using CDC high pressures in the range of 85 to 150 tsi have formed the basis for this patent to develop the near net shaped high temperature components (HTC) of various designs/geometries using 52.5 Mo-47.5 Re mechanically blended powder materials and successfully demonstrate the unique manufacturing method as well hot-fire testing of the produced 52.5 Mo-47.5 Re components (HTC-Design A, HTC-Design B and Design C).

FIGS. 15-24 provides the various press/tooling/part geometry behavior during the CDC compaction and FIGS. 25-26, show the final CDC-HTC parts of Design D and Design E after pressing, suitable/reproducible high temperature sintering cycle at 2300 deg C. in hydrogen for a few hours and post-finishing steps. We have also successfully fabricated Design C parts and hot-fire tested them. FIGS. 29 and 30 provide the typical gentler/controllable CDC loading profiles in milliseconds of compaction time used for the successful near net shape fabrication reported in this invention.

FIG. 31 shows the CDC green tensile mechanical samples compacted at 85 tsi (Sample ID: 1713-1730). FIG. 32 indicates CDC compacted green sample densities using a 400 ton-CDC Press (HTC-Design D). FIG. 33 shows the CDC compacted green part dimensions. FIG. 34 provides minimal shrinkage (negative % Change) attributes of CDC compacted HTC Design D parts at 85 tsi and optimal sintering. FIG. 35 reveals the potential benefits of higher CDC compaction pressures on increased green part densities of HTC Design C near net shaped Mo-47.5% Re parts.

Note that the conventional presses are limited to 50-55 tsi. FIG. 36 provides the room (e.g., 70 deg F.) and high temperature (1500, 2000, 2500, 3000 and 3500 deg F.) mechanical properties of CDC compacted at 85 tsi and optimally sintered 52.5 Mo-47.5 Re mechanical test samples.

FIG. 27 and Table 13 provide the previously reported small scale ring samples processed by CDC compaction, indicating the higher densification and fine surface finish quality. In the previous patent application Ser. No. 11/975,910 filed Oct. 22, 2007, which is incorporated herein by reference as if fully reproduced and set forth herein, we have reported the development of novel high temperature composite alloys of Mo—Re together with excellent high temperature behavior. The CDC process is done by cold pressing followed by suitable sintering with minimal post-process steps to obtain higher density near or net shape products. It is to be noted that conventional pressing methods usually are done at 50-55 tsi, and Hot Isostatic Pressing (HIP) involves both heating and pressures.

The low % of scrap metals in the CDC process (FIG. 6) compared to other manufacturing processes is unique. Select results of density, surface roughness and hardness of CDC samples of Al—Mg, steel, stainless steel and copper reveal higher density, smoother surface finish and stronger materials properties. The superior surface quality of CDC copper and stainless steels is evident from FIG. 6 as well as the ring geometry typical for nozzle liner inserts. Aluminum nitride and SiC ceramics in cylindrical slugs have been fabricated recently using UTRON's CDC high pressure compaction with much higher green densities (Table 2) followed by higher sintered densities (e.g., 97-99% in CDC SiC) and excellent surface finish (FIG. 7). We have produced significant material property enhancements such as density, strength and % elongation of CDC samples as compared to those made by traditional powder metallurgy methods. Single and multi-component layered compacts have been produced with the CDC process in many combinations including: $Al/Al_2O_3$, Ti/Al, Ta/410SS, Mo/410SS, Ti/316L, Ta/steel, Ta/Cu, and Cu/steel. The representative geometries fabricated include cylinders, rings, and dogbones as well as other geometries. FIG. 9 provides the unique combinations of layered high temperature functional gradient alloys possible for fabrication using high pressure CDC compaction. We have also successfully fabricated Mo/Re alloys with Hf and HfC and optimized in preliminary conditions for obtaining strengths of ~40,000 psi at 2500° F. testing in our current project. FIGS. 11-13 provide the excellent high temperature mechanical properties of CDC high pressure compacted @ 150 tsi followed by suitable sintering in hydrogen at 2300 deg C. for a few hours.

Superior surface quality in microns or sub-microns and mechanical/ductility equivalent or better than wrought metals have been obtained on several geometries of materials at higher CDC compaction pressures under optimum process conditions. More recently, we have also successfully CDC compacted and sintered various refractories [43-48] such as tungsten, molybdenum, Re, Mo—Re alloys (Table 4 and FIGS. 8 and 9) and Hf, HfC alloys with net shape, sub-micron surface finishes, much higher densities and part properties for potential x-ray targets and other high temperature components. In another project for potential Army application, we demonstrated by CDC processing that refractory tantalum can be bonded to aluminum substrate by high pressure solid-state compaction/sintering using intelligent choices of powder selection and compaction process parameters.

Tables 4-13 show the results of CDC high pressure compaction to produce 52.5 Mo-47.5 Re alloys successfully for potential high temperature uses. The produced Mo/Re alloys by CDC processing and suitable post-process sintering revealed excellent higher ductility and strength attributes and values up to test temperatures of 3500° F. (FIGS. 11-13, FIG. 36). The relatively fine microstructures of the suitably processed Mo—Re parts are similar to the finer grained structures (<70-80 microns) as reported previously. Previously we have successfully compacted and produced net-shaping tungsten, rhenium, molybdenum and TZM disks (0.5 inch diameter) with relatively high sintered densities (up to 96-99%) including some Re—, W-25 Re and Re—Mo (52.5 Mo-47.5 Re) materials with other composite additions such as Hf, and HfC. Some AlN ceramic, SiC and metal-matrix composites, e.g., Cu/AlN, were compacted at 150 tsi without cracking using intelligent powder alloys and optimum compaction process optimization.

Summary of CDC High Pressure Compaction Technology Benefits

A new high pressure compaction technology and the processing and variety of materials and geometries that can be compacted based on the direct conversion of chemical energy from natural gas and air combustion has been demonstrated to fabricate cost-effectively Mo—Re and other advanced novel composite alloys for near net shape high temperature components. The CDC high pressure press has three main attributes: First, owning to its high efficiency and unique design, it is very compact relative to other press technologies. A CDC based press is a fraction of the size of a conventional press with the same load capability. Secondly, due to its distinctive loading cycle, the press is capable of delivering "standard" or very high compaction loads without damaging die components or producing cracks in the compacts. Finally, compacts made at high controlled loads in the CDC process with only die wall lubrication display greatly flexible manufacturing of several metallic, ceramic and composite materials with enhanced densification, controlled geometry, minimal shrinkage and materials wastage, and improved mechanical durability properties before and after sintering.

Anticipated Benefits

The potential applications for the proposed CDC technology include rocket motor components, plasma/thruster/ionic propulsion electrodes, high temperature valves, valve bodies, high performance armors, heat sinks, thermoelectric/battery/fuel cell electrodes, military ammunitions/projectiles/heat shields, gyroscopes, igniter components, electronic packaging/aerospace components, x-ray targets/tubes, high performance welding and glass melting electrodes, RF damage resistant refractory rings used for linear collider copper disk structures, boring bars/tools, high temperature dies, brazing fixtures, electrical contacts, warheads (charge liners) [30-31], rocket nozzles/liners, and high vacuum components. The other applications of CDC processing for DOE needs are in Next Linear Collider (NLC)/superconducting accelerator components, couplers, low temperature vacuum seals (e.g. Al—Mg alloys), and nuclear plasma components. Other commercial applications include ball and roller bearings, permanent/superconducting magnets, sputtering/x-ray targets with conductive copper backing, mould dies with tough steel/copper backing, automotive/aerospace piston rings, valve seats, gears, high temperature composite bearings, microwave appliances, cutting tools, and other wear/corrosion resistant tribological components.

In the new combustion driven compaction (CDC) process, a chamber, powder, a piston or ram, and a gas supply are provided. The chamber is filled with a mixture of natural gas and air and the gas supply is closed. The gas is combusted, causing the pressure in the chamber to rise and exert force on the piston or ram. The powder is then compressed into an intended shape. To pre-compress, and remove entrapped air from, the powder, the piston or ram is pressed against the powder as the chamber is being filled with natural gas and air. The pre-combustion load on the powder may be 15 to 20 tsi.

A die may be provided and the powder may be held in the die. The piston or ram is in the chamber and to compress the powder the piston or ram is pushed into the die and against the powder. The die walls may be lubricated. The peak load on the powder may be up to 150 tsi or greater which is much higher than the conventional powder metallurgy (PM) methods (~50-55 tsi). The peak load on the powder may occur within 250 ms of the initiation of combustion. The peak load on the powder may be a direct function of combustion pressure and the area of the piston or ram. The high pressure and temperature exhaust gases produced during combustion may be used for other press operations.

The process of claim 1 may produce only about 5% or less scrap metal. The powder compression can bond refractory tantalum to aluminum substrate. After compression, the shaped powder may be sintered in hydrogen. The powder provided may be metal powder with a fineness determined by the acceptable shrinkage of the compressed powder. The powder may be −635 mesh or finer (<20 microns).

The powder may be compressed with a pressure of about 85 to 150 tsi. The intended shape may be a near net shape.

A material made by the new combustion driven compaction process has improved density, strength, and % elongation compared to materials made by traditional powder metallurgy. It may be a Mo/Re alloy exhibiting higher strengths and excellent ductility. The material may have surface quality in microns or sub-microns and ductility equivalent or better than wrought metals. The material may have a green density of 75-82% of theoretical and a sintered density of 98% or higher of theoretical density.

The material may have less shrinkage during sintering compared to materials made be traditional powder metallurgy. The material after sintering may have good bonding, no cracking, fine surface quality, higher densification and superior mechanical properties compared to traditionally compacted and sintered powder metallurgy materials, and comparable strength and ductility to wrought annealed materials both at room temperature and high temperatures up to 3500° F. The material may have a strength of 135 ksi or more, ductility of 30% or more, hardness of 315 VHN or greater, or a polycrystalline microstructure. The material may have as an average grain size of <64 microns after sintering.

The material may have functional gradient structures of several layers of differing materials and composites. The material may have a high temperature resistant refractory matrix material.

Innovative materials processing and component fabrication strategies allow economically feasible acquisition of new manufacturing process technologies and unique refractory materials and alloys for several advanced high temperature component applications. Cost-effective and rapid fabrication process technology facilitates transition of high performance, near net shape and reliable prototypes from a research and development environment to a cost-effective manufacturing environment.

One such cost-effective and competitive manufacturing process technology—the high pressure Combustion Driven Powder Compaction (CDC) technology can be used to manufacture denser, durable near net shape components with improved or equivalent properties in minimal number of processing steps, adaptable for rapid production and cost-effective manufacturing. The high temperature material used in this innovation includes pre-blended and finer-grit size (e.g., −635 mesh) mechanical powder mixture of 52.5 Mo-47.5 Re material. These materials are usually made in the wrought product forms (e.g., round bar stocks) by Hot-Isostatic Pressing (HIPing) technology which involves heating and simultaneously applying relatively lower compaction pressures (e.g., 15, 000 to 60, 000 psi) followed by several steps of conventional multi-step post-process finishing processes. Such approach is not only relatively more expensive, laborious and time-consuming, but also results in significant materials wastage due to machining and costly materials not suitable for rapid production at economical manufacturing costs. The CDC high pressure consolidation overcomes several of these challenges. In this innovation, we have claimed to process and successfully fabricate high temperature components (HTC) of various shapes and geometries at relatively intermediate higher compaction pressures (e.g., 85 tsi to 150 tsi) including mechanical test samples and other hollow slugs and complex shapes using specifically 52.5 Mo-47.5 Re material composition.

In this innovation, we have claimed excellent high temperature mechanical properties of CDC test samples at 85 tsi similar to the previously tested samples at 150 tsi after CDC compaction at controlled loading cycle, suitable and reproducible sintering cycle, interchangeable/scalable using 300 Ton or 400 Ton CDC high pressure compaction presses to fabricate the required part geometries and also successfully hot-fire tested the select CDC processed high temperature components both at 85 tsi and 150 tsi. The present manufacturing process innovation of CDC processed near net shaped high temperature Mo—Re alloy based components has resulted in the successful transfer of technology and cost-effective manufacturing for potential end users which opens up several other defense, energy and commercial applications. We have reported the unique properties of a variety of CDC advanced composite materials processed at the highest compaction pressure of 150 tsi and optimal sintering based on novel Molybdenum-Rhenium (Mo—Re) and Rhenium (Re) based alloys/composites for high temperature applications in a previous patent filing.

CDC produces near net shape high temperature components of various simple to complex shapes and sizes with much higher green and sintered densities, much less part shrinkage after sintering and superior surface quality (e.g., microns to sub-microns of average roughness are typical), less post-process machining or materials wastage (FIG. 6), and near net shapes of simple to complex geometry (FIG. 6).

CDC uses a minimal number of steps and has competitively lower manufacturing costs compared to the traditional fabrication methods such as multi-step conventional powder metallurgy (usually limited to <50-55 tsi compaction pressures), Casting/Forging, Chemical Vapor Deposition (CVD), Chemical Vapor Infiltration (CVI) and Vacuum Plasma Processing (VPS) methods.

In response to high temperature materials and innovative near net shape fabrication technology has been developed with tremendous potential for cost-effective manufacturing, minimal or no wastage of expensive and exotic raw materials such as Molybdenum-Rhenium (Mo/Re) and other Re—based composite alloys and rapid manufacturing (e.g., milliseconds of compaction time) method called high pressure Combustion Driven Powder Compaction (CDC) technology.

Potential Mo/Re—X—Y composite materials (e.g., X=Hf; and Y=HfC) have been fabricated all with CDC method in net shape with higher densification and improved mechanical properties at elevated temperatures (e.g., 3500 F or higher). Testing of CDC processed Mo/Re alloys indicated excellent results up to temperatures at 3500 deg F. (Previous Patent Pending).

The CDC high pressure (up to 150 tsi) and faster (few hundred milliseconds) compaction with controlled gentler loading profile are desirable attributes to consolidate variety of micro/nano powders to obtain much higher green and sintered part densities with near net shapes of simple to complex geometries. Other process advantages of CDC processing for refractory Mo/Re alloys with Hf, $Ta_2C$, HfC nozzle components are competitively lower manufacturing costs, minimal wastage of expensive raw powder materials, less shrinkage, and minimal texturing effects as commonly found in traditionally rolled materials.

The high pressure CDC compaction overcomes several processing challenges with its milliseconds of part pressing time, much higher compaction pressures (up to 150 tsi) and gentler loading profiles (FIG. 2, FIG. 10, FIG. 29*a*, FIG. 29*b*, FIG. 30) to improve the densification of variety of engineering materials (FIG. 6, FIG. 7 and FIG. 8) including net-shaped ceramics (FIG. 7 and Table 2). Some of the latest results of CDC copper and stainless steel samples (FIG. 6) indicate high density, superior surface finish/quality, and better mechanical properties and leak resistance comparable to those of wrought/cast materials.

Hafnium (which has density of 13.31 g/cc and melting point of 2230 deg C.) was used for CDC refractory composites developed in this innovation to provide high temperature protection up to temperatures (e.g., 2100 deg C. just below its melting point) as well as strengthening for the Mo/Re base matrix alloy. The mechanically blended Mo/Re base alloy (with calculated theoretical density of 13.5 g/cc and melting point of 2450 using simple rule of mixtures), as used in our CDC compaction experiments has a composition of 52.5 Mo-47.5 Re, as provided by the powder vendor (weight %).

Table 1 provides the properties of high temperature refractory materials and other ceramics. It is seen that rhenium (Melting Point of 3180 deg C.) has the highest strength and modulus of elasticity compared to other refractory metals such as tungsten, molybdenum, tantalum, and niobium with melting points, 3410, 2610, 2996, and 2468 deg C., respectively.

PM processing and CDC in particular can improve the high-temperature properties of Re—W alloys by their ability to disperse other harder and higher-melting carbides such as HfC, TaC. CDC at high pressures at 150 tsi has the ability to generate desired finer and uniform microstructures containing such carbides leading to better high-temperature properties. Some of the carbide based materials are used for protecting carbon-carbon composites in high temperature propulsion systems. It is evident that materials such as HfC, TaC, HfN, and $HfB_2$ have the desired high melting temperatures and potential to serve as ceramic reinforcing materials for refractory based metal matrix composite nozzles such as TZM, Mo/Re and Re—W alloys. The key issues are to match the linear thermal expansion of the composite to prevent thermal cracking/shocking and improve density and interfacial mechanical bonding/thermal shock resistance at higher temperatures.

Near Net-shaping tungsten, molybdenum, Mo/Re alloys and TZM disks (0.5 inch diameter) with relatively high sintered densities (up to 96-98%) including some Re— and Re—Mo materials with Hf, and Hf, some AlN ceramic, SiC and metal-matrix composites (e.g., Cu/AlN) were successfully compacted and produced at 150 tsi without cracking using intelligent powder alloys and compaction. The use of boron carbides and hafnium carbides have shown better thermal cyclic behavior as compared to SiC in some studies indicating the need to further develop similar competitive alloys in composite form. Compared to the oxides, carbides and nitrides (Table 1) have much higher melting temperatures.

The use of Mo/Re based composites with strengthening composite reinforcing materials such as Hf and carbides such as HfC, is highly desirable for very high temperature applications. The previous invention produces cost-effective, and competitive Mo/Re based composite alloys with and without Hf and HfC with select compositions in the near net shape form with two steps of manufacturing. Innovative high pressure CDC powder compaction at 150 tsi and optimal thermal sintering are used to obtain relatively higher green and sintered part densities, sub-micron surface quality, less part shrinkage characteristics, fine grained microstructures, and excellent strength/ductility attributes with comparable annealed material properties at temperatures up to 3500 deg F.

The potential erosion resistant materials are refractories such as W—Re, Re or Re/Mo and or ceramic composites with carbides, nitrides, and borides such as TaC, HfC, HfN, $HfB_2$, $ZrB_2$, $TiB_2$, SiC, or $B_4C$ depending on the type of propulsion system and material properties for high temperature protection (Table 1). The potential high temperature materials are rhenium based alloys such as molybdenum/rhenium and functional gradient Mo/Re ceramic composites with carbides and borides such as TaC, HfC, $HfB_2$, $ZrB_2$, $TiB_2$, SiC, or $B_4C$ in the decreasing order of melting points for high temperature protection. Rhenium's linear thermal expansion ($6.7\times10^{-6}$/deg) is very compatible with carbides. Also Rhenium is not a carbide former which is an added advantage.

Other additional composite additional material such as Hafnium (which has density of 13.31 g/cc and melting point of 2230 deg C.) used for CDC refractory composites developed in this innovation is desirable to provide high temperature protection up to temperatures (e.g., 2100° C. just below its melting point) as well as strengthening for the Mo/Re base matrix alloy.

The CDC Process

Combustion Driven Compaction (CDC) utilizes the controlled release of energy from combustion of natural gas and air to compact powders. In operation the following steps occur: Fill chamber to high pressure with a mixture of natural gas and air; As the chamber is being filled the piston or ram is allowed to move down pre-compressing and removing entrapped air from the powder; The gas supply is closed and an ignition stimulus is applied causing the pressure in the chamber to rise dramatically, further compressing the metal powder to its final net shape.

The basic CDC process is shown in FIG. 1. The CDC process is unique in utilizing the direct conversion of chemical energy to produce compaction. In addition, the process inherently includes a pre-compaction step preparing the powder for the final compaction load. The CDC process can provide standard or very high compaction tonnages resulting in very high-density parts with improved mechanical properties. In addition to the unique loading sequence and high tonnage the process occurs over a relatively short time frame (a few hundred milliseconds). A typical CDC produced load shown in FIG. 2 illustrates the faster process cycle time.

Significance of the Innovation

With greater demands for superior high temperature properties and erosion resistance and protect the C/C or C/SiC composite materials used in high temperature components, the needs for cost-effective fabrication in near net/net shape form and development of suitable high performance, well-bonded refractory based functional gradient high temperature materials are demanding and crucial. An innovative high pressure CDC powder compaction in near net shape has been used to manufacture such high temperature components. parts and select tensile mechanical samples.

Mo/Rhenium and select composite alloys of HfC, TaC and SiC and other advanced alloy composites can be used based on their high temperature properties such as Molybdenum, Niobium-based alloys, hafnium borides, boron carbides, and other borides and silicides with some carbon for absorbing the strains by few %. With the availability of select micro/nano powders in the commercial markets, CDC high pressure compaction is unique to produce high performance, dense, and simple/complex composite parts in both micron and nano structured form by faster (e.g., milliseconds) consolidation. The science of CDC processed high density powder material products and associated materials responses under high pressures are truly emerging research fields of critical importance and scientific value and our present innovation has resulted in a near net shape unique process together with cost effective manufacturing advantages and scaling up potential for production to fabricate Mo—Re based alloys and has far greater commercialization potential for other similar and other high density and high performance novel alloys and composites for various defense, energy and commercial applications.

EXPERIMENTAL MATERIALS PROCEDURES AND RESULTS

Powder Materials Used:

1. 52.5 Mo-47.5 Re (−200 mesh; ~<74 microns) and −635 mesh (~20 microns or less)
2. Select Mo/41% Re to fabricate Hollow Cylinder or Slugs (e.g., HTC-Design A) [Sample ID: 1436, 1437 in Table 5]
3. Select Mo/41% Re, Re, and W-25 Re Alloy Materials with select amounts of Hf and HfC (e.g., 0.5% Hf, 2 HfC) for the Feasibility Concept for Functional Gradient Layers of Materials to fabricate Hollow Cylinders or Slugs (e.g., HTC-Design A) [Sample ID: 1600, 1601 and 1602 in Table 5]
   Hf Powder (−325 mesh, ~<44 microns) & HfC Powder (−325 mesh, '<44 microns)

CDC Compaction Process Conditions 1. (CDC Pressure for Pressing/Compaction @ 85 tsi and 150 tsi and Suitable Diewall Lubricant
2. No binders or additives were added to the molybdenum-rhenium mix powder Type of Geometries Successfully Fabricated: 3.5 inch long tensile dogbones with select thickness; and several hollow (Design A, Design B) and complex shaped (Design C, Design D and Design E) high temperature components.

Die setup for Design A, B, C 300 Ton CDC press
Die preparation
Clean and lube die
Set die to fill heights
Powder fill
Design A, B
  Powder poured into die cavity, powder gently pressed into cavity to get required fill
Design C
  Shake Powder (screen in bottle cap) into die cavity, powder gently pressed into cavity to get required fill
Pre-Compaction (required for short pressing stroke on 300 ton press)
Upper punch inserted into die cavity
Bring piston in contact with Punch
  Fill chamber with air, pre-compacting powder
Relieved pressure re-spaced piston
Repeat as needed until chamber gas fill pressure is reached
Re-space piston for combustion
Combustion
Fill chamber with combustion mixture
Ignite mixture (compacting power)
Ejection
Exhaust combustion gases from chamber, maintaining some for back pressure for part ejection
Eject part from tooling as necessary
Die setup for Design D, E High Temperature Components: 400 Ton CDC press
Die preparation
Clean and lube die
Set die to fill heights
Powder fill
Powder is fill in die cavity using powder fluidizer
Hold the fluidizer over the cavity and open the exit chute
  Move the fluidizer around the cavity to evenly fill
  When the fluidizer is empty, spread the powder around to evenly distribute in the cavity
Pre-Compaction and Combustion
Upper punch inserted into die cavity
Bring piston in contact with Punch
Fill chamber with gas mixture, pre-compacting powder
Ignite mixture (compacting power)
Ejection
Exhaust combustion gases from chamber, maintaining some for back pressure for part ejection
Eject part from tooling as necessary 3. components (HTCs)
4. Suitable tooling assemblies to fabricate the various geometries in this innovation were procured and executed by UTRON team for use in various CDC compaction presses such as 300 Ton and 400 Ton CDC presses.
5. Sintering Experiments of CDC Samples in Hydrogen ~2300 deg C. for controlled and optimized hours)

Geometrical Properties 1. (Thickness, Width, Length for tensile samples of dog-bones)
2. Diameter, Thickness (disks), ID, OD & Thickness/Length (Rings)

Green Densities (e.g., ~75 to 86.66% for various high temperature components when pressed at 85 tsi-150 tsi) and Sintered Densities (e.g., ~98.59% depending on the powder alloy compositions and sintering conditions)

Shrinkage Properties: For 52.5 Mo/47.5 Re: ~ ~4% on the ID and OD to 6.85% on length (e.g., Sample 1457) depending on geometrical characteristics and CDC conditions (flange diameter, flange thickness, tube OD, tube ID, tube length etc) [Table 8]. In general, Higher Compaction pressures resulted in reducing the relative % shrinkages.

Mechanical Properties (hardness, elastic modulus, yield strength, tensile strength, strain at maximum stress, ductility etc), and elevated temperatures up to 3500 deg F. (FIG. 36)

Post-Process Finishing of Sintered CDC High Temperature Component Parts

1. Some fine grinding, Electron Discharge Machining (EDM) and proprietary vapor blast cleaning to obtain smoother surface finishes (e.g., of the order of 16 micro-inches) on the ID regions of the tube
2. The sequences of post-process finishing steps may involve one or combinations of the above generic descriptions depending on the geometry nature of the High Temperature Component Designs and the CDC parts have been found to have excellent responses in terms of types of curly wear chips after grinding etc indicating the higher part densities, less porosity, absence of cracking and/or delminations, and the retention of adequate ductility of the suitably optimized sintered parts etc during post-process finishing stages.
3. Some Design D Components have been examined using Dye Penetrant Testing and found to pass the tests indicating the physical integrity of the CDC process optimized near net shape components.

Select Microstructural Properties of Sintered Mechanical Test Samples and Post-Process Finished Final High Temperature Components Microstructure and Microchemistry of Post-Process Finished High Temperature Components (e.g., Select Sample of 1433)

Brief Procedure:

Objective

The purpose of this evaluation was to characterize the surface elemental composition in three key locations on a flanged tube: the flat, radius, and the inner diameter (ID) of CDC Compacted and Sintered High Temperature Component after post-process finishing steps and before hot-fire testing. The sample was reportedly vapor-blast cleaned.

Test Procedure and Results

The as-post process-finished CDC part was ultra-sonically cleaned in isopropyl alcohol for approximately five minutes. The surfaces were imaged in a scanning electron microscope (SEM) and shown in the FIG. 47*a*, (flat/flange) FIG. 47*b* (Transition/Radius) and FIG. 47*c* (ID—Internal Diameter Region). Preliminary estimates for the Semi-quantitative elemental analysis were conducted on the surfaces using energy dispersive spectroscopy (EDS). The sample was analyzed in three different regions of the part; flat, radius, and the ID. EDS spectra are shown in FIGS. 47*b*, 48*b* and 49*c*, respectively indicating the absence of copper or zinc from the EDM electrode or die wall lubricant. Semi-quantitative elemental analysis results revealed that the error associated with EDS analysis of light elements is greater than that of heavy elements.

1. This step was critical to demonstrate that the CDC final high temperature component parts were relatively free from die wall lubricant or other undesirable chemical contaminations due to the use of EDM electrodes or other cleaning chemicals (e.g., Copper, Zinc are less desirable) etc. Through this unique innovation, we claim that we have established the CDC Manufacturing Procedure for Mo—Re Based Refractory Alloy Materials. As compared to the previous arts of near net shaping by extensive machining and intensive intermediate process steps with lot of expensive materials wastage from a HIP or Swaged or Low Pressure Compacted (Conventional P/M) bar stock, We have effectively developed unique and novel art of high pressure CDC Compaction Process for the Near Net Shape Fabrication method with minimal materials wastage, higher part densities, retention of fine grained microstructures with minimal grain growth, and excellent high temperature strength and ductility attributes.

2. During the near net shape fabrication, All the above steps starting from the Powder Alloy Composition without any additive or binder, Controlled Size Distribution, CDC Compaction, Choice of Suitable Die Wall Lubricant, Optimal and Reproducible Sintering Cycle, and Well-Crafted Post-Process Finishing Steps were identified and successfully executed to obtain the final High Temperature Components.

3. Select CDC High Temperature Components have also been tested up to 3700 deg F.; 1500 psi hot fire tests and been evaluated for their adequate high temperature performance.

4. With limited number of parts being CDC processed in near net shape, successfully hot-fire tested (up to 3700 deg F.; 1500 psi pressure) and statistically acceptable number of tensile samples (e.g., Tables 10 and 11) being evaluated for high temperature behavior (up to 3500 deg F.), We claim that Our CDC process is also proven to yield consistent CDC part behavior in terms of manufacturability, reproducibility under identical CDC process conditions, less or no dependence whether it is 300 or 400 Ton CDC Press indicating the interchangeability and statistical acceptance of excellent high temperature strength and ductility with minimal scatter assuming the starting powder chemistry and nature are controllable within the desirable specifications.

Physical and Geometrical Properties

Select key results of the physical and geometrical properties of Green and sintered tensile samples and other processed geometries and Hydrogen Sintered CDC samples are provided. In general, the as-pressed and sintered samples were well-bonded under optimum compaction and sintering conditions and found to respond well for post-process finishing steps. The curly nature of wear chips after post-process steps such as suitable grinding indicated excellent ductility attributes of the sintered parts.

In general the green (75 to 82% of theoretical) and sintered densities (93 to 97% of theoretical densities) were relatively higher due to high pressure compaction at 150 tsi than those obtained normally with traditional powder metallurgical techniques.

The hydrogen sintered samples, in general, were well-bonded, free-from cracking, of smooth surface finish and of net shape quality. The near net shaping ability is demonstrated (FIGS. 8 and 9). The fine surface finishes are characteristics of CDC high pressure compaction (Table 14). The crack-free nature has indicated the need for unique faster loading cycle (FIG. 3) and the right powder selection/morphology.

Powder Selection and Morphology

The powder specifications include: 52.5 Mo-47.5 Re powder with −200 mesh, −635 mesh, Hafnium powder with −325 mesh (44 microns or smaller) and 99.6% purity, and Hafnium carbide powder with −325 mesh with 1-4 microns of average size. The powder morphologies were evaluated using microscopy. The narrow distribution, range of sizes within the mesh designation and non-spherical shape of the powders were evident and desirable for compaction. Both coarse and fine powders responded well for high pressure CDC compaction pressing. The die-cavity filling and reduced powder fill ratios were obtained by carefully control of inert gas delivery through the powder fluidizer system and gentler vibration of the tooling and the suitable parameters were optimized for the select powder grit size used in this innovation. This technique has been beneficial to handle relatively less flowable characteristics of finer sized powders.

Sintering Responses:

The sintering experiments at 2300 deg C. for controlled number of hours in hydrogen were carried out on select CDC samples. The sintering responses of samples revealed higher densification, good bonding, no cracking, fine surface quality and comparable mechanical properties of strength and ductility under optimum sintering conditions for the specific alloys of Molybdenum-Rhenium to those of wrought annealed materials. In fact, the high temperature sintering of CDC samples has improved the densification significantly and mechanical properties as compared to those traditionally compacted and sintered P/M materials.

In our previous Patent, we have also reported the sintering temperature effects on the sintered properties of similar novel advanced composite alloys of Re and Mo—Re. For example, CDC high pressure compacted samples sintered at 2100-2120 deg C. indicated higher sintered densities up to 97% of theoretical value than those sintered at lower sintering temperature at 1800 deg C.

The evaluation of the densities of previously reported samples of cylindrical disk samples sintered in Hydrogen at 2300 deg C. has resulted as follows:

Re Disk: #902 20.529 g/cc 97.67% of Theoretical Density

Re/1 Hf #900 20.183 g/cc 96.58% of Theoretical Density

Mo/Re Disk: #904 13.267 g/cc 94.80% of Theoretical Density

Mo/Re/1 Hf #906 13.068 g/cc 93.43% of Theoretical Density

Mo/Re/12.5 Hf #894 11.349 g/cc 82.15% of Theoretical Density

The ring sample #953 (fabricated with −200 mesh powder) had a sintered density of 13.154 g/cc (93.99% of theoretical density) and sample #954 (fabricated with 50% of −200 mesh powder and 50% of −635 mesh powder) had a sintered density of 12.956 g/cc_(92.58% of theoretical density). The shrinkage values of ring samples were relatively lower than those obtained in tensile dogbones.

As indicated previously, high sintered densities of optimum alloy compositions (e.g., Re, Mo/Re and alloys with low Hf % and HfC) are unique attributes of high pressure CDC compaction. These results also indicate the significance and dire scientific needs for further process optimization in our continuing efforts as of this patent application submission.

CDC Process Optimized Tensile Dogbones for Room and High Temperature

Mechanical Testing

Mechanical tensile dogbone samples of the Mo-47.5% Re alloy composition were fabricated by CDC compaction at intermediate compaction pressure of 85 tsi and suitable sintering cycle and evaluated for room and high temperature properties. FIGS. 37 and 38 show the optimally sintered tensile samples with fine surface quality, well-bonded, crack-free and of sintered high density (Table 10). FIG. 36 and Table 11 provide the major findings of the enhanced strength and superior high temperature ductility properties (reaching values of 100% ductility indicating super plastic behavior as commonly observed in nanostructured metals such as copper at room temperature). Results of Mo-47.5% Re tensile samples compacted at 150 tsi from the previously filed patent are also presented to provide the effects of intermediate to high CDC compaction pressures to obtain excellent and adequate high temperature properties. Quick glance of the HIP properties of similar Mo—Re alloy material has indicated the unique CDC high pressure compaction processing and optimization to obtain equivalent or better (e.g., much higher enhanced ductility) properties revealing the high temperature super plastic behavior). Also, the high temperature test results of CDC samples revealed lot less scatter of the mechanical properties indicating the excellent reproducibility attributes in CDC fabrication. Such superior high temperature mechanical properties as claimed in this innovation under similar CDC compaction conditions have been used to fabricate the near net shaped high temperature components (e.g., Design C) and successfully hot-fire tested as of filing this patent innovation. Select hot firing test results of other CDC compacted geometries (e.g., Design A) were done at 3700 deg F. and 1500 psi test pressures and additional near net shaped samples (Design C and Design D) are awaiting similar testing. These claims of not only innovative CDC manufacturing process steps but also the successful hot-fire test results of repeat samples of similar geometries (Design C) prove the reliable high temperature performance as well as the excellent reproducibility of the claimed innovation. Currently, this manufacturing innovation has already received significant attention and we anticipate to extend our claim to other potential end use application involving high temperature components.

Traditionally these kind of materials have been processed by Conventional Low Pressure Compaction followed by multi-steps post-processing, electron beam melting (EBM), consumable electrode vacuum arc casting (VAC), and other metal working processes such as extrusion, forging, rolling, rotary swaging, or seamless tube drawing. Each of these methods do have some benefits and limitations. The thermo-mechanical steps and high cost of processing these relatively expensive and scarcely available raw material stocks of otherwise extremely work-hardenable Mo—Re materials are known to affect the final mechanical properties, materials wastage, and cracking tendency, if not properly controlled, behavior during fabrication. Hence, it is desirable to minimize such texturing effects and materials wastage by minimal number of near net shape steps, and intelligent processing. This CDC high pressure consolidation manufacturing of select Mo—Re alloy High Temperature Component innovation as claimed in this patent together with the optimal material composition has led to a simplified few-step process of high pressure near net shape processing and already been proven and selected by the end users to be a competitive and cost-effective rapid manufacturing method as compared to HIPing and other conventional means.

Microstructural Results

The microstructural results (FIGS. 39-46) demonstrate the fine polycrystalline nature of fine grains in the as-sintered as well in the post-process finished final parts. In some cases (FIGS. 39 and 41), the hardness load (@ 150 kg-Rockwell C method) indentations were found to reveal no cracking indicating the ductile behavior of the CDC processed materials at room temperature. FIGS. 42 to 46 show the polycrystalline morphology of the final finished parts as well sintered microstructures. The absence of cracking or debonding is evident indicating the quality of CDC process control and optimization together with minimal grain growth. Some of these Design A, Design B and Design C High Temperature Components have been hot-fire tested at 3700 deg F. and 1500 psi pressures which revealed excellent mechanical behavior without any cracking, debonding or warping, for example. These results are in excellent agreement with the high temperature mechanical properties developed under similar CDC process conditions High Pressure Consolidation of Fine Re/Mo—Re Powders:

The unique advantages of high pressure compaction up to 150 tsi to fabricate high temperature tensile mechanical test samples and other geometries of a variety of powder sizes (e.g., −200 mesh, <74 microns and −635 mesh, ~<20 microns) have been claimed previously and are apparent [Ref: Patent Pending]. In this invention, we have focused on specifically finer grit (e.g., −635 mesh) 52.5 Mo-47.5 Re material using CDC intermediate high pressure of 85 tsi to fabricate near net shape high temperature component designs (Design C, Design D and Design E). Designs A and B were produced by CDC compaction up to 150 tsi. Both 300 and 400 Ton Presses have been used successfully to fabricate HTC-Designs A to C. 400 Ton Press was used for only near net shape Design D and Design E. In addition, we have also extended the present innovation's unique high pressure CDC compaction (at 150 tsi) and post-processing thermal procedures to other similar material group systems such as Mo-41 Re. It is important to highlight that the finer grit size (e.g., −635 mesh) powders of Re Mo/Re are known to be difficult to be pressed by traditional P/M methods at compaction pressures <50-55 tsi. The technical basis for such approach is beneficial to produce CDC high density metal matrix composites in near or net shape with finer carbide distribution to further improve the high temperature strength and durability mechanical properties.

SUMMARY OF CONCLUSIONS

Molybdenum-Rhenium based high temperature (e.g., 52.5 Mo/47.5 Re by weight %) powder materials have been compacted in various geometrical shapes using high pressure CDC compaction at 85 tsi-150 tsi and sintered successfully for high temperature mechanical property enhancement and process optimization.

In summary, the Mo/Re (52.5Mo-47.5Re) alloys can be compacted successfully at 85 to 150 tsi using a 300 ton CDC press with much higher green and sintered densities, crack-free parts during CDC pressing at high pressures and unique faster CDC loading cycle of milliseconds, comparable room temperature and high temperature (up to 3500 deg F.) mechanical properties equivalent or better to those of Hot Isostatic Pressed materials, near net shaping ability to fabricate different geometries (tensile dogbones, hollow slugs and near net shape shapes) and functional gradient layered materials, fine surface finish/quality, process flexibility to fabricate novel powder alloys, controllable grain sizes, microstructures and microchemistry and significant cost effectiveness in both materials wastage minimization and manufacturing. This unique technology can manufacture high temperature components economically.

With high pressure CDC compaction press, many of the challenges with other manufacturing methods can be overcome. The powder handling and compaction with both macro, micro as well as nano-sized powder alloys and composite powders can be carried out successfully at high pressures to improve the densification, for example. Also, the CDC process can be done in controlled inert conditions (e.g., using glove box and inert gas supply in the die/punch setup). This manufacturing is also amenable for functional gradient structures of several layers of differing materials and composites for multi-functional use. Such manufacturing strategy using CDC process is anticipated to be a competitive alternative than the existing traditional rapid prototyping fabrication methods, conventional P/M and wrought methods and conventional coating processes.

In light of several other manufacturing methods as discussed above, the high pressure CDC compaction process is expected to have several unique cost-effective manufacturing advantages of high pressure densification, ability to press coarse, fine and even nano powders, rapid development for advanced composite materials of unique compositions tailoring to the material property and functional property needs for high temperature applications, net shaping ability, lot less or no scrap metal % and improved mechanical and microstructural attributes for developing advanced high temperature system (HTS) components.

The Combustion Driven Compaction process involves the following steps. A chamber is filled with a mixture of natural gas and air. The gas mixture is combusted, driving a piston or ram into a die containing metallic powder, compressing the powder into a desired shape. As the chamber is filled with gas, the piston or ram is allowed to rest on the powder, pre-compressing the powder and removing trapped air. During compression, compaction pressures reach up to 85 tsi or more (max value of 150 tsi). Traditional pressing technologies using hydraulic or mechanical pressing are limited to ~50-55 tsi and usually result in less part green and sintered densities and require several post-processing steps to obtain higher final part densities similar to what we have obtained in this innovation. In the conventional pressing methods, post-processing steps may involve additional steps such intermediate sintering, annealing, mechanical rolling etc. to enhance the part densification together with large part shrinkages. In a previous art using HIP method used for high temperature ceramic and refractory metals which involves both heating and pressure during pressing and is not suitable for scaling-up or rapid production together with limited tool life, the process usually involves prolonged heating for hours followed by low pressure (e.g., typical range of 15, 000-60, 000 psi) consolidation. In CDC compaction, the loading profile is unique to provide both pre-compaction step followed by high pressure final pressing all in one stroke which occurs within several hundred milliseconds. After compression, the near net shaped component is suitably sintered in a hydrogen environment at 2300 deg C. for up to 4 hours to obtain higher sintered part densities, microstructures with finer grain sizes and minimal grain growth attributes, followed by carefully controlled post-process steps to get the final finished dimensions. This CDC process creates near net shape components due to less part shrinkage, with much less scrap metal. The CDC compaction apparatus used to perform this process is about the size of a telephone booth and can be moved with a standard forklift. The high temperature material for the near net shaped component was procured in the form of elemental mechanically blended powder of Mo—Re (52.5 Mo-47.5 Re) composition. The produced Mo—Re near net shaped components have also passed successfully the hot-fire testing and the equivalent tensile samples processed under similar CDC compaction process conditions as well as resulted in high temperature mechanical strength/ductility/superplastic properties up to 3500 deg F. which are equivalent or better than hot-isostatically pressed (HIP) material properties with relatively minimal scatter of the data. Although we have attempted to extend the present CDC processing innovation to fabricate other similar and dissimilar functional gradient layers which include a combination of Mo/Re, HfC and Hf of a fineness dictated by desired shrinkage, resulting in a material suitable for high temperature propulsion systems and other higher-stress, high-temperature component system applications.

While the invention has been described with reference to specific embodiments, modifications and variations of the invention may be constructed without departing from the scope of the invention, which is defined in the following claims.

TABLE 1

Properties of Refractory and Ceramic Materials
TABLE 1.1 Some Properties of More Common Refractory Metals and Binary Ceramics[a]

| Material | | Density (g/cc) | MP (° C.) | CTE (ppm/° C.) | E (GPa) | Other |
|---|---|---|---|---|---|---|
| A) Refractory metals | Nb | 8.4 | 2470 | 9 | 100 | Ductile |
| | Ta | 16.6 | 3000 | 8 | 190 | Ductile |
| | Mo | 10.2 | 2620 | 8 | 320 | |
| | W | 19.3 | 3400 | 7 | 420 | |
| | Re | 22 | 3180 | 7 | 480 | Expensive |
| B) Borides | $HfB_2$ | 11.2 | 3250 | 6-7 | | |
| | $NbB_2$ | 7.2 | 2900 | 9 | | Decomposes |

TABLE 1-continued

Properties of Refractory and Ceramic Materials
TABLE 1.1 Some Properties of More Common Refractory Metals and Binary Ceramics[a]

| Material | | Density (g/cc) | MP (° C.) | CTE (ppm/° C.) | E (GPa) | Other |
|---|---|---|---|---|---|---|
| | $TaB_2$ | 12.6 | 3000 | 6-7 | 260 | |
| | $TiB_2$ | 4.5 | 2900 | 7 | 500 | |
| | $WB_2$ | | 2900 | | | |
| | $ZrB_2$ | 6.1 | 3000 | 8 | 450 | |
| C) Carbides | HfC | 12.7 | 3880 | 7 | 430 | |
| | SiC | 3.2 | 2600 | 6 | 450 | Sublimes |
| | NbC | 7.8 | 3700 | 7 | 450 | |
| | TaC | 14.5 | 3700 | 9 | 450 | |
| | TiC | 4.9 | 3140 | 9 | 450 | |
| | ZrC | 6.7 | 3450 | 8 | 420 | |
| D) Nitrides | BN | 2.2 | 3000 | High crystalline anisotropy | | Sublimes |
| | HfN | 13.9 | 3300 | 7 | | |
| | TaN | 14.1 | 3200 | 5 | | |
| | ThN | 11.6 | 2800 | | | α-emitter |
| | TiN | 5.4 | 2950 | 10 | 260 | |
| | ZrN | 7.4 | 2980 | 8 | | |
| E) Oxides | BeO | 3 | 2500 | 8 | 400 | Toxic |
| | $HfO_2$ | 9.7 | 2750 | 11 | | |
| | MgO | 3.6 | 2800 | 16 | 350 | Hydrates |
| | $ThO_2$ | 9.8 | 3200 | 11 | 240 | α-emitter |
| | $ZrO_2$ | 5.7 | 2715 | 12 | 230 | |

[a]MP = melting point, CTE = coefficient of thermal expansion, and E = Young's modulus.

TABLE 2

CDC Processed Ceramic Properties

CDC Ceramics
Parts are Pressable up to 150 tsi
Higher Density Products (e.g., ~97-99% Dense after Suitable Sintering)
Less Part Shrinkages
Carbide, Nitride, and Other Type of Ceramics and their composites
Potential Applications include Armor ceramics, microwave absorbers, high temperature/wear resistant parts, electrical dielectric insulators, and cutting tools
Typical Green Properties Using High Pressure CDC Compaction @ 150 tsi**

| Sample #: | Description: | Green Density (g/cc) | Percent of Theory: | ID (in) | OD (in) | Height (in) | Mass (g) | Theoretical Density: (g/cc) | Die Geometry: |
|---|---|---|---|---|---|---|---|---|---|
| 956 | Nano SiC 45-55 nm | 1.8648 | 57.97 | | 1.015 | 0.062 | 1.533 | 3.217 | 1" Cylinder |
| 1129 | Sub-micron-SiC | 2.2734 | 70.67 | 0.3240 | 0.5055 | 0.1950 | 0.859 | 3.217 | Ring |
| 1130 | <44 microns-HfC (−325 mesh) | 8.1736 | 64.51 | 0.3220 | 0.5040 | 0.2050 | 3.242 | 12.670 | Ring |
| 1265 | Nano B4C + 1 wt % Al2O3 | 1.5048 | 58.81 | | 1.0130 | 0.0795 | 1.580 | 2.5589 | 1" Cylinder |
| 1266 | Nano B4C | 1.4332 | 56.87 | | 1.0110 | 0.0820 | 1.546 | 2.5200 | 1" Cylinder |

**Karthik Nagarathnam, "CERAMIC DEFENSE: Pressing with Controlled Combustion" Published in *Ceramic Industry*, by BNP media, Jun. 1, 2006, (Electronic Version of the Publication is available in the following link: http://www.ceramicindustry.com/CDA/Articles/Feature_Article/10cd85375737b010

TABLE 3

Select Microstructural Properties of CDC Compacted Re, Mo and W-Based Alloy Materials Typical Microstructures

| Sample # | Grain Size (ASTM No.) | Grain Size (Avg. Diameter) |
|---|---|---|
| 1513-Mo-41Re | 5 | 63.5 microns |
| 1525-W-25Re | 7 | 31.8 microns |
| 1537-Re-Ta-Hf-2HfC | 6.5 | 37.8 microns |
| 1514-Rhenium | 8 | 22.5 microns |

TABLE 4

CDC Compaction Properties of As-Pressed (Green) Mechanical Test Samples

| Test #: | Sample #: | Date: | Description: | Target Load (tsi) | Green Density (g/cc) | Percent of Theory: | Die Geometry: | Press |
|---|---|---|---|---|---|---|---|---|
| 1942 | 1713 | Nov. 12, 2007 | MoRe (−635) | 85 | 78.84 | 27.029 | Tensile | 300T |
| 1943 | 1714 | Nov. 13, 2007 | MoRe (−635) | 85 | 78.80 | 27.031 | Tensile | 300T |
| 1944 | 1715 | Nov. 14, 2007 | MoRe (−635) | 85 | 78.65 | 27.024 | Tensile | 300T |
| 1945 | 1716 | Nov. 14, 2007 | MoRe (−635) | 85 | 78.65 | 27.036 | Tensile | 3001 |
| 1946 | 1717 | Nov. 14, 2007 | MoRe (−635) | 85 | 78.56 | 27.022 | Tensile | 300T |
| 1947 | 1718 | Nov. 14, 2007 | MoRe (−635) | 85 | 78.66 | 27.040 | Tensile | 300T |
| 1948 | 1719 | Nov. 14, 2007 | MoRe (−635) | 85 | 78.36 | 27.040 | Tensile | 300T |
| 1949 | 1720 | Nov. 14, 2007 | MoRe (−635) | 85 | 78.51 | 27.033 | Tensile | 300T |
| 1950 | 1721 | Nov. 14, 2007 | MoRe (−635) | 85 | 77.97 | 27.034 | Tensile | 300T |
| 1951 | 1722 | Nov. 15, 2007 | MoRe (−635) | 85 | 79.20 | 27.021 | Tensile | 300T |
| 1952 | 1723 | Nov. 15, 2007 | MoRe (−635) | 85 | 78.54 | 27.044 | Tensile | 300T |
| 1953 | 1724 | Nov. 15, 2007 | MoRe (−635) | 85 | 78.33 | 27.028 | Tensile | 300T |
| 1954 | 1725 | Nov. 16, 2007 | MoRe (−635) | 85 | 79.43 | 26.938 | Tensile | 300T |
| 1955 | 1726 | Nov. 16, 2007 | MoRe (−635) | 85 | 78.94 | 26.978 | Tensile | 300T |
| 1956 | 1727 | Nov. 16, 2007 | MoRe (−635) | 85 | 78.73 | 27.020 | Tensile | 300T |
| 1957 | 1728 | Nov. 16, 2007 | MoRe (−635) | 85 | 78.44 | 27.039 | Tensile | 300T |
| 1958 | 1729 | Nov. 19, 2007 | MoRe (−635) | 85 | 79.03 | 27.021 | Tensile | 300T |
| 1959 | 1730 | Nov. 19, 2007 | MoRe (−635) | 85 | 78.66 | 27.027 | Tensile | 300T |
| 1960 | 1731 | Nov. 19, 2007 | MoRe (−635) | 150 | 86.99 | 27.029 | Tensile | 300T |

TABLE 5

CDC Experimental Matrix of High Temperature Component Fabrication of Various Design Geometrics Using 52.5 Mo-47 Re (called MoRe)

| Test #: | Sample #: | Date: | Description: | Target Load (tsi) | Green Density (g/cc) | Percent of Theory: | Die Geometry: | Press |
|---|---|---|---|---|---|---|---|---|
| 1236 | 1031 | Dec. 13, 2004 | MoRe (−200 mesh) | 50 | | | SC-HTC | 300T |
| 1237 | 1032 | Dec. 14, 2004 | MoRe (−200) | 50 | | | SC-HTC | 300T |
| 1238 | 1033 | Dec. 14, 2004 | MoRe (−200) | 50 | | | SC-HTC | 300T |
| 1239 | 1034 | Dec. 15, 2004 | MoRe (−200) | 50 | | | SC-HTC | 300T |
| 1240 | 1035 | Dec. 15, 2004 | MoRe (−200) | 50 | | | SC-HTC | 300T |
| 1241 | 1036 | Dec. 16, 2004 | MoRe (−200) | 50 | | | SC-HTC | 300T |
| 1242 | 1037 | Dec. 16, 2004 | MoRe (−200) | 50 | | | SC-HTC | 300T |
| 1243 | 1038 | Dec. 16, 2004 | MoRe (−200) | 50 | | | SC-HTC | 300T |
| 1246 | 1041 | Dec. 20, 2004 | MoRe (−200) | 50 | | | SC-HTC | 300T |
| 1658 | 1432 | Sep. 6, 2006 | MoRe (−200) | 50 | 8.7076 | 64.41 | HTC-A | 300T |
| 1659 | 1433 | Sep. 7, 2006 | MoRe (−200) | 100 | 10.4169 | 77.05 | HTC-A | 300T |
| 1660 | 1434 | Sep. 7, 2006 | MoRe (−635 mesh) | 100 | 10.3674 | 76.69 | HTC-A | 300T |
| 1661 | 1435 | Sep. 8, 2006 | MoRe (−635) | 150 | 11.1163 | 82.22 | HTC-A | 300T |
| 1662 | 1436 | Sep. 21, 2006 | 41% MoRe (−635) | 150 | 10.8688 | 83.95 | HTC-A | 300T |
| 1663 | 1437 | Oct. 23, 2006 | 41% MoRe (−635) | 150 | 10.7899 | 83.34 | HTC-A | 300T |
| 1682 | 1456 | Nov. 8, 2006 | MoRe (−635) | 150 | 11.1836 | 82.72 | HTC-A | 300T |
| 1683 | 1457 | Nov. 9, 2006 | MoRe (−635) | 150 | 11.1953 | 82.81 | HTC-A | 300T |
| 1684 | 1458 | Nov. 9, 2006 | MoRe (−635) | 150 | 11.0359 | 81.63 | HTC-A | 300T |
| 1685 | 1459 | Nov. 10, 2006 | MoRe (−635) | 150 | 11.0307 | 81.59 | HTC-A | 300T |
| 1686 | 1460 | Nov. 13, 2006 | MoRe (−635) | 150 | 11.1205 | 82.26 | HTC-A | 300T |
| 1687 | 1461 | Nov. 13, 2006 | MoRe (−635) | 150 | 11.0961 | 82.07 | HTC-A | 300T |
| 1692 | 1466 | Jan. 5, 2007 | MoRe (−635) | 100 | 11.0494 | 81.73 | HTC-B | 300T |
| 1693 | 1467 | Jan. 5, 2007 | MoRe (−635) | 150 | 11.5267 | 85.26 | HTC-B | 300T |
| 1694 | 1468 | Jan. 8, 2007 | MoRe (−635) | 150 | 11.5144 | 85.17 | HTC-B | 300T |
| 1695 | 1469 | Jan. 8, 2007 | MoRe (−635) | 150 | 11.5695 | 85.58 | HTC-B | 300T |
| 1696 | 1470 | Jan. 9, 2007 | MoRe (−635) | 150 | 11.5051 | 85.10 | HTC-B | 300T |
| 1697 | 1471 | Jan. 9, 2007 | MoRe (−635) | 150 | 11.4816 | 84.93 | HTC-B | 300T |
| 1705 | 1479 | Feb. 1, 2007 | MoRe (−635) | 20 | 8.3150 | 61.50 | HTC-C | 300T |
| 1706 | 1480 | Feb. 2, 2007 | MoRe (−635) | 20 | 8.2739 | 61.20 | HTC-C | 300T |
| 1707 | 1481 | Feb. 5, 2007 | MoRe (−635) | 42 | 9.2636 | 68.52 | HTC-C | 300T |
| 1708 | 1482 | Feb. 6, 2007 | MoRe (−635) | 56 | 9.6389 | 71.30 | HTC-C | 300T |
| 1709 | 1483 | Feb. 7, 2007 | MoRe (−635) | 56 | 9.5429 | 70.59 | HTC-C | 300T |
| 1710 | 1484 | Feb. 8, 2007 | MoRe (−635) | 56 | 9.5487 | 70.63 | HTC-C | 300T |
| 1711 | 1485 | Feb. 9, 2007 | MoRe (−635) | 84 | 10.1053 | 74.75 | HTC-C | 300T |
| 1712 | 1486 | Feb. 21, 2007 | MoRe (−635) | 84 | | | HTC-C | 300T |
| 1713 | 1487 | Feb. 22, 2007 | MoRe (−635) | 84 | 10.1955 | 75.42 | HTC-C | 300T |
| 1714 | 1488 | Feb. 23, 2007 | MoRe (−635) | 84 | 10.1984 | 75.43 | HTC-C | 300T |
| 1829 | 1600 | Jul. 27, 2007 | Re (200) 0.5% Hf 2% HfC | 150 | 14.7164 | 71.14 | HTC-A | 300T |
| 1830 | 1601 | Aug. 3, 2007 | Re (200) 0.5% Hf 2% HfC/41% MoRe (−635) | 150 | 12.8212 | 78.05 | HTC-A | 300T |

TABLE 5-continued

CDC Experimental Matrix of High Temperature Component Fabrication of Various Design Geometrics Using 52.5 Mo-47 Re (called MoRe)

| Test #: | Sample #: | Date: | Description: | Target Load (tsi) | Green Density (g/cc) | Percent of Theory: | Die Geometry: | Press |
|---|---|---|---|---|---|---|---|---|
| 1831 | 1602 | Aug. 6, 2007 | Re (200) 0.5% Hf 2% HfC/WRe25/41% MoRe (−635) | 150 | 13.6426 | 77.63 | HTC-A | 300T |
| K13 | K13 | Jan. 19, 2007 | MoRe (−635) | 100 | 11.0293 | 81.58 | HTC-B | 1000T |
| K14 | K14 | Jan. 22, 2007 | MoRe (−635) | 150 | 11.7122 | 86.63 | HTC-B | 1000T |
| K15 | K15 | Jan. 22, 2007 | MoRe (−635) | 150 | 11.2881 | 83.49 | HTC-B | 1000T |
| K16 | K16 | Jan. 23, 2007 | MoRe (−635) | 150 | 11.6146 | 85.91 | HTC-B | 1000T |

15

TABLE 6

Properties of As-Compacted Green HTC Parts

HTC-A

| Sample #: | Description: | Green Density: (g/cc) | Percent of Theory: | Mass: (g) | ID (in) | OD (in) | Length (in) | Theoretical Density (g/cc) | Load (tsi) |
|---|---|---|---|---|---|---|---|---|---|
| 1432 | MoRe (−200) | 8.7076 | 64.41 | 352.0 | 0.4780 | 1.3580 | 1.9440 | 13.5195 | 50 |
| 1433 | MoRe (−200) | 10.4169 | 77.05 | 350.1 | 0.4770 | 1.3570 | 1.6180 | 13.5195 | 100 |
| 1434 | MoRe (−635) | 10.3674 | 76.69 | 350.4 | 0.4765 | 1.3565 | 1.6280 | 13.5195 | 100 |
| 1435 | MoRe (−635) | 11.1163 | 82.22 | 372.1 | 0.4765 | 1.3570 | 1.6110 | 13.5195 | 150 |
| 1436 | 41% MoRe (−635) | 10.8688 | 83.95 | 355.5 | 0.4765 | 1.3565 | 1.5755 | 12.9475 | 150 |
| 1437 | 41% MoRe (−635) | 10.7899 | 83.34 | 355.3 | 0.4760 | 1.3560 | 1.5870 | 12.9475 | 150 |
| 1456 | MoRe (−635) | 11.1836 | 82.72 | 390.4 | 0.4765 | 1.3567 | 1.6810 | 13.5195 | 150 |
| 1457 | MoRe (−635) | 11.1953 | 82.81 | 390.0 | 0.4765 | 1.3565 | 1.6780 | 13.5195 | 150 |
| 1458 | MoRe (−635) | 11.0359 | 81.63 | 390.4 | 0.4765 | 1.3567 | 1.7035 | 13.5195 | 150 |
| 1459 | MoRe (−635) | 11.0307 | 81.59 | 390.1 | 0.4770 | 1.3567 | 1.7033 | 13.5195 | 150 |
| 1460 | MoRe (−635) | 11.1205 | 82.26 | 390.4 | 0.4768 | 1.3568 | 1.6905 | 13.5195 | 150 |
| 1461 | MoRe (−635) | 11.0961 | 82.07 | 390.6 | 0.4768 | 1.3568 | 1.6950 | 13.5195 | 150 |

HTC-B

| Sample #: | Description: | Green Density: (g/cc) | Percent of Theory: | Mass: (g) | ID (in) | OD (in) | Length (in) | Theoretical Density (g/cc) | Load (tsi) |
|---|---|---|---|---|---|---|---|---|---|
| 1466 | MoRe (−635) | 11.0494 | 81.73 | 400.3 | 0.4760 | 1.5278 | 1.3355 | 13.5195 | 100 |
| 1467 | MoRe (−635) | 11.5267 | 85.26 | 400.0 | 0.4760 | 1.5282 | 1.2785 | 13.5195 | 150 |
| 1468 | MoRe (−635) | 11.5144 | 85.17 | 400.3 | 0.4758 | 1.5283 | 1.2805 | 13.5195 | 150 |
| 1469 | MoRe (−635) | 11.5695 | 85.58 | 400.6 | 0.4760 | 1.5283 | 1.2755 | 13.5195 | 150 |
| 1470 | MoRe (−635) | 11.5051 | 85.10 | 400.4 | 0.4760 | 1.5286 | 1.2815 | 13.5195 | 150 |
| 1471 | MoRe (−635) | 11.4816 | 84.93 | 400.4 | 0.4760 | 1.5287 | 1.2840 | 13.5195 | 150 |
| K13 | MoRe (−635) | 11.0293 | 81.58 | 399.9 | 0.4770 | 1.5282 | 1.3365 | 13.5195 | 100 |
| K14 | MoRe (−635) | 11.7122 | 86.63 | 399.9 | 0.4760 | 1.5293 | 1.2560 | 13.5195 | 150 |
| K15 | MoRe (−635) | 11.2881 | 83.49 | 400.5 | 0.4760 | 1.5307 | 1.3025 | 13.5195 | 150 |
| K16 | MoRe (−635) | 11.6146 | 85.91 | 400.3 | 0.4760 | 1.5292 | 1.2680 | 13.5195 | 150 |

HTC-C

| Sam-ple #: | Description: | Green Density: (g/cc) | Percent of Theory: | Mass: (g) | ID (in) | OD flange (in) | OD bushing (in) | Length flange (in) | Length part (in) | Theoretical Density (g/cc) | Load (tsi) |
|---|---|---|---|---|---|---|---|---|---|---|---|
| 1479 | MoRe (−635) | 8.3150 | 61.50 | 99.235 | 0.2000 | 1.5300 | 0.7090 | 0.1600 | 1.2890 | 13.5195 | 20 |
| 1480 | MoRe (−635) | 8.2739 | 61.20 | 105.046 | 0.2010 | 1.5320 | 0.7090 | 0.2040 | 1.3200 | 13.5195 | 20 |
| 1481 | MoRe (−635) | 9.2636 | 68.52 | 104.568 | 0.2010 | 1.5290 | 0.7090 | 0.1580 | 1.2700 | 13.5195 | 42 |
| 1482 | MoRe (−635) | 9.6389 | 71.30 | 110.041 | 0.2010 | 1.5270 | 0.7090 | 0.1660 | 1.2620 | 13.5195 | 56 |
| 1483 | MoRe (−635) | 9.5429 | 70.59 | 109.730 | 0.2010 | 1.5270 | 0.7090 | 0.1670 | 1.2600 | 13.5195 | 56 |
| 1484 | MoRe (−635) | 9.5487 | 70.63 | 109.683 | 0.2010 | 1.5265 | 0.7090 | 0.1690 | 1.2625 | 13.5195 | 56 |
| 1485 | MoRe (−635) | 10.1053 | 74.75 | 120.140 | 0.2010 | 1.5280 | 0.7090 | 0.1845 | 1.2670 | 13.5195 | 84 |
| 1487 | MoRe (−635) | 10.1955 | 75.42 | 130.052 | 0.2010 | 1.5285 | 0.7090 | 0.2130 | 1.2990 | 13.5195 | 84 |
| 1488 | MoRe (−635) | 10.1984 | 75.43 | 130.042 | 0.2010 | 1.5280 | 0.7090 | 0.2130 | 1.2990 | 13.5195 | 84 |

TABLE 7

Properties of Optimally Sintered CDC High Temperature Component Geometries

HTC-A

| Sample #: | Description: | Sintered Density (g/cc) | Percent of Theory: | Mass: (g) | ID (in) | OD (in) | Length (in) | Theoretical Density (g/cc) | Load (tsi) |
|---|---|---|---|---|---|---|---|---|---|
| 1432 | MoRe (−200) | 13.0479 | 96.51 | 351.31 | 0.4216 | 1.2008 | 1.6550 | 13.5195 | 50 |
| 1433 | MoRe (−200) | 13.1253 | 97.08 | 349.47 | 0.4404 | 1.2618 | 1.4795 | 13.5195 | 100 |
| 1434 | MoRe (−635) | 13.1697 | 97.41 | 349.63 | 0.4409 | 1.2583 | 1.4850 | 13.5195 | 100 |
| 1435 | MoRe (−635) | 13.2195 | 97.78 | 371.15 | 0.4518 | 1.2837 | 1.5110 | 13.5195 | 150 |
| 1436 | 41% MoRe (−635) | 12.6023 | 97.33 | 354.68 | 0.4535 | 1.2945 | 1.4875 | 12.9475 | 150 |
| 1437 | 41% MoRe (−635) | | | | | | | 12.9475 | 150 |
| 1456 | MoRe (−635) | 13.1736 | 97.44 | 389.59 | 0.4537 | 1.2915 | 1.5715 | 13.5195 | 150 |
| 1457 | MoRe (−635) | 13.1516 | 97.28 | 389.08 | 0.4560 | 1.2956 | 1.5630 | 13.5195 | 150 |
| 1458 | MoRe (−635) | 13.1530 | 97.29 | 389.63 | 0.4545 | 1.2906 | 1.5775 | 13.5195 | 150 |
| 1459 | MoRe (−635) | 13.1868 | 97.54 | 389.30 | 0.4533 | 1.2886 | 1.5765 | 13.5195 | 150 |
| 1460 | MoRe (−635) | 13.1440 | 97.22 | 389.64 | 0.4547 | 1.2932 | 1.5715 | 13.5195 | 150 |
| 1461 | MoRe (−635) | 13.1254 | 97.09 | 389.78 | 0.4540 | 1.2933 | 1.5735 | 13.5195 | 150 |

HTC-C

| Sample #: | Description: | Sintered Density (g/cc) | Percent of Theory: | Mass: (g) | ID (in) | OD flange (in) | OD brushing (in) | Length flange (in) | Length part (in) | Theoretical Density (g/cc) | Load (tsi) |
|---|---|---|---|---|---|---|---|---|---|---|---|
| 1479 | MoRe (−635) | | | | | | | | | 13.5195 | 20 |
| 1480 | MoRe (−635) | 13.3092 | 98.44 | 104.61 | 0.1755 | 1.2988 | 0.6400 | 0.1645 | 1.0995 | 13.5195 | 20 |
| 1481 | MoRe (−635) | 13.3235 | 98.55 | 104.19 | 0.1820 | 1.3580 | 0.6300 | 0.1350 | 1.0870 | 13.5195 | 42 |
| 1482 | MoRe (−635) | 13.3083 | 98.44 | 109.66 | 0.1835 | 1.3975 | 0.6285 | 0.1495 | 1.0820 | 13.5195 | 56 |
| 1483 | MoRe (−635) | | | 109.36 | 0.1830 | 1.3985 | 0.6250 | 0.1510 | 1.0740 | 13.5195 | 56 |
| 1484 | MoRe (−635) | 13.2633 | 98.11 | 109.28 | 0.1825 | 1.4025 | 0.6220 | 0.1535 | 1.0720 | 13.5195 | 56 |
| 1485 | MoRe (−635) | | | 119.59 | 0.1855 | 1.4310 | 0.6300 | 0.1725 | 1.0940 | 13.5195 | 84 |
| 1487 | MoRe (−635) | 13.3289 | 98.59 | 129.69 | 0.1855 | 1.4255 | 0.6330 | 0.1963 | 1.1310 | 13.5195 | 84 |
| 1488 | MoRe (−635) | 13.3121 | 98.47 | 129.66 | 0.1850 | 1.4275 | 0.6330 | 0.1965 | 1.1298 | 13.5195 | 84 |

TABLE 8

Minimal Dimensional Changes of CDC Compacted and Optimally Sintered Parts

HTC-A

| Sample #: | Description: | ID (%) | OD (%) | Length (A) | Load (tsi) |
|---|---|---|---|---|---|
| 1432 | MoRe (−200) | −11.24 | −11.06 | −14.87 | 50 |
| 1433 | MoRe (−200) | −7.29 | −6.53 | −8.56 | 100 |
| 1434 | MoRe (−635) | −7.18 | −6.79 | −8.78 | 100 |
| 1435 | MoRe (−635) | −4.89 | −4.91 | −6.21 | 150 |
| 1436 | 41% MoRe (−635) | −4.53 | −4.11 | −5.59 | 150 |
| 1437 | 41% MoRe (−635) | | | | 150 |
| 1456 | MoRe (−635)* | −4.49 | −4.33 | −6.51 | 150 |
| 1457 | MoRe (−635) | −4.00 | −4.03 | −6.85 | 150 |
| 1458 | MoRe (−635) | −4.32 | −4.40 | −7.40 | 150 |
| 1459 | MoRe (−635) | −4.56 | −4.55 | −7.44 | 150 |
| 1460 | MoRe (−635) | −4.28 | −4.21 | −7.04 | 150 |
| 1461 | MoRe (−635) | −4.42 | −4.20 | −7.17 | 150 |
| | | from die 0.475" | from die 1.35" | from green | |

HTC−C

| Sample #: | Description: | ID (%) | OD flange (%) | OD bushing (%) | Length flange (%) | Length part (%) | Load (tsi) |
|---|---|---|---|---|---|---|---|
| 1479 | MoRe (−635) | | | | | | 20 |
| 1480 | MoRe (−635) | −12.25 | −14.67 | −12.57 | −19.36 | −16.70 | 20 |
| 1481 | MoRe (−635) | −9.00 | −10.78 | −10.43 | −14.56 | −14.41 | 42 |
| 1482 | MoRe (−635) | −8.25 | −8.18 | −10.71 | −9.94 | −14.26 | 56 |
| 1483 | MoRe (−635) | −8.50 | −8.11 | −11.07 | −9.58 | −14.76 | 56 |
| 1484 | MoRe (−635) | −8.75 | −7.85 | −11.57 | −9.17 | −15.09 | 56 |
| 1485 | MoRe (−635) | −7.25 | −5.98 | −10.36 | −6.50 | −13.65 | 84 |
| 1487 | MoRe (−635) | −7.25 | −6.34 | −10.00 | −7.86 | −12.93 | 84 |

TABLE 8-continued

| Minimal Dimensional Changes of CDC Compacted and Optimally Sintered Parts | | | | | | | |
|---|---|---|---|---|---|---|---|
| 1488 | MoRe (−635) | −7.50 from die 0.2" | −6.21 from die 1.522" | −10.00 from die 0.7" | −7.75 from green | −13.03 from green | 84 |

TABLE 9

CDC Compacted Green Properties of Design D and E

| Sample #: | Date: | Description: | Green Density (g/cc) | Percent of Theory: | Mass: (g) | ID (in) | OD flange (in) | OD bushing (in) | Thickness flange (in) | Length part (in) | Theoretical Density (g/cc) |
|---|---|---|---|---|---|---|---|---|---|---|---|
| 4735-01 | Dec. 21, 2007 | HTC-D | 10.2932 | 76.14 | 118.883 | 0.1990 | 1.3930 | 0.7065 | 0.1450 | 1.4980 | 13.5195 |
| 4735-02 | Jan. 2, 2008 | HTC-D | 10.3651 | 76.67 | 119.522 | 0.2000 | 1.3930 | 0.7063 | 0.1450 | 1.4970 | 13.5195 |
| 4735-03 | Jan. 3, 2008 | HTC-D | 10.3896 | 76.85 | 119.323 | 0.1995 | 1.3935 | 0.7063 | 0.1420 | 1.4975 | 13.5195 |
| 4735-04 | Jan. 3, 2008 | HTC-D | 10.3504 | 76.56 | 119.866 | 0.1995 | 1.3940 | 0.7068 | 0.1470 | 1.4955 | 13.5195 |
| 4735-05 | Jan. 4, 2008 | HTC-D | 10.4123 | 77.02 | 199.652 | 0.1995 | 1.3930 | 0.7067 | 0.1410 | 1.5005 | 13.5195 |
| 4735-06 | Jan. 7, 2008 | HTC-D | 10.5100 | 77.74 | 120.200 | 0.2000 | 1.3930 | 0.7063 | 0.1380 | 1.5030 | 13.5195 |
| 4735-07 | Jan. 16, 2008 | HTC-D | 10.6790 | 78.99 | 119.657 | 0.2000 | 1.3945 | 0.7063 | 0.1280 | 1.4940 | 13.5195 |
| 4735-08 | Jan. 24, 2008 | HTC-D | 10.4849 | 77.55 | 119.722 | 0.1983 | 1.3935 | 0.7068 | 0.1390 | 1.4920 | 13.5195 |
| 4735-09 | Jan. 24, 2008 | HTC-D | 10.2756 | 76.01 | 120.088 | 0.1985 | 1.3930 | 0.7067 | 0.1500 | 1.5040 | 13.5195 |

| Sample #: | Date: | Description: | Green Density (g/cc) | Percent of Theory: | Mass: (g) | ID (in) | OD (in) | Depth top counterbore (in) | Depth bottom counterbore (in) | Length part (in) | Theoretical Density (g/cc) |
|---|---|---|---|---|---|---|---|---|---|---|---|
| 4736-01 | Jan. 21, 2008 | HTC-E | 10.6911 | 79.08 | 349.8 | 0.3750 | 1.5058 | 0.1570 | 0.3070 | 1.4580 | 13.5195 |
| 4736-02 | Jan. 21, 2008 | HTC-E | 10.6928 | 79.09 | 349.3 | 0.3750 | 1.5055 | 0.1520 | 0.3020 | 1.4550 | 13.5195 |

TABLE 10

Sintered Density Properties of Mechanical Test CDC Samples

| Specimen Number | Density (g/cc) | Theoretical (g/cc) | % Dense |
|---|---|---|---|
| TN-1713 | 13.3208 | 13.52 | 98.53% |
| TN-1714 | 13.3214 | 13.52 | 98.53% |
| TN-1715 | 13.3240 | 13.52 | 98.55% |
| TN-1716 | 13.3025 | 13.52 | 98.39% |
| TN-1717 | 13.3129 | 13.52 | 98.47% |
| TN-1718 | 13.3088 | 13.52 | 98.44% |
| TN-1719 | 13.3065 | 13.52 | 98.42% |
| TN-1720 | 13.3133 | 13.52 | 98.47% |
| TN-1721 | 13.3072 | 13.52 | 98.43% |
| TN-1722 | 13.2923 | 13.52 | 98.32% |
| TN-1723 | 13.3297 | 13.52 | 98.59% |
| TN-1724 | 13.2918 | 13.52 | 98.31% |

TABLE 10-continued

Sintered Density Properties of Mechanical Test CDC Samples

| Specimen Number | Density (g/cc) | Theoretical (g/cc) | % Dense |
|---|---|---|---|
| TN-1725 | 13.3284 | 13.52 | 98.58% |
| TN-1726 | 13.2955 | 13.52 | 98.34% |
| TN-1727 | 13.2894 | 13.52 | 98.29% |
| TN-1728 | 13.3393 | 13.52 | 98.66% |
| TN-1729 | 13.2981 | 13.52 | 98.36% |
| TN-1730 | 13.2946 | 13.52 | 98.33% |
| TN-1731 | 13.2398 | 13.52 | 97.93% |

TN specimen densities were measured using the immersion density method in alcohol Theoretical density value from Rhenium Alloys, Inc. Technical Properties webpage TN-1731 was produced using high-pressure CDC, all other specimens were produced with intermediate-pressure CDC

TABLE 11

Room and High Temperature Mechanical Properties of 52.5 Mo-47.5 Re Test Samples

| Specimen Number | Temp (F.) | Top Half Length (in) | Bottom Half Length (in) | Original Gage Length (in) | % Elongation |
|---|---|---|---|---|---|
| TN-1713 | 70 | 0.5890 | 0.6150 | 1.00 | 20.40% |
| TN-1714 | 70 | 0.5685 | 0.6430 | 1.00 | 21.25% |
| TN-1715 | 70 | 0.5875 | 0.6365 | 1.00 | 22.40% |
| TN-1716 | 1500 | 0.6240 | 0.6120 | 1.00 | 23.60% |
| TN-1717 | 1500 | 0.6370 | 0.5915 | 1.00 | 22.85% |
| TN-1718 | 1500 | 0.5915 | 0.6520 | 1.00 | 24.35% |
| TN-1719 | 2000 | 0.6500 | 0.6230 | 1.00 | 27.30% |
| TN-1720 | 2000 | 0.6230 | 0.6645 | 1.00 | 28.75% |
| TN-1721 | 2000 | 0.5740 | 0.7340 | 1.00 | 30.80% |
| TN-1722 | 2500 | 0.6495 | 0.8705 | 1.00 | 52.00% |

TABLE 11-continued

Room and High Temperature Mechanical Properties of 52.5 Mo-47.5 Re Test Samples

| Specimen Number | Temp (F.) | Top Half Length (in) | Bottom Half Length (in) | Original Gage Length (in) | % Elongation |
|---|---|---|---|---|---|
| TN-1723 | 2500 | 0.6160 | 0.8630 | 1.00 | 47.90% |
| TN-1724 | 2500 | 0.6345 | 0.8105 | 1.00 | 44.50% |
| TN-1728 | 3000 | 0.9390 | 0.7940 | 1.00 | 73.30% |
| TN-1729 | 3000 | 0.7655 | 1.0215 | 1.00 | 78.70% |
| TN-1730 | 3000 | 0.7825 | 0.9360 | 1.00 | 71.85% |
| TN-1731 | 3000 | 0.6970 | 0.9210 | 1.00 | 61.80% |
| TN-1725 | 3500 | 0.6990 | 1.0120 | 1.00 | 71.10% |
| TN-1726 | 3500 | 1.2735 | 0.6750 | 1.00 | 94.85% |
| TN-1727 | 3500 | 1.0505 | 0.9545 | 1.00 | 100.50% |

| Sample #: | Density (g/cc) | Percent of Theory: | Mass (g) | Die Geometry: | Condition |
|---|---|---|---|---|---|
| 1433 | 13.2375 | 97.91 | 40.121 | HTC-A | Machined |

20

TABLE 12

Properties of CDC Compacted and Processed Geometries

| Sample #: | Density (g/cc) | Percent of Theory: | Mass: (g) | Die Geometry: | Condition |
|---|---|---|---|---|---|
| 1433 | 13.2375 | 97.91 | 40.121 | HTC-A | Machined |
| 1434 | 13.2538 | 98.03 | 346.510 | HTC-A | Sintered |
| 1435 | 13.2032 | 97.66 | 38.190 | HTC-A | Machined |
| 1436 | 12.6706 | 97.86 | 354.660 | HTC-A | Sintered, MoRe41 |
| 1456 | 13.2661 | 98.13 | 389.570 | HTC-A | Sintered |
| 1460 | 13.2359 | 97.90 | 389.610 | HTC-A | Sintered |
| 1461 | 13.2271 | 97.84 | 389.750 | HTC-A | Sintered |
| 1469 | 13.1495 | 97.26 | 20.366 | HTC-B | Machined |
| 1480 | 13.2635 | 98.11 | 52.580 | HTC-C | Sintered, longitudinally |
| | 13.2689 | 98.15 | 38.752 | | sectioned for testing |
| 1481 | 13.2756 | 98.20 | 104.190 | HTC-C | Sintered |
| 1482 | 13.2496 | 98.00 | 53.190 | HTC-C | Sintered, longitudinally |
| | 13.2630 | 98.10 | 43.926 | | sectioned for testing |
| 1484 | 13.2156 | 97.75 | 109.290 | HTC-C | Sintered |
| 1485 | 13.2594 | 98.08 | 19.022 | HTC-C | Machined |
| K15 | 13.1649 | 97.38 | 20.433 | HTC-B | Machined |

TABLE 13

Optimally Sintered CDC Mo/Re Ring Sample Properties [44, 48 49]

| Sample #: | Description: | Mass: grams | ID (in): | OD (in): | Height (in): | Density (g/cc) |
|---|---|---|---|---|---|---|
| 1023 | Mo/Re (−200) | 5.1878 | 0.3045 | 0.4780 | 0.2300 | 12.9086 |
| 1024 | Mo/Re (−200) Mo/Re (−635) 50% | 5.1978 | 0.3055 | 0.4790 | 0.2305 | 12.8725 |
| 1025 | Mo/Re (−635) | 5.1168 | 0.3070 | 0.4820 | 0.2225 | 12.9408 |
| 1026 | Mo/Re (−200/−635) 1% Hf 2% HfC | 5.2001 | 0.3055 | 0.4790 | 0.2320 | 12.7949 |
| 1027 | Mo/Re (−200/−635) 5% Hf 2% HfC | 5.2199 | 0.3060 | 0.4815 | 0.2335 | 12.5677 |
| 1028 | Mo/Re (−635) 1% Hf 2% HfC | 5.2345 | 0.3055 | 0.4805 | 0.2280 | 12.9684 |
| 1029 | Mo/Re (−635) 5% Hf 2% HfC | 5.4333 | 0.3080 | 0.4840 | 0.2425 | 12.4888 |
| 1030 | Mo/Re(−200) 1% Hf | 5.1606 | 0.3030 | 0.4600 | 0.2315 | 12.8521 |

What is claimed is:

1. A method of manufacturing high operating temperature Re containing composite near net shape parts comprising providing a combustion driven compaction press with a piston, a materials cavity and a male die and a chamber on opposite ends of the piston, mechanically blending mixtures of Re powders and other metallurgical powders, placing the mechanically blended powders in the cavity of the combustion driven compaction press, placing the male die on the blended powders in the chamber, filling the chamber of the press with combustible gas and an oxidizer under pressure, moving the piston in a direction of the cavity and the male die further into the cavity under pressure of the filling of the chamber, cold compressing the mechanically blended powders under a force of the filling of the chamber, igniting and combusting the gas in the chamber, increasing pressure rapidly and smoothly to about 85 tons per square inch or more in the chamber by the combustion, driving the piston and the male die into the cavity with the combustion induced increased pressure in the chamber, compacting the blended mixtures of the powders by high pressure compaction into a formed Re containing composite part, removing the formed Re containing composite part from the cavity, and sintering the formed Re containing composite part for a prolonged period of approximately three or more hours at a high temperature of about 2300° C. or more in a controlled environment, thereby producing dense, high strength, high temperature withstanding parts in near net shape with little or no waste capable of withstanding temperatures of 3,500° F. resulting in material suitable for high temperature applications with ductility and superplastic properties.

2. The method of claim 1, wherein the controlled environment is hydrogen.

3. The method of claim 1, wherein the combusting gas in the chamber and the drawing the piston into the cavity further comprises creating pressures in the compressed powers from about 85 tsi to about 150 tsi.

4. The method of claim 1, wherein the blended powders comprised powders of from about −635 mesh to about −200 mesh.

5. The method of claim 1, wherein the blended powders and the formed product is selected from the group consisting of Mo-41 Re; W-25Re; Re-0.5Hf-2HfC; Re-5 Ta-0.5Hf-2HfC; Re-5 Mo-0.5 Hf-2HfC; Mo-41 Re-10 W; Mo-41Re-10 Ta; Mo-41Re-0.5 Hf-2HfC; W-25 Re-0.5 Hf-2 HfC; W-25Re-5Ta-0.5 Hf-2HfC; and W-25Re-5 Mo-0.5Hf-2 HfC alloys.

6. The method of claim 1, wherein the mixture of Re and the other metallurgical powders is 52.5 Molybdenum-47.5% Rhenium, wherein the average grain size after sintering is approximately 64 microns or smaller.

7. The method of claim 6, wherein a top part of the piston in the chamber has a larger diameter than the bottom part of the piston.

8. A method of forming high operating temperature near net shape Re containing composite near net shape parts comprising providing a press with a forming die cavity, a driving chamber and a piston and a male die extending between the chamber and the cavity, mechanically blending mixtures of RE containing metallurgical powders having sizes of about −635 mesh to about −200 mesh, placing the blended powders in the die cavity of the press, filling the chamber of the press with combustible material, and an oxidant, moving the piston in a direction of the cavity by the filling of the chamber, thereby pre-compressing the blended powders in the cavity by the filling of the chamber and the moving of the piston, igniting and combusting the combustible material with the oxidant, rapidly expanding the chamber with products of the combustion, driving the piston into the cavity and compacting and forming the mixed and compressed powders into a near net shape Re containing composite green part having 72-85% theoretical density, and sintering the formed Re containing composite near net shape part for a prolonged period of approximately three or more hours at a high temperature of about 2300° C. in a hydrogen controlled environment and producing a sintered part having 98% or more theoretical density, strength of 135 ksi ductility of 30% or more and hardness of 315 VHN or greater with a polycrystallic microstructure and average grain size of <64 microns.

9. The method of claim 8, wherein the metallurgical powders and the Re composite parts are selected from the group consisting of Mo—Re, W—Re, Re—Hf—HfC, Re—Ta—Hf—HfC, Re—Mo—Hf—HfC, Mo—Re—Ta, Mo—Re—Hf—HfC, W—Re—Hf—HfC, W—Re—Ta—Hf—HfC or and W—Re—Mo—Hf.

10. The method of claim 8, wherein the combustible material is $CH_4$ and the oxidant is air.

11. The method of claim 8, wherein the combusting and driving of the piston creates forces and pressures in the cavity and compressed mixed powders of from about 85 to about 150 tons per square inch.

12. The method of claim 8, further comprising sintering the near net shape Re composite part for about four hours at about 2300° C. in hydrogen, wherein the average grain size after sintering is approximately 64 microns or smaller.

13. The method of claim 8, wherein the mixture of metallurgical powders is 52.5 Molybdenum-47.5% Rhenium.

* * * * *